US011842702B2

(12) United States Patent
Mito et al.

(10) Patent No.: US 11,842,702 B2
(45) Date of Patent: Dec. 12, 2023

(54) LIQUID CRYSTAL DISPLAY APPARATUS CAPABLE OF CHANGING BACKLIGHT EMISSION BRIGHTNESS

(71) Applicant: CANON KABUSHIKI KAISHA, Tokyo (JP)

(72) Inventors: Koji Mito, Kanagawa (JP); Yasuo Suzuki, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/511,797

(22) Filed: Oct. 27, 2021

(65) Prior Publication Data

US 2022/0157267 A1 May 19, 2022

(30) Foreign Application Priority Data

Nov. 13, 2020 (JP) ..... 2020-189430
Aug. 30, 2021 (JP) ..... 2021-140204

(51) Int. Cl.
*G09G 3/36* (2006.01)
*G09G 3/00* (2006.01)

(52) U.S. Cl.
CPC ..... *G09G 3/00* (2013.01); *G09G 2320/066* (2013.01); *G09G 2320/0626* (2013.01); *G09G 2354/00* (2013.01); *G09G 2360/16* (2013.01)

(58) Field of Classification Search
None
See application file for complete search history.

(56) References Cited

U.S. PATENT DOCUMENTS 10,186,209 B1 * 1/2019 Shah ..... G09G 3/20
2007/0273686 A1 * 11/2007 Watanabe ..... G06T 15/506 345/419
2010/0194777 A1 * 8/2010 Yamano ..... H04N 1/465 382/165

(Continued)

FOREIGN PATENT DOCUMENTS

JP 5456050 A 3/2014

OTHER PUBLICATIONS

Schuchhardt, Matthew, User-aware System Design and Optimization, Northwestern University. ProQuest Dissertations Publishing, 2015. 3741317 (Year: 2015).*

*Primary Examiner* — Benjamin C Lee
*Assistant Examiner* — Emily J Frank
(74) *Attorney, Agent, or Firm* — Cowan, Liebowitz & Latman, P.C.

(57) ABSTRACT

A liquid crystal display apparatus includes: a liquid crystal panel; an input interface for inputting data of a first image; a backlight module; and at least one memory and at least one processor which function as: an estimating unit configured to estimate brightness of light to be irradiated from the backlight module to the liquid crystal panel; a correcting unit configured to correct the first image to a second image based on the brightness estimated by the estimating unit, a contrast of the liquid crystal panel, and a target contrast so that a brightness error with respect to a display brightness in a case where the first image is displayed with the target contrast is suppressed; and a control unit configured to control transmittance of the liquid crystal panel based on data of the second image.

20 Claims, 30 Drawing Sheets

(56) References Cited

U.S. PATENT DOCUMENTS

| | | | | |
|---|---|---|---|---|
| 2011/0267379 | A1* | 11/2011 | Kurabayashi | G09G 3/3426 345/102 |
| 2014/0292631 | A1* | 10/2014 | Vasquez | G09G 3/2096 345/102 |
| 2018/0247609 | A1* | 8/2018 | Joshi | G09G 3/3426 |
| 2020/0126512 | A1* | 4/2020 | Amin | G09G 5/003 |
| 2022/0068238 | A1* | 3/2022 | Chappalli | G09G 5/10 |

* cited by examiner

*FIG. 28A*

LOCAL DIMMING SETTING

| | |
|---|---|
| DISPLAY CONTRAST | LOW |
| DARK PART COLOR GAMUT EXPANSION | ON |

*FIG. 28B*

LOCAL DIMMING SETTING

| | |
|---|---|
| DISPLAY CONTRAST | HIGH |
| DARK PART COLOR GAMUT EXPANSION | **LOW** |

*FIG. 28C*

LOCAL DIMMING SETTING

| | |
|---|---|
| DISPLAY CONTRAST | LOW |
| DARK PART COLOR GAMUT EXPANSION | **ON** |
| | OFF |

LIQUID CRYSTAL DISPLAY APPARATUS CAPABLE OF CHANGING BACKLIGHT EMISSION BRIGHTNESS

BACKGROUND OF THE INVENTION

Field of the Invention

The present invention relates to a liquid crystal display apparatus capable of changing an emission brightness of a backlight module and to a control method thereof.

Description of the Related Art

Higher contrasts are required in display apparatuses for displaying images with relatively wide dynamic ranges that are referred to as HDR (High Dynamic Range) images or the like. Representative display apparatuses include an OLED (Organic Light Emitting Diode) display apparatus and a liquid crystal display apparatus (LCD apparatus). While an organic EL (Electro Luminescence) element emits light for each pixel in an OLED display apparatus, a liquid crystal panel adjusts a transmission amount of light irradiated from a backlight module for each pixel in an LCD apparatus. In an LCD apparatus, since the light irradiated from the backlight module cannot be completely blocked, black floating due to light leakage occurs. Therefore, in an LCD apparatus, contrast of display is lower than in an OLED display apparatus that is a self-luminous display apparatus.

When reducing black floating and improving contrast with an LCD apparatus, generally, a technique referred to as local dimming is used. Local dimming is a technique for reducing black floating by controlling emission brightness of a backlight module for each divided region. However, reducing the emission brightness of the backlight module also lowers display brightness of parts other than a dark part at the same time. In this case, the display brightness can be compensated by correcting an image to be displayed on the LCD apparatus. As a technique for compensating display brightness having been lowered by local dimming by image correction, Japanese Patent No. 5456050 discloses a technique of multiplying a gradation value of an image by an inverse of brightness (backlight brightness; intensity) of light from the backlight module which a liquid crystal panel is irradiated with.

However, with the conventional technique of multiplying a gradation value of an image by an inverse of backlight brightness creates a specific brightness error (error of display brightness).

SUMMARY OF THE INVENTION

The present invention provides a technique that enables display in which a specific brightness error has been suppressed to be performed.

The present invention in its first aspect provides a liquid crystal display apparatus comprising: a liquid crystal panel; an input interface for inputting data of a first image; a backlight module which is configured to irradiate light to the liquid crystal panel and of which emission brightness is changeable; and at least one memory and at least one processor which function as: an estimating unit configured to estimate brightness of light to be irradiated from the backlight module to the liquid crystal panel; a correcting unit configured to correct the first image to a second image based on the brightness estimated by the estimating unit, a contrast of the liquid crystal panel, and a target contrast so that a brightness error with respect to a display brightness in a case where the first image is displayed with the target contrast is suppressed; and a control unit configured to control transmittance of the liquid crystal panel based on data of the second image.

The present invention in its second aspect provides a control method of a liquid crystal display apparatus including a liquid crystal panel, an input interface for inputting data of a first image, and a backlight module which is configured to irradiate light to the liquid crystal panel and of which emission brightness is changeable, the control method comprising: an estimating step of estimating brightness of light to be irradiated from the backlight module to the liquid crystal panel; a correcting step of correcting the first image to a second image based on the brightness estimated in the estimating step, a contrast of the liquid crystal panel, and a target contrast so that a brightness error with respect to a display brightness in a case where the first image is displayed with the target contrast is suppressed; and a control step of controlling transmittance of the liquid crystal panel based on data of the second image.

The present invention in its third aspect provides a non-transitory computer readable medium that stores a program, wherein the program causes a computer to execute a control method of a liquid crystal display apparatus including a liquid crystal panel, an input interface for inputting data of a first image, and a backlight module which is configured to irradiate light to the liquid crystal panel and of which emission brightness is changeable, the control method comprising: an estimating step of estimating brightness of light to be irradiated from the backlight module to the liquid crystal panel; a correcting step of correcting the first image to a second image based on the brightness estimated in the estimating step, a contrast of the liquid crystal panel, and a target contrast so that a brightness error with respect to a display brightness in a case where the first image is displayed with the target contrast is suppressed: and a control step of controlling transmittance of the liquid crystal panel based on data of the second image.

Further features of the present invention will become apparent from the following description of exemplary embodiments with reference to the attached drawings.

BRIEF DESCRIPTION OF THE DRAWINGS

FIGS. 28A to 28C are diagrams showing examples of an OSD menu according to the seventh example;

DESCRIPTION OF THE EMBODIMENTS

Figure 1:
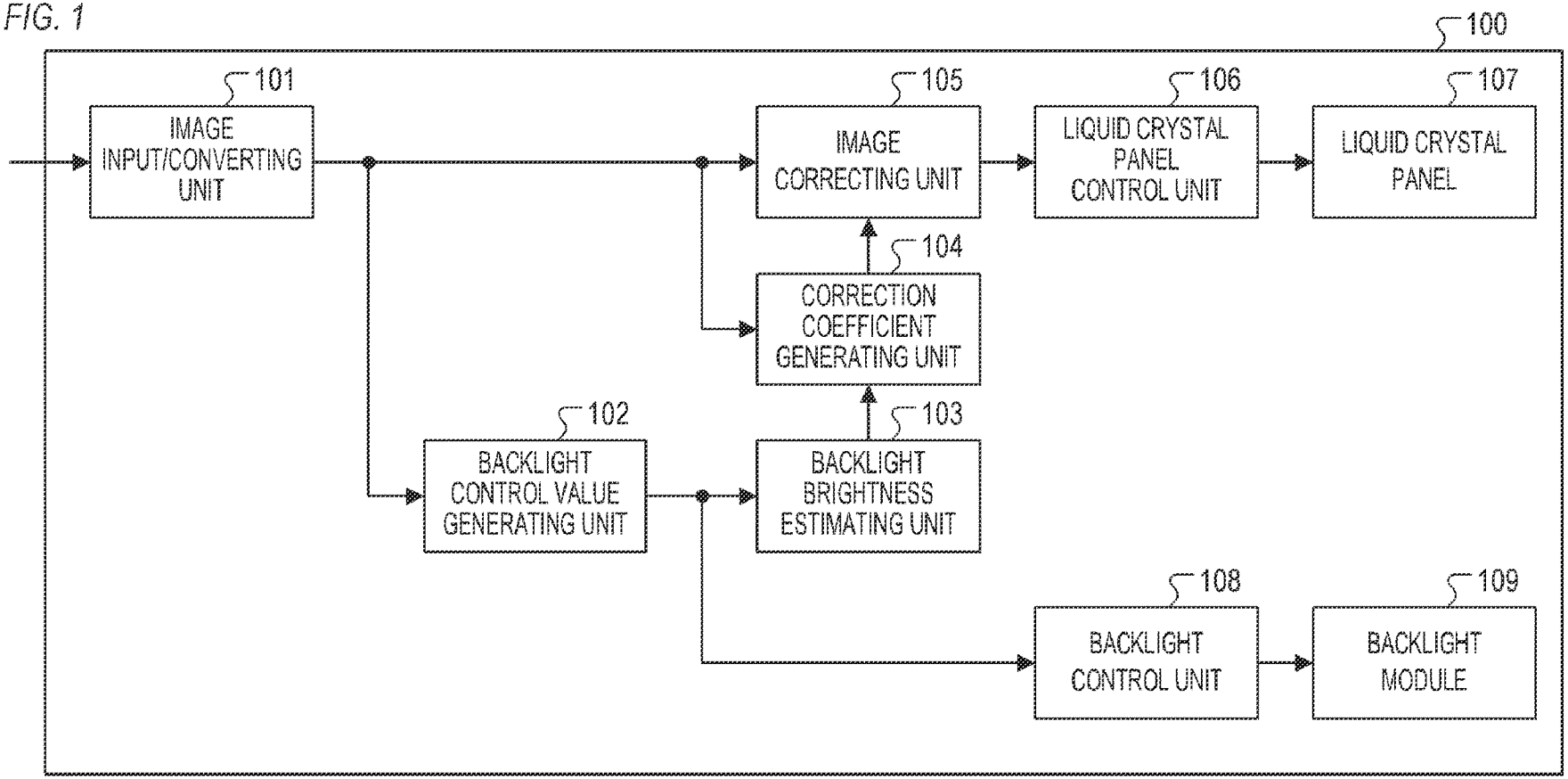
FIG. 1 is a block diagram showing functional blocks of a liquid crystal display apparatus according to a first example.

Hereinafter, an embodiment of the present invention will be described with reference to the drawings. It is to be understood that the technical scope of the present invention is to be defined by the scope of claims and is not intended to be limited by the embodiment exemplified below. Furthermore, not all of the combinations of features described in the embodiment are essential to the present invention. Contents described in the present specification and in the drawings are exemplary and are not intended to limit or restrict the present invention. Various modifications can be made based on the spirit of the present invention and such modifications are not to be excluded from the scope of the invention. In other words, all configurations that combine the embodiment and modifications thereof are to be included in the present invention.

As will be described later, the inventors of the present invention found that a specific brightness error occurs in conventional techniques in which a gradation value of an image is multiplied by an inverse of brightness (backlight brightness; intensity) of light from a backlight module which a liquid crystal panel is irradiated with. In this case, the specific brightness error refers to an error with respect to a display brightness when the image is displayed with a target contrast and, at the same time, an error related to a backlight brightness and a panel contrast (a contrast of the liquid crystal panel). Display brightness refers to brightness on a display surface on which the image is to be displayed. A contrast of a display refers to a ratio between an upper limit and a lower limit of the display brightness. A contrast of the liquid crystal panel refers to a contrast of a display on the liquid crystal panel when the backlight brightness is set uniform within the display surface. The contrast of the liquid crystal panel can also be described as a ratio between an upper limit and a lower limit of transmittance of the liquid crystal panel.

If white brightness is 1000 nit when display is performed with a contrast of 1 million to 1, black brightness is 0.001 nit and a brightness dynamic range (a dynamic range of brightness) is 0.001 to 1000 nit. In addition, when a gradation value of an image is 0.0025, as expressed by the following calculation formula, normalization to the brightness dynamic range of 0.001 to 1000 nit results in display brightness corresponding to the gradation value 0.0025 of 2.5009975 nit. In this case, the contrast of 1 million to 1 will be considered a target contrast (an ideal contrast) and a display brightness (2.5009975 nit) thereof will be considered a target display brightness.

$$0.0025\times(1000\text{ nit}-0.001\text{ nit})+0.001\text{ nit}=2{,}499998\text{ nit}+0.001\text{ nit}=2.5009975\text{ nit} \quad \text{[Math. 1]}$$

In a liquid crystal display apparatus (LCD apparatus), the contrast of a liquid crystal panel (a panel contrast) is often around 1000 to 1. If white brightness is 1000 nit when the panel contrast is 1000 to 1, then black brightness is 1 nit and the brightness dynamic range is 1 to 1000 nit. In addition, when an image is not corrected, as expressed by the following calculation formula, normalization to the brightness dynamic range of 0.001 to 1000 nit results in display brightness corresponding to the gradation value 0.0025 of 3.4975 nit.

$$0.0025\times(1000\text{ nit}-1\text{ nit})+1\text{ nit}=3.4975\text{ nit} \quad \text{[Math. 2]}$$

Now, let us assume that the backlight brightness having been normalized to 0 to 1 (0% to 100%) is 1 (100%). When an image is to be corrected using the conventional technique described above, the gradation value 0.0025 is multiplied by an inverse (1/1=1 time) of the backlight brightness and the display brightness corresponding to the gradation value 0.0025 remains 3.4975 nit.

$$(0.0025\times1\text{ time})\times(1000\text{ nit}-1\text{ nit})+1\text{ nit}=2.4975\text{ nit}+1\text{ nit}=3.4975\text{ nit} \quad \text{[Math. 3]}$$

When the backlight brightness is lowered to 0.5 (50%), the white brightness and the black brightness are respectively lowered by 50% and the brightness dynamic range becomes 0.5 to 500 nit. In addition, when an image is not corrected, as expressed by the following calculation formula, normalization to the brightness dynamic range of 0.5 to 500 nit results in display brightness corresponding to the gradation value 0.0025 of 1.74875 nit.

$$0.0025\times(500\text{ nit}-0.5\text{ nit})+0.5\text{ nit}=1.74875\text{ nit} \quad \text{[Math. 4]}$$

When an image is to be corrected using the conventional technique described above, the gradation value 0.0025 is multiplied by an inverse (1/0.5=2 times) of the backlight brightness and the display brightness corresponding to the gradation value 0.0025 becomes 2.9975 nit.

$$(0.0025\times 2\text{ times})\times(500\text{ nit}-0.5\text{ nit})+0.5\text{ nit}=2.4975\text{ nit}+0.5\text{ nit}=2.9975\text{ nit} \quad \text{[Math. 5]}$$

When the panel contrast is changed to 2000 to 1, black brightness is brightness that is 1/2000 of white brightness. When the backlight brightness is 0.5 (50%), since the white brightness is 500 nit, the black brightness is 0.25 nit and the brightness dynamic range is 0.25 to 500 nit. In addition, when an image is not corrected, as expressed by the following calculation formula, normalization to the brightness dynamic range of 0.25 to 500 nit results in display brightness corresponding to the gradation value 0.0025 of 1.499375 nit.

$$0.0025\times(500\text{ nit}-0.25\text{ nit})+0.25\text{ nit}=1.499375\text{ nit} \quad \text{[Math. 6]}$$

When an image is to be corrected using the conventional technique described above, the gradation value 0.0025 is multiplied by an inverse (1/0.5=2 times) of the backlight brightness and the display brightness corresponding to the gradation value 0.0025 becomes 2.74875 nit.

$$(0.0025\times 2\text{ times})\times(500\text{ nit}-0.25\text{ nit})+0.25\text{ nit}=2.49875\text{ nit}+0.25\text{ nit}=2.74875\text{ nit} \quad \text{[Math. 7]}$$

As described above, with the conventional technique in which an image is corrected using an inverse of backlight brightness, an increase in black floating in conjunction with an increase in the backlight brightness and a decrease in the panel contrast results in an increase in a brightness error with respect to a target display brightness. While the brightness error due to black floating relatively decreases in a bright part, the brightness error due to black floating relatively increases in a dark part. Therefore, with the conventional technique described above, a brightness error related to the backlight brightness and the panel contrast increases particularly in dark regions and black floating becomes more visible.

First Example

Hereinafter, a first example of the present invention will be described. FIG. 1 is a block diagram showing functional blocks of a liquid crystal display apparatus 100 according to the first example. The liquid crystal display apparatus 100 includes an image input/converting unit 101, a backlight control value generating unit 102, a backlight brightness estimating unit 103, a correction coefficient generating unit 104, an image correcting unit 105, a liquid crystal panel control unit 106, a liquid crystal panel 107, a backlight control unit 108, and a backlight module 109.

The image input/converting unit 101 acquires image data (data of an image) from the outside. Specifically, the image input/converting unit 101 has an input interface such as an SDI (Serial Digital Interface) and inputs the image data to the liquid crystal display apparatus 100 from the outside via the input interface. In addition, the image input/converting unit 101 applies conversion processing such as gradation conversion or signal format conversion to the acquired (input) image data and outputs image data after the conversion processing.

The gradation conversion is, for example, gradation conversion using a one-dimensional lookup table (1D-LUT) which is gradation conversion in accordance with a gamma value (panel gamma) of the liquid crystal panel 107. Let us now consider a case where gamma characteristics (a correspondence relationship between a gradation value and brightness: gradation characteristics) of image data acquired from the outside are linear characteristics in which the brightness linearly increases with respect to an increase in the gradation value and panel gamma is 2.0. In this case, gradation conversion using an inverse gamma (in other words, 1/2.0) of the panel gamma is performed. Accordingly, the acquired image data (image data having linear characteristics) is converted into image data having gamma characteristics in which brightness is proportional to 1/2.0 power of the gradation value. It should be noted that the conversion processing by the image input/converting unit 101 is not limited to gradation conversion using a 1 D-LUT and may include conversion processing using a three-dimensional lookup table (3D-LUT), gain adjustment, offset adjustment, matrix conversion, or the like.

Signal format conversion is, for example, processing of converting a signal format of the image data from YCbCr or XYZ into RGB. It should be noted that signal formats before and after the conversion are not limited to YCbCr, XYZ, and RGB.

The backlight control value generating unit 102 generates a backlight control value for controlling the backlight module 109 based on image data (input image data; data of the input image) output from the image input/converting unit 101. In addition, the backlight control value generating unit 102 outputs the generated backlight control value. Emission brightness (emission intensity) of the backlight module 109 can be changed. Specifically, the backlight module 109 emits light with emission brightness in accordance with the backlight control value. In the first example, a plurality of divided regions that constitute a display surface are set in advance, and the backlight module 109 has a plurality of light sources that respectively correspond to the plurality of divided regions and enables emission brightness to be changed for each divided region. While the light sources of the backlight module 109 are not particularly limited, for example, the light sources are LEDs (Light Emitting Diodes). In addition, the backlight control value generating unit 102 generates the backlight control value for each divided region. For example, the backlight control value is determined in accordance with a characteristic value (a statistic) such as a maximum gradation value or an average gradation value of image data of a region that corresponds to the backlight control value (in the first example, a divided region that corresponds to the backlight control value). The emission brightness of the backlight module 109 may be controlled so that the emission brightness of the backlight module 109 is a uniform brightness across the entire display surface. In this case, for example, the backlight control value generating unit 102 generates a backlight control value that is uniform across the entire display surface. In addition, the region in which a characteristic value of image data is acquired may be either narrower or wider than the region corresponding to the backlight control value.

The backlight brightness estimating unit 103 performs an estimation calculation of brightness (backlight brightness;

intensity) of light from the backlight module 109 which the liquid crystal panel 107 is irradiated with based on the backlight control value output from the backlight control value generating unit 102. In addition, the backlight brightness estimating unit 103 outputs the estimated backlight brightness. Various proposed methods can be used for the estimation calculation of a backlight brightness. For example, based on a backlight control value of each light source (each divided region) and a brightness distribution model of light emitted from the light source (a portion corresponding to the divided region among the backlight module 109), backlight brightness can be estimated (calculated) for each position (each region) of the display surface. The backlight brightness may be estimated (detected) using a brightness sensor or the like.

Based on the backlight brightness output from the backlight brightness estimating unit 103, the correction coefficient generating unit 104 generates a correction coefficient to be applied to the input image data output from the image input/converting unit 101. In addition, the correction coefficient generating unit 104 outputs the generated correction coefficient.

The image correcting unit 105 generates (calculates) a pixel value of corrected image data (data of a corrected image) by multiplying the pixel value of the input image data output from the image input/converting unit 101 by a correction coefficient Gt output from the correction coefficient generating unit 104. In the first example, an RGB value (R value, G value, B value)=(Vr, Vg, Vb) that is the pixel value of the input image data is multiplied by the correction coefficient Gt according to expression (1) below to generate an RGB value=(Vrc, Vgc, Vbc) that is a pixel value of the corrected image data. In addition, the image correcting unit 105 outputs the generated corrected image data.

[Math. 8]

$$Vrc=Vr\times Gt$$

$$Vgc=Vg\times Gt$$

$$Vbc=Vb\times Gt \quad (1)$$

The liquid crystal panel control unit 106 controls transmittance (a transmittance distribution within the display surface) of the liquid crystal panel 107 based on (in accordance with) the corrected image data output from the image correcting unit 105 so that an image based on the corrected image data is displayed on the liquid crystal panel 107.

The liquid crystal panel 107 is controlled by the liquid crystal panel control unit 106 and displays an image on the display surface.

The backlight control unit 108 controls emission brightness of the backlight module 109 (a light source of the backlight module 109) in accordance with the backlight control value output from the backlight control value generating unit 102. For example, the backlight control unit 108 determines a duty ratio of PWM (Pulse Width Modulation) control in accordance with the backlight control value and controls the emission brightness of the backlight module 109 by performing PWM control with the determined duty ratio. In the first example, the backlight control unit 108 performs such processing (control) for each divided region.

The backlight module 109 irradiates a rear surface of the liquid crystal panel 107 with light. As described above, the emission brightness of the backlight module 109 can be changed. In the first example, a plurality of divided regions that constitute the display surface are set in advance, and the backlight module 109 has a plurality of light sources that respectively correspond to the plurality of divided regions and enables emission brightness to be changed for each divided region.

Figure 2:
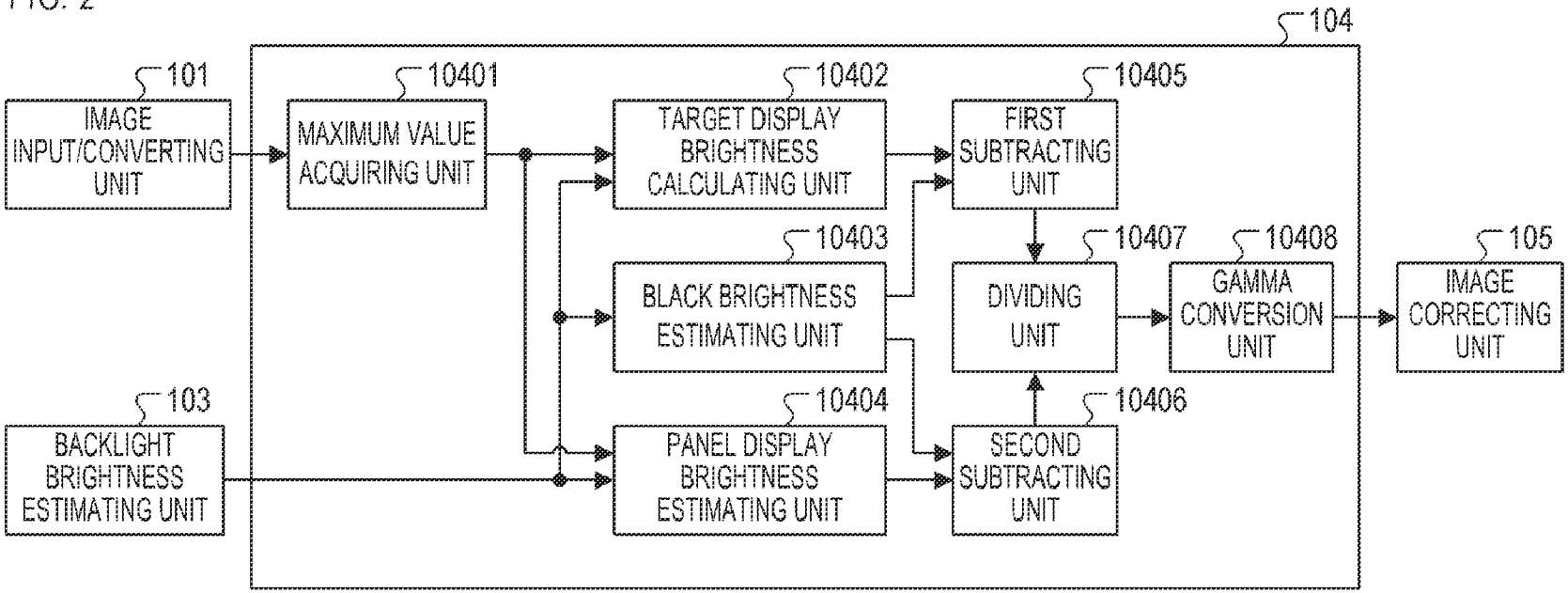
FIG. 2 is a block diagram showing functional blocks of a correction coefficient generating unit according to the first example.

FIG. 2 is a block diagram showing functional blocks of the correction coefficient generating unit 104. The correction coefficient generating unit 104 includes a maximum value acquiring unit 10401, a target display brightness calculating unit 10402, a black brightness estimating unit 10403, a panel display brightness estimating unit 10404, a first subtracting unit 10405, a second subtracting unit 10406, a dividing unit 10407, and a gamma conversion unit 10408.

The maximum value acquiring unit 10401 acquires, for each pixel of the input image data output from the image input/converting unit 101, a gradation value of the input image data as an input value Vin. In addition, the maximum value acquiring unit 10401 outputs the acquired input value Vin. In the first example, the maximum value acquiring unit 10401 acquires a maximum value among an R value, a G value, and a B value of an RGB value that is the pixel value of the input image data as the input value Vin. Alternatively, a minimum value, an average value, an intermediate value, or the like of the R value, the G value, and the B value may be acquired as the input value Vin. A Y value of YCbCr, XYZ, or the like may be acquired as the input value Vin. Hereinafter, the input value Vin is assumed to be a value normalized to 0 to 1.

The target display brightness calculating unit 10402 calculates a display brightness (a target display brightness) Lt in a case where the input image is displayed with the target contrast from the input value Vin output from the maximum value acquiring unit 10401 or the like in accordance with expression (2) below. In addition, the target display brightness calculating unit 10402 outputs the calculated target display brightness Lt. In expression (2), pg denotes panel gamma By raising Vin to the power of pg, an output value corresponding to the display brightness when the input value Vin is displayed by the liquid crystal panel 107 is obtained. In addition, in expression (2), the backlight brightness is assumed to be 100%, the target contrast is assumed to be Ct to 1, and a maximum display brightness is denoted by Lmax. In this case, a minimum display brightness is expressed as Lmax/Ct and a brightness dynamic range is expressed as Lmax/Ct to Lmax. Therefore, as shown in expression (2), by normalizing, using the brightness dynamic range Lmax/Ct to Lmax, an output value obtained by converting the input value Vin using the panel gamma pg, the target display brightness Lt is calculated. In this case, the minimum display brightness is display brightness obtained by measuring a display of, for example, an entirely black image and the maximum display brightness is display brightness obtained by measuring a display of, for example, an entirely white image.

[Math. 9]

$$Lt=\left(Vin^{pg}\times\left(Lmax-\frac{Lmax}{Ct}\right)+\frac{Lmax}{Ct}\right)=\left(Vin^{pg}\times\left(1-\frac{1}{Ct}\right)+\frac{1}{Ct}\right)\times Lmax \quad (2)$$

The black brightness estimating unit 10403 calculates black brightness Lbk (the minimum display brightness in a case where a backlight brightness Le is output from the backlight brightness estimating unit 103) based on the backlight brightness Le or the like in accordance with expression (3) below. In addition, the black brightness estimating unit 10403 outputs the calculated black brightness Lbk. In this case, the backlight brightness Le is normalized to 0 to 1 (0% to 100%). The maximum display brightness in a case of the backlight brightness Le is Lmax Le. In addition, when the contrast (panel contrast) of the liquid crystal panel 107 is expressed as Cp to 1, the minimum display brightness is 1/Cp of the maximum display brightness. Therefore, as shown in expression (3), the black brightness Lbk (the minimum display brightness in a case of the backlight brightness Le) is 1/Cp of Lmax×Le.

[Math. 10]

$$Lbk = \frac{Lmax \times Le}{Cp} = \frac{Le}{Cp} \times Lmax \tag{3}$$

The panel display brightness estimating unit 10404 calculates a panel display brightness Lp from the input value Vin output from the maximum value acquiring unit 10401, the backlight brightness Le output from the backlight brightness estimating unit 103, and the like in accordance with expression (4) below. In addition, the panel display brightness estimating unit 10404 outputs the calculated panel display brightness Lp. The panel display brightness Lp is display brightness when the input image is displayed with the panel contrast. As described above, the maximum display brightness in a case of the backlight brightness Le is Lmax×Le and the minimum display brightness in a case of the backlight brightness Le is 1/Cp of Lmax×Le. In other words, the brightness dynamic range is expressed as (Lmax×Le)/Cp to Lmax×Le. Furthermore, by raising Vin to the power of pg, an output value corresponding to the display brightness when the input value Vin is displayed by the liquid crystal panel 107 is obtained. Therefore, as shown in expression (4), the panel display brightness Lp is calculated by normalizing, using the brightness dynamic range (Lmax×Le)/Cp to Lmax×Le, an output value obtained by converting the input value Vin using the panel gamma pg.

[Math. 11]

$$Lp = \left(Vin^{pg} \times \left(Le \times Lmax - \frac{Le \times Lmax}{Cp}\right) + \frac{Le \times Lmax}{Cp}\right) = \left(Vin^{pg} \times \left(1 - \frac{1}{Cp}\right) + \frac{1}{Cp}\right) \times Le \times Lmax \tag{4}$$

The first subtracting unit 10405 calculates a first brightness difference Dt by subtracting the black brightness Lbk (the output value of the black brightness estimating unit 10403) from the target display brightness Lt (the output value of the target display brightness calculating unit 10402) in accordance with expression (5) below. In addition, the first subtracting unit 10405 outputs the calculated first brightness difference Dt.

[Math. 12]

$$Dt = Lt - Lbk \tag{5}$$

The second subtracting unit 10406 calculates a second brightness difference Dp by subtracting the black brightness Lbk (the output value of the black brightness estimating unit 10403) from the panel display brightness Lp (the output value of the panel display brightness estimating unit 10404) in accordance with expression (6) below. In addition, the second subtracting unit 10406 outputs the calculated second brightness difference Dp.

[Math. 13]

$$Dp = Lp - Lbk \tag{6}$$

The dividing unit 10407 calculates a brightness ratio Lratio according to expression (7) below by dividing the first brightness difference Dt (the output value of the first subtracting unit 10405) by the second brightness difference Dp (the output value of the second subtracting unit 10406). In addition, the dividing unit 10407 outputs the calculated brightness ratio Lratio.

[Math. 14]

$$Lratio = \frac{Dt}{Dp} \tag{7}$$

The gamma conversion unit 10408 calculates a correction coefficient Gt according to expression (8) below by applying an inverse gamma of the panel gamma pg to the brightness ratio Lratio output from the dividing unit 10407. In addition, the gamma conversion unit 10408 outputs the calculated correction coefficient Gt.

[Math. 15]

$$Gt = Lratio^{\frac{1}{pg}} \tag{8}$$

Expression (9) below can be obtained by combining expressions (2) to (8) described above. In other words, it can also be considered that the correction coefficient generating unit 104 calculates the correction coefficient Gt in accordance with expression (9). In expression (9), when the input value Vin is 0, a zero division (division by zero) occurs. Therefore, when the input value Vin is 0, the correction coefficient Gt is set to 0 so as to disable image correction. In addition, when a dividend of expression (9) is a negative value, the dividend is limited to 0.

[Math. 16]

$$Gt = \left(\frac{\left(Vin^{pg} \times \left(1 - \frac{1}{Ct}\right) + \frac{1}{Ct}\right) \times Lmax - \frac{Le}{Cp} \times Lmax}{\left(Vin^{pg} \times \left(1 - \frac{1}{Cp}\right) + \frac{1}{Cp}\right) \times Le \times Lmax - \frac{Le}{Cp} \times Lmax}\right)^{\frac{1}{pg}} = \left(\frac{Vin^{pg} \times \frac{Ct-1}{Ct} + \frac{1}{Ct} - \frac{Le}{Cp}}{Vin^{pg} \times \frac{Cp-1}{Cp} \times Le}\right)^{\frac{1}{pg}} \tag{9}$$

A specific example of a calculation of the correction coefficient Gt by the correction coefficient generating unit 104 will be described with reference to FIGS. 3 to 5.

Figure 3:
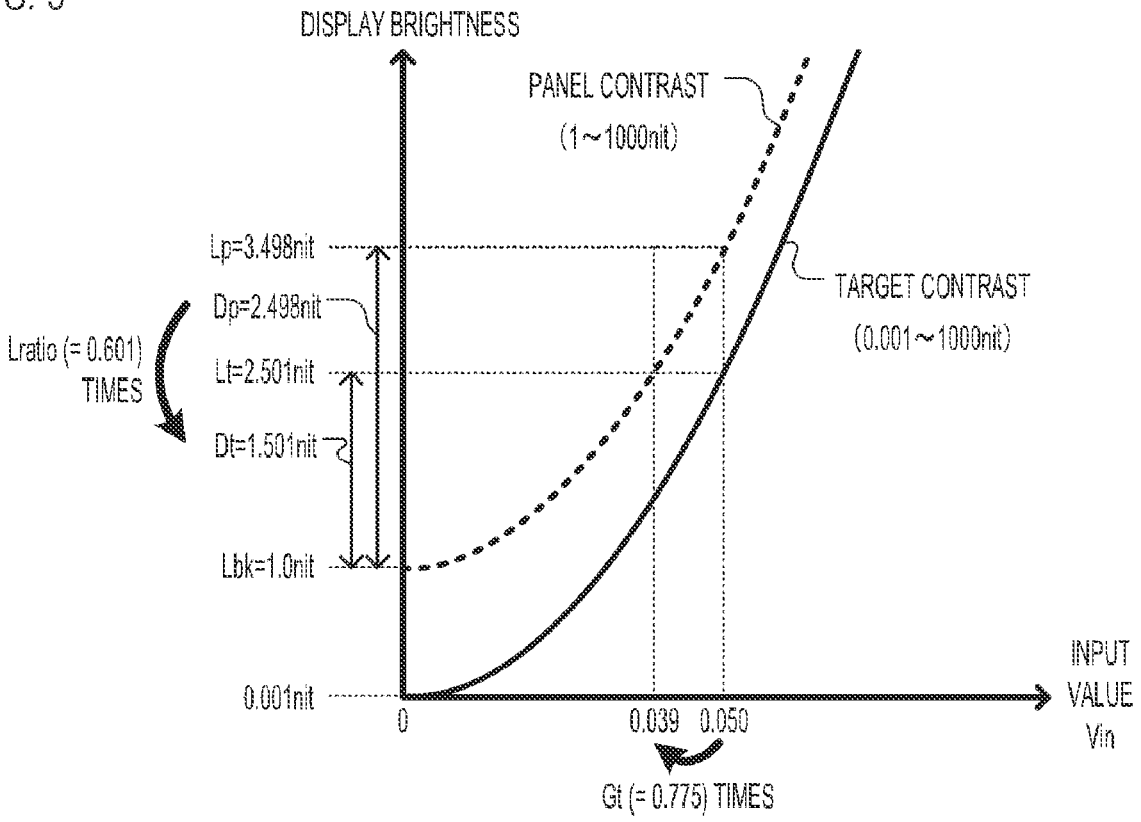
FIG. 3 is a graph for describing a specific example of a calculation of a correction coefficient according to the first example.

FIG. 3 is a graph for describing a specific example of a calculation of the correction coefficient Gt by the correction coefficient generating unit 104. In FIG. 3, an abscissa represents the input value Vin and an ordinate represents display brightness. Referring to FIG. 3, an example of a case will be described in which the target contrast is 1 million to 1 (Ct=1 million), the panel contrast is 1000 to 1 (Cp=1000), the panel gamma pg is 2.0, the backlight brightness Le is 100%, and the input value Vin is 0.05. In this case, the maximum display brightness when the backlight brightness Le is 100% is assumed to be 1000 nit. Therefore, the brightness dynamic range of a display with the target contrast is 0.001 to 1000 nit and the brightness dynamic range of a display with the panel contrast is 1 to 1000 nit.

The target display brightness Lt that is calculated by the target display brightness calculating unit 10402 in accordance with expression (2) is 2.5009975 nit (described as 2.501 nit in FIG. 3) as represented by the following calculation formula.

[Math. 17]

$$Lt = \left(0.05^{2.0} \times \left(1 - \frac{1}{1000000}\right) + \frac{1}{1000000}\right) \times 1000nit = 2.5009975nit$$

The black brightness Lbk that is calculated by the black brightness estimating unit 10403 in accordance with expression (3) is 1.0 nit as represented by the following calculation formula.

[Math. 18]

$$Lbk = \frac{1.0}{1000} \times 1000nit = 1.0nit$$

The panel display brightness Lp that is calculated by the panel display brightness estimating unit 10404 in accordance with expression (4) is 3.4975 nit (described as 3.498 nit in FIG. 3) as represented by the following calculation formula.

[Math. 19]

$$Lp = \left(0.05^{2.0} \times \left(1 - \frac{1}{1000}\right) + \frac{1}{1000}\right) \times 1.0 \times 1000nit = 3.4975nit$$

The first brightness difference Dt that is calculated by the first subtracting unit 10405 in accordance with expression (5) is 1.5009975 nit (described as 1.501 nit in FIG. 3) as represented by the following calculation formula.

$$Dt = 2.5009975 \text{ nit} - 1.0 \text{ nit} = 1.5009975 \text{ nit}$$ [Math. 20]

The second brightness difference Dp that is calculated by the second subtracting unit 10406 in accordance with expression (6) is 2.4975 nit (described as 2.498 nit in FIG. 3) as represented by the following calculation formula.

$$Dp = 3.4975 \text{ nit} - 1.0 \text{ nit} = 2.1975 \text{ nit}$$ [Math. 21]

The brightness ratio Lratio that is calculated by the dividing unit 10407 in accordance with expression (7) is 0.601 as represented by the following calculation formula.

$$Lratio = \frac{1.5009975nit}{2.4975nit} = 0.601$$ [Math. 22]

The correction coefficient Gt that is calculated by the gamma conversion unit 10408 in accordance with expression (8) is 0.77524 (described as 0.775 in FIG. 3) as represented by the following calculation formula.

$$Gt = 0.601^{\frac{1}{20}} \approx 0.77524$$ [Math. 23]

In a case where the gradation value of the input image data is 0.05, the gradation value Vc of the corrected image data that is generated by the image correcting unit 105 in accordance with expression (1) is 0.038762 (described as 0.039 in FIG. 3) as represented by the following calculation formula.

$$Vc = 0.05 \times 0.77524 = 0.038762$$ [Math. 24]

A display brightness Lc (a panel display brightness) corresponding to the gradation value Vc is calculated by subjecting the gradation value Vc to a conversion by a panel gamma of 2.0 and normalization by a brightness dynamic range of 1 to 1000 nit. As represented by the following calculation formula, display brightness Lc=2.50099 nit is calculated from gradation value Vc=0.038762. In this manner, display brightness Lc that is approximately the same as the display brightness generated with the method according to the first example or, in other words, the target display brightness Lt can be obtained.

$$Lc = (0.038762^{2.0} \times (1000 \text{ nit} - 1.0 \text{ nit}) + 1.0 \text{ nit}) \approx 2.50099 \text{ nit}$$ [Math. 25]

Figure 4:
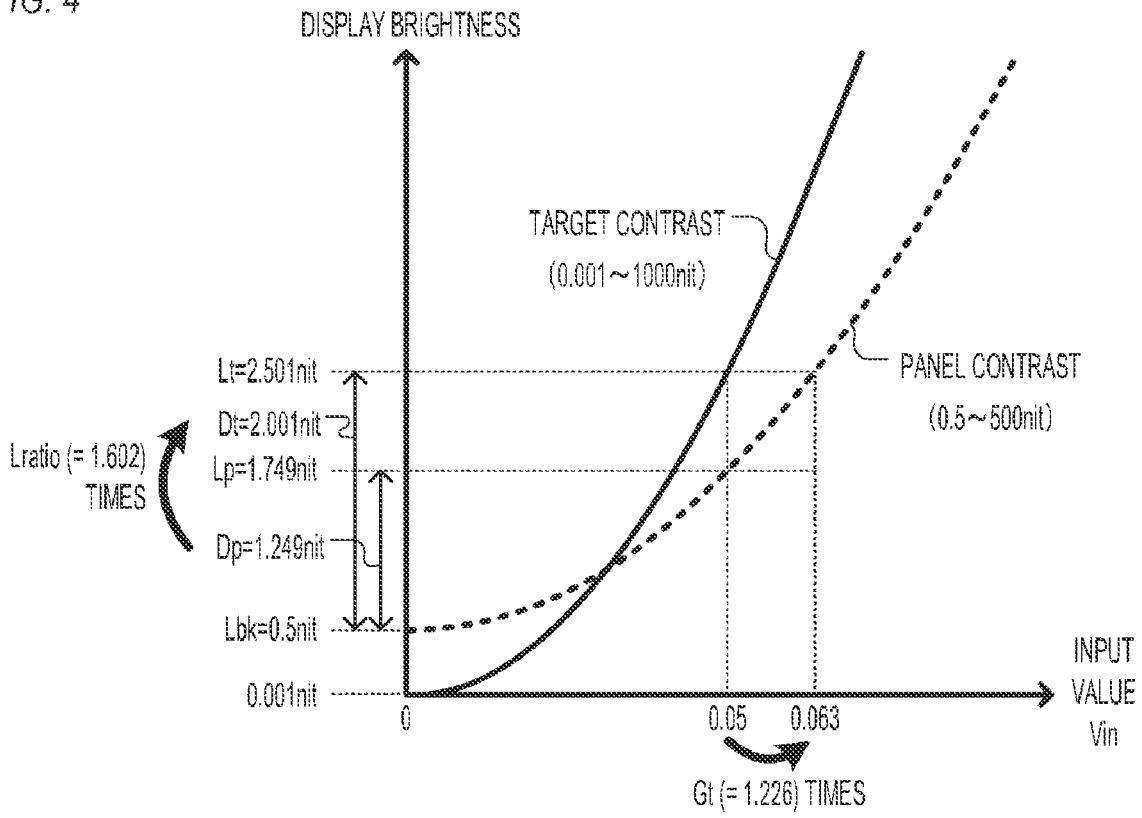
FIG. 4 is a graph for describing a specific example of a calculation of a correction coefficient according to the first example.

FIG. 4 is a graph for describing a specific example of a calculation of a correction coefficient Gt by the correction coefficient generating unit 104. In FIG. 4, an abscissa represents the input value Vin and an ordinate represents display brightness. Referring to FIG. 4, an example of a case will be described in which the target contrast is 1 million to 1 (Ct=1 million), the panel contrast is 1000 to 1 (Cp=1000), the panel gamma pg is 2.0, the backlight brightness Le is 50%, and the input value Vin is 0.05. In this case, the maximum display brightness when the backlight brightness Le is 100% is assumed to be 1000 nit. Therefore, the brightness dynamic range of a display with the target contrast is 0.001 to 1000 nit and the brightness dynamic range of a display with the panel contrast is 0.5 to 500 nit.

The target display brightness Lt that is calculated by the target display brightness calculating unit 10402 in accordance with expression (2) is 2.5009975 nit (described as 2.501 nit in FIG. 4) as represented by the following calculation formula.

$$Lt = \left(0.05^{2.0} \times \left(1 - \frac{1}{1000000}\right) + \frac{1}{1000000}\right) \times 1000nit = 2.5009975nit$$ [Math. 26]

The black brightness Lbk that is calculated by the black brightness estimating unit 10403 in accordance with expression (3) is 0.5 nit as represented by the following calculation formula.

$$Lbk = \frac{0.5}{1000} \times 1000nit = 0.5nit$$ [Math. 27]

The panel display brightness Lp that is calculated by the panel display brightness estimating unit 10404 in accordance with expression (4) is 1.74875 nit (described as 1.749 nit in FIG. 4) as represented by the following calculation formula.

$$Lp = \left(0.05^{2.0} \times \left(1 - \frac{1}{1000}\right) + \frac{1}{1000}\right) \times 0.5 \times 1000nit = 1.74875nit \quad \text{[Math. 28]}$$

The first brightness difference Dt that is calculated by the first subtracting unit 10405 in accordance with expression (5) is 2.0009975 nit (described as 2.001 nit in FIG. 4) as represented by the following calculation formula.

$$Dt = 2.5009975 \text{ nit} - 0.5 \text{ nit} = 2.0009975 \text{ nit} \quad \text{[Math. 29]}$$

The second brightness difference Dp that is calculated by the second subtracting unit 10406 in accordance with expression (6) is 1.24875 nit (described as 1.249 nit in FIG. 4) as represented by the following calculation formula.

$$Dp = 1.74875 \text{ nit} - 0.5 \text{ nit} = 1.24875 \text{ nit} \quad \text{[Math. 30]}$$

The brightness ratio Lratio that is calculated by the dividing unit 10407 in accordance with expression (7) is 1.6024 (described as 1.602 in FIG. 4) as represented by the following calculation formula.

$$Lratio = \frac{2.0009975nit}{1.24875nit} \approx 1.6024 \quad \text{[Math. 31]}$$

The correction coefficient Gt that is calculated by the gamma conversion unit 10408 in accordance with expression (8) is 1.26586 (described as 1.266 in FIG. 4) as represented by the following calculation formula.

$$Gt = 1.6024^{1/2.0} \approx 1.26586 \quad \text{[Math. 32]}$$

In a case where the gradation value of the input image data is 0.05, the gradation value Vc of the corrected image data that is generated by the image correcting unit 105 in accordance with expression (1) is 0.063293 (described as 0.063 in FIG. 4) as represented by the following calculation formula.

$$Vc = 0.05 \times 1.26586 \approx 0.063293 \quad \text{[Math. 33]}$$

A display brightness Lc (a panel display brightness) corresponding to the gradation value Vc is calculated by subjecting the gradation value Vc to a conversion by a panel gamma of 2.0 and normalization by a brightness dynamic range of 0.5 to 500 nit. As represented by the following calculation formula, display brightness Lc=2.50099 nit is calculated from gradation value Vc=0.063293. In other words, display brightness Lc that is approximately the same as the target display brightness Lt can be obtained.

$$Lc = (0.063293^{2.0} \times (500 \text{ nit} - 0.5 \text{ nit}) + 0.5 \text{ nit}) \approx 2.50099 \text{ nit} \quad \text{[Math. 34]}$$

Figure 5:
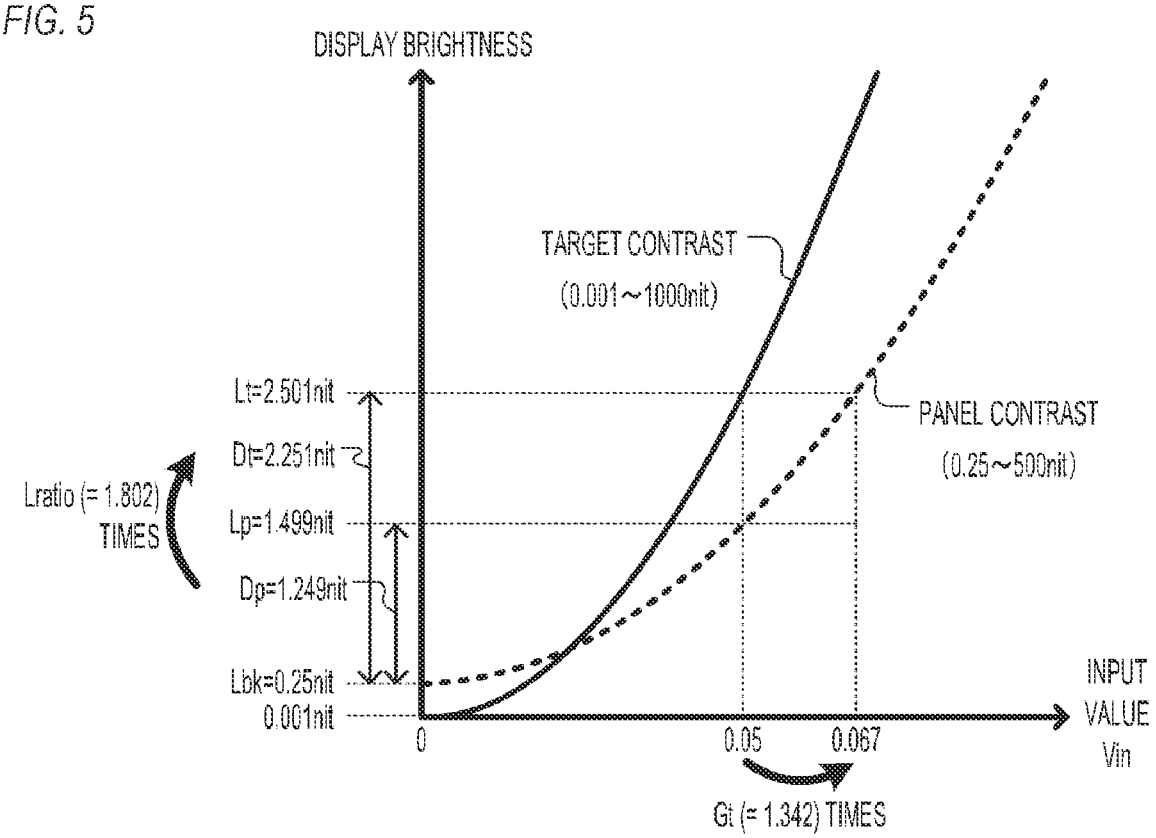
FIG. 5 is a graph for describing a specific example of a calculation of a correction coefficient according to the first example.

FIG. 5 is a graph for describing a specific example of a calculation of the correction coefficient Gt by the correction coefficient generating unit 104. In FIG. 5, an abscissa represents the input value Vin and an ordinate represents display brightness. Referring to FIG. 5, an example of a case will be described in which the target contrast is 1 million to 1 (Ct=1 million), the panel contrast is 2000 to 1 (Cp=2000), the panel gamma pg is 2.0, the backlight brightness Le is 50%, and the input value Vin is 0.05. In this case, the maximum display brightness when the backlight brightness Le is 100% is assumed to be 1000 nit. Therefore, the brightness dynamic range of a display with the target contrast is 0.001 to 1000 nit and the brightness dynamic range of a display with the panel contrast is 0.25 to 500 nit.

The target display brightness Lt that is calculated by the target display brightness calculating unit 10402 in accordance with expression (2) is 2.5009975 nit (described as 2.501 nit in FIG. 5) as represented by the following calculation formula.

$$Lt = \left(0.05^{2.0} \times \left(1 - \frac{1}{1000000}\right) + \frac{1}{1000000}\right) \times 1000nit = 2.5009975nit \quad \text{[Math. 35]}$$

The black brightness Lbk that is calculated by the black brightness estimating unit 10403 in accordance with expression (3) is 0.25 nit as represented by the following calculation formula.

$$Lbk = \frac{0.5}{2000} \times 1000nit = 0.25nit \quad \text{[Math. 36]}$$

The panel display brightness Lp that is calculated by the panel display brightness estimating unit 10404 in accordance with expression (4) is 1.499375 nit (described as 1.499 nit in FIG. 5) as represented by the following calculation formula.

$$Lp = \left(0.05^{2.0} \times \left(1 - \frac{1}{2000}\right) + \frac{1}{2000}\right) \times 0.5 \times 1000nit = 1.499375nit \quad \text{[Math. 37]}$$

The first brightness difference Dt that is calculated by the first subtracting unit 10405 in accordance with expression (5) is 2.2509975 nit (described as 2.251 nit in FIG. 5) as represented by the following calculation formula.

$$Dt = 2.5009975 \text{ nit} - 0.25 \text{ nit} = 2.2509975 \text{ nit} \quad \text{[Math. 38]}$$

The second brightness difference Dp that is calculated by the second subtracting unit 10406 in accordance with expression (6) is 1.24875 nit (described as 1.249 nit in FIG. 5) as represented by the following calculation formula.

$$Dp = 1.499375 \text{ nit} - 0.25 \text{ nit} = 1.249375 \text{ it} \quad \text{[Math. 39]}$$

The brightness ratio Lratio that is calculated by the dividing unit 10407 in accordance with expression (7) is 1.8017 (described as 1.802 in FIG. 5) as represented by the following calculation formula $$Lratio = \frac{2.2509975nit}{1.249375nit} \approx 1.8017 \quad \text{[Math. 40]}$$

The correction coefficient Gt that is calculated by the gamma conversion unit 10408 in accordance with expression (8) is 1.34227 (described as 1.342 in FIG. 5) as represented by the following calculation formula.

$$Gt = 1.8017^{\frac{1}{2.0}} \approx 1.34227 \quad \text{[Math. 41]}$$

In a case where the gradation value of the input image data is 0.05, the gradation value Vc of the corrected image data that is generated by the image correcting unit 105 in accordance with expression (1) is 0.0671135 (described as 0.067 in FIG. 5) as represented by the following calculation formula.

$$Vc=0.05\times1.34227\approx0.0671135 \quad \text{[Math. 42]}$$

A display brightness Lc (a panel display brightness) corresponding to the gradation value Vc is calculated by subjecting the gradation value Vc to a conversion by a panel gamma of 2.0 and normalization by a brightness dynamic range of 0.25 to 500 nit. As represented by the following calculation formula, display brightness Lc=2.50098 nit is calculated from gradation value Vc=0.0671135. In other words, display brightness Lc that is approximately the same as the target display brightness Lt can be obtained.

$$Lc=(\mathbf{0.0671135}^{2.0}\times(500\text{ nit}-0.25\text{ nit})+0.25\text{ nit}) \approx 2.50098\text{ nit} \quad \text{[Math. 43]}$$

In this manner, using the correction coefficient Gt generated with the method according to the first example enables display brightness Lc that is approximately the same as the target display brightness Lt to be obtained and enables a brightness error (an error with respect to the target display brightness) related to the backlight brightness and the panel contrast to be suppressed. For example, the brightness error (the error with respect to the target display brightness) can be prevented from increasing in conjunction with an increase in the backlight brightness and a decrease in the panel contrast.

Specific examples of an effect of the first example will be described with reference to FIGS. 6 to 13B.

Figure 6:
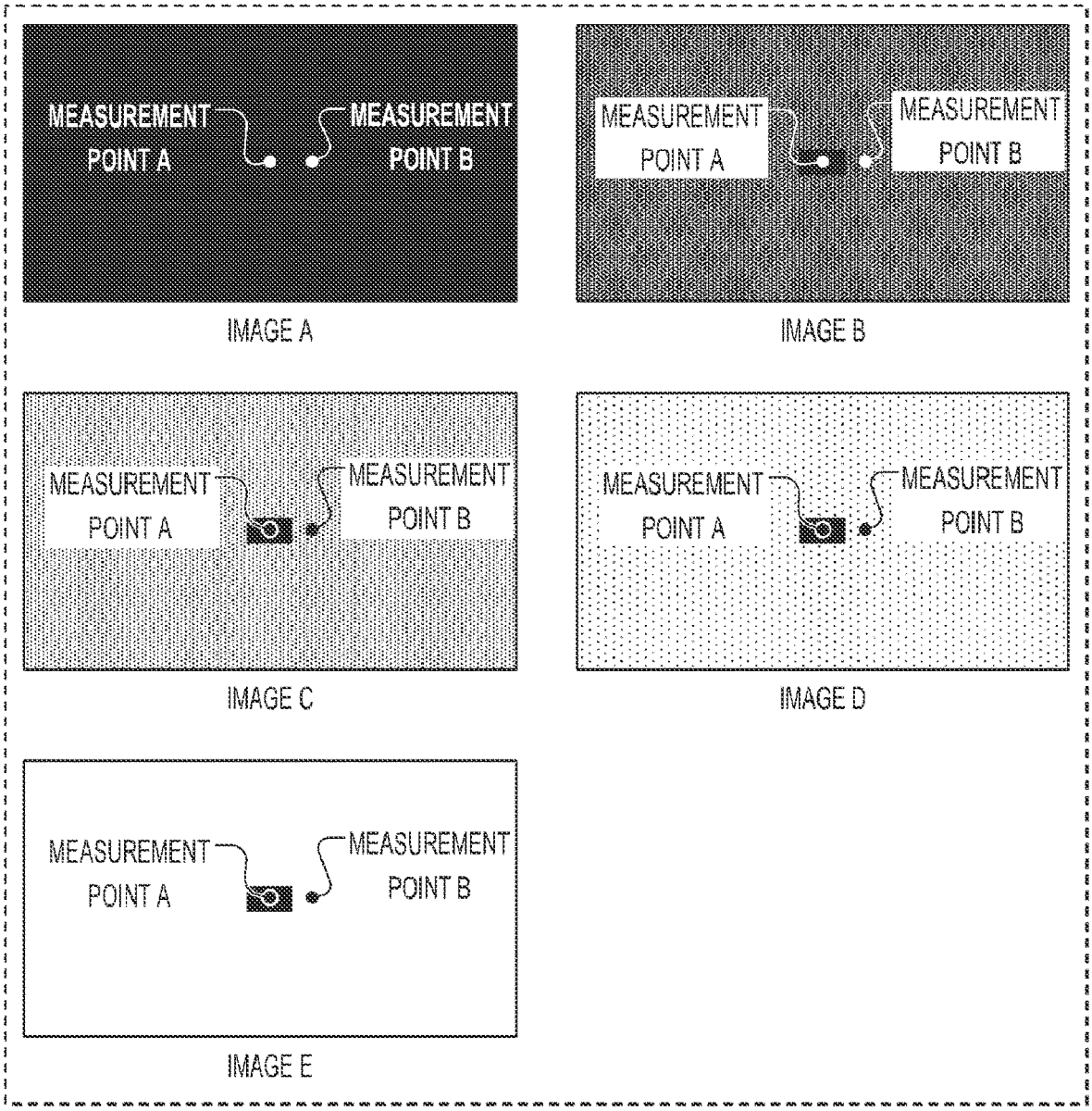
FIG. 6 is a diagram showing an example of an input image according to the first example.

FIG. 6 shows an example of an input image. In images A to D, an RGB value (Vr, Vg, Vb) of a patch region including a measurement point A is (0, 0, 0). An RGB value of a background region including a measurement point B is (0, 0, 0) in image A, (2048, 2048, 2048) in image B, (2896, 2896, 2896) in image C, (3547, 3547, 3547) in image D, and (4095, 4095, 4095) in image E. In FIG. 6, it is assumed that the R values, G values, and B values are all 12-bit integers and an inverse gamma of the panel gamma pg has been applied thereto. In addition, a size of the patch region, coordinates of the patch region, and positions of the measurement points A and B are the same among the images A to E.

Figure 7:
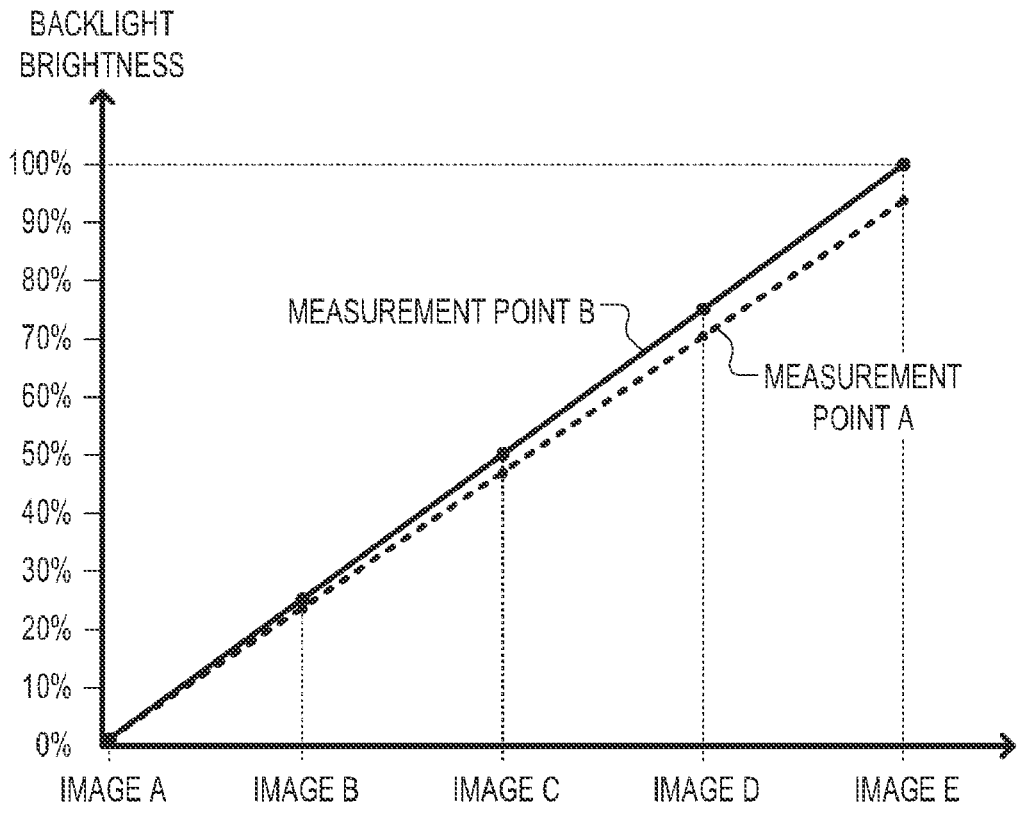
FIG. 7 is a diagram showing an example of emission brightness according to the first example.

FIG. 7 shows an example of the backlight brightness Le at the measurement point A and the measurement point B in FIG. 6. In this case, it is assumed that a light source of a divided region including the measurement point A among a plurality of light sources of the backlight module 109 is not turned on. However, it is assumed that the backlight brightness Le at the measurement point A is equivalent to 90% of the backlight brightness Le at the measurement point B due to an effect of diffused light from a light source of a divided region including the measurement point B. Therefore, when the backlight brightness Le at the measurement point B is 0.1% in image A, 25% in image B, 50% in image C, 75% in image D, and 100% in image E, the backlight brightness Le at the measurement point A is 0.09% in image A, 22.5% in image B, 45% in image C, 67.5% in image D, and 90% in image E.

Figure 8A:
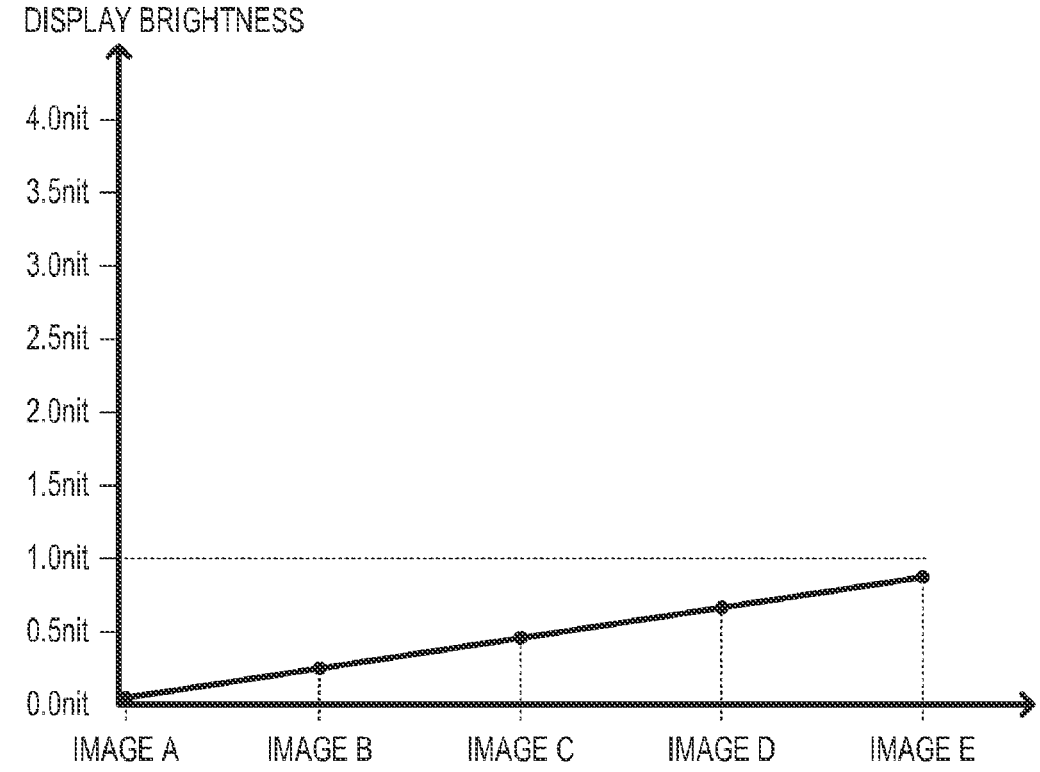
FIGS. 8A and 8B are diagrams showing an example of conventional display brightness.
Figure 8B:
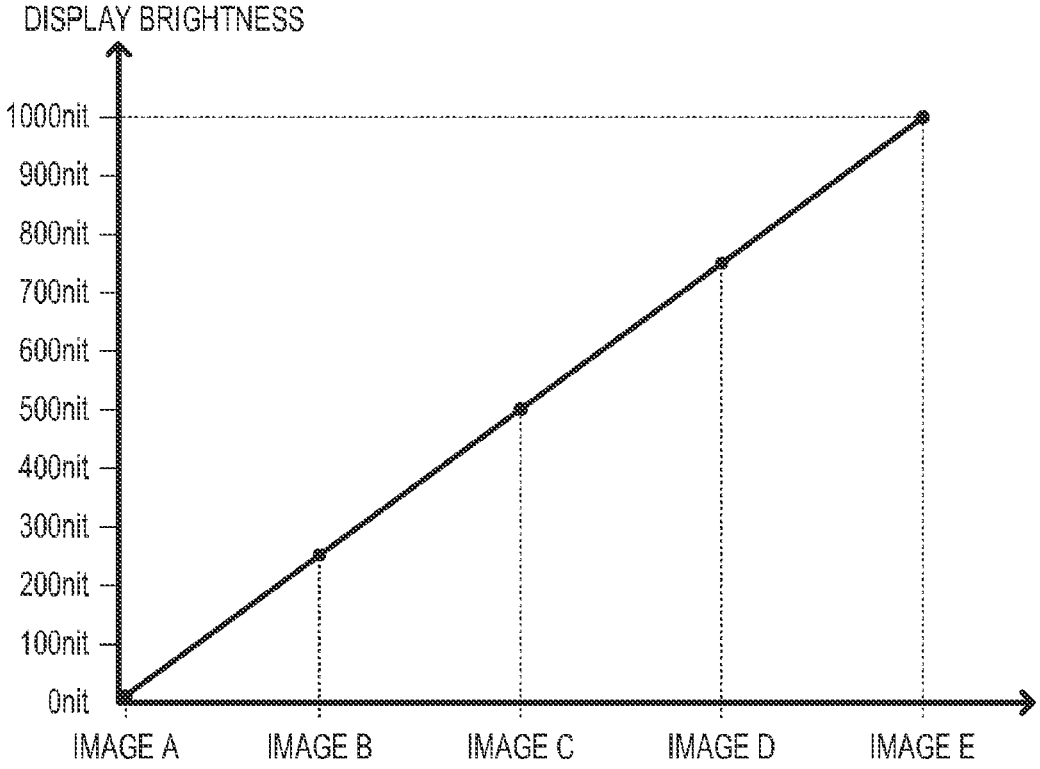
Figure 9A:
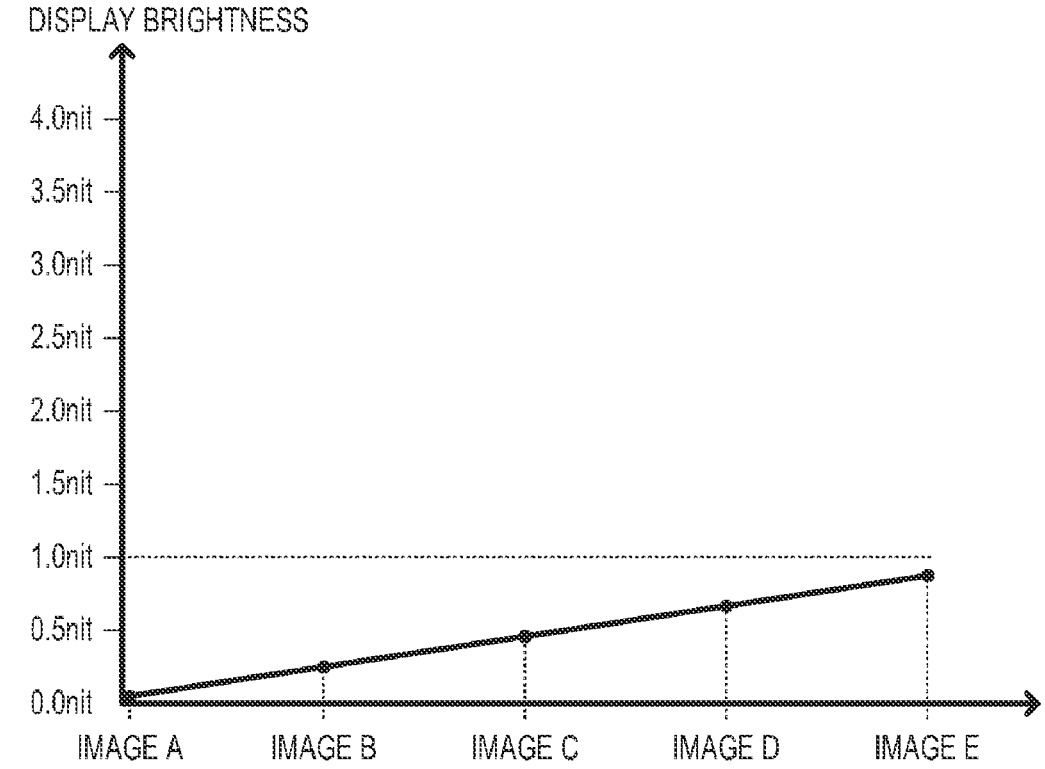
FIGS. 9A and 9B are diagrams showing an example of display brightness according to the first example.
Figure 9B:
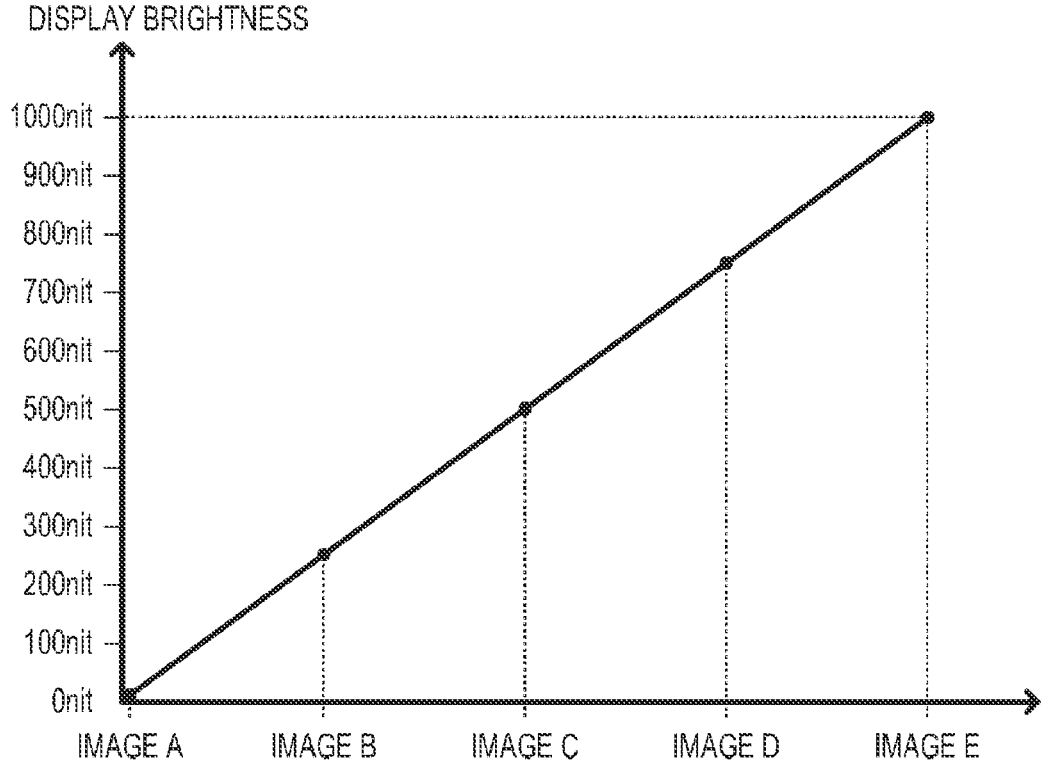

FIGS. 8A to 9B show an example of the display brightness Lc at the measurement point A and the measurement point B when the input image shown in FIG. 6 is displayed on a liquid crystal display apparatus with the backlight brightness Le shown in FIG. 7. FIGS. 8A and 8B show an example in a case of using a conventional technique of correcting an input image with an inverse of the backlight brightness Le, and FIGS. 9A and 9B show an example in a case of correcting the input image using the method according to the first example. It is assumed that the panel contrast of the liquid crystal display apparatus is 1000 to 1 (Cp=1000) and the maximum display brightness when the backlight brightness Le is 100% is 1000 nit. Therefore, when the backlight brightness Le is 100%, the brightness dynamic range of a display with the panel contrast is 1 to 1000 nit. In addition, the panel gamma pg of the liquid crystal display apparatus is assumed to be 2.0.

First, with reference to FIGS. 8A and 8B, an example in a case of using a conventional technique of correcting an input image with an inverse of the backlight brightness Le will be described. FIG. 8A shows the display brightness Lc at the measurement point A shown in FIG. 6, and FIG. 8B shows the display brightness Lc at the measurement point B shown in FIG. 6. In this case, it is assumed that an input image is corrected so that an effect of multiplying the display brightness by an inverse of the backlight brightness Le is produced. In other words, a correction coefficient applied to the input image is 1/Le to the power of 1/pg as represented by expression (10) below.

[Math. 44]

$$Gi=\left(\frac{1}{Le}\right)^{\frac{1}{pg}} \tag{10}$$

By converting, with the panel gamma pg, a value (a gradation value of a corrected image) which is obtained by multiplying the input value Vin (a 12-bit integer) by a correction coefficient Gi calculated with expression (10), an output value corresponding to the display brightness Lc of a corrected image is obtained. In addition, the brightness dynamic range of a display with the panel contrast is expressed as (Lmax×Le)/Cp to Lmax×Le. Therefore, as shown in expression (11) below, the display brightness Lc is calculated by normalizing the output value described above to the brightness dynamic range (Lmax×Le)/Cp to Lmax×Le.

[Math. 45]

$$\begin{aligned} Lc &= \left(\frac{Vin}{4095}\times\left(\frac{1}{Le}\right)^{\frac{1}{pg}}\right)^{pg}\times\left(Lmax\times Le-\frac{Lmax\times Le}{Cp}\right)+\frac{Lmax\times Le}{Cp} \\ &= \left(\left(\frac{Vin}{4095}\times\left(\frac{1}{Le}\right)^{\frac{1}{pg}}\right)^{pg}\times\left(1-\frac{1}{Cp}\right)\times+\frac{1}{Cp}\right)\times Lmax\times Le \end{aligned} \tag{11}$$

However, in a case where the input value Vin is 0, as shown in expression (12) below; image correction is disabled and the display brightness Lc is determined in accordance with the panel contrast and the backlight brightness Le.

[Math. 46]

$$Lc = \left(\left(\frac{0}{4095} \times \left(\frac{1}{Le}\right)^{\frac{1}{pg}}\right)^{pg} \times \left(1 - \frac{1}{Cp}\right) \times Lmax \times Le + \frac{1}{Cp}\right) \times Lmax \times Le = 0 + \frac{1}{Cp} \times Lmax \times Le = \frac{1}{Cp} \times Lmax \times Le \quad (12)$$

As shown in FIG. 8B, at the measurement point B in image A shown in FIG. 6, since the input value Vin (a maximum value among the R value, the G value, and the B value) is 0, the display brightness Lc is calculated as 0.001 nit in accordance with expression (12). At the measurement point B in images B to E in FIG. 6, since the input value Vin is not 0, the display brightness Lc is 250 nit in image B, 500 nit in image C, 750 nit in image D, and 1000 nit in image E in accordance with expression (11). In addition, as shown in FIG. 8A, at the measurement point A in images A to E in FIG. 6, since the input value Vin is 0, the display brightness Lc is 0.0009 nit in image A, 0.225 nit in image B, 0.45 nit in image C, 0.675 nit in image D, and 0.9 nit in image E in accordance with expression (12).

Next, with reference to FIGS. 9A and 9B, an example in a case of correcting an input image using the method according to the first example will be described. FIG. 9A shows the display brightness Lc at the measurement point A shown in FIG. 6, and FIG. 9B shows the display brightness Lc at the measurement point B shown in FIG. 6. In this case, the correction coefficient Gt is calculated in accordance with expression (9) described earlier.

By converting, with the panel gamma pg, a value (a gradation value of a corrected image) which is obtained by multiplying the input value Vin (a 12-bit integer) by the correction coefficient Gt calculated with expression (9), an output value corresponding to the display brightness Lc of a corrected image is obtained. In addition, the brightness dynamic range of a display with the panel contrast is expressed as (Lmax×Le)/Cp to Lmax×Le. Therefore, as shown in expression (13) below, the display brightness Lc is calculated by normalizing the output value described above to the brightness dynamic range (Lmax×Le)/Cp to Lmax×Le.

[Math. 47]

$$Lc = \left(\frac{Vin}{4095} \times \left(\frac{Vin^{pg} \times \frac{Ct-1}{Ct} + \frac{1}{Ct} - \frac{Le}{Cp}}{Vin^{pg} \times \frac{Cp-1}{Cp} \times Le}\right)^{\frac{1}{pg}}\right)^{pg} \times \left(1 - \frac{1}{Cp}\right) \times Lmax \times Le + \frac{1}{Cp} \times Lmax \times Le \quad (13)$$

However, in a case where the input value Vin is 0, as shown in expression (14) below, image correction is disabled and the display brightness Lc is determined in accordance with the panel contrast and the backlight brightness Le.

[Math. 48]

$$Lc = \left(\frac{0}{4095} \times \left(\frac{0^{pg} \times \frac{Ct-1}{Ct} + \frac{1}{Ct} - \frac{Le}{Cp}}{0^{pg} \times \frac{Cp-1}{Cp} \times Le}\right)^{\frac{1}{pg}}\right)^{pg} \times \left(1 - \frac{1}{Cp}\right) \times Lmax \times Le + \frac{1}{Cp} \times Lmax \times Le = 0 + \frac{1}{Cp} \times Lmax \times Le = \frac{1}{Cp} \times Lmax \times Le \quad (14)$$

As shown in FIG. 9B, at the measurement point B in image A shown in FIG. 6, since the input value Vin is 0, the display brightness Lc is calculated as 0.001 nit in accordance with expression (14). In this case, the target contrast is assumed to be 1 million to 1 (Ct=1 million). At the measurement point B in images B to E in FIG. 6, since the input value Vin is not 0, the display brightness Lc is 250 nit in image B, 500 nit in image C, 750 nit in image D, and 1000 nit in image E in accordance with expression (13). In addition, as shown in FIG. 9A, at the measurement point A in images A to E in FIG. 6, since the input value Vin is 0, the display brightness Lc is 0.0009 nit in image A, 0.225 nit in image B, 0.45 nit in image C, 0.675 nit in image D, and 0.9 nit in image E in accordance with expression (14).

As is apparent from expression (12) or expression (14), when the input value Vin is 0 or, in other words, when a color of a pixel is black, an effect of image correction cannot be obtained. In this case, the black brightness Lbk in accordance with the panel contrast and the backlight brightness Le is adopted as the display brightness Lc. In other words, as shown in FIG. 8A to 9B, when the display brightness Lc at the measurement point A is high in comparison to the display brightness Lc at the measurement point B, the display brightness Lc at the measurement point A is affected by diffused light from a light source of the backlight module 109 in the background region.

Figure 10:
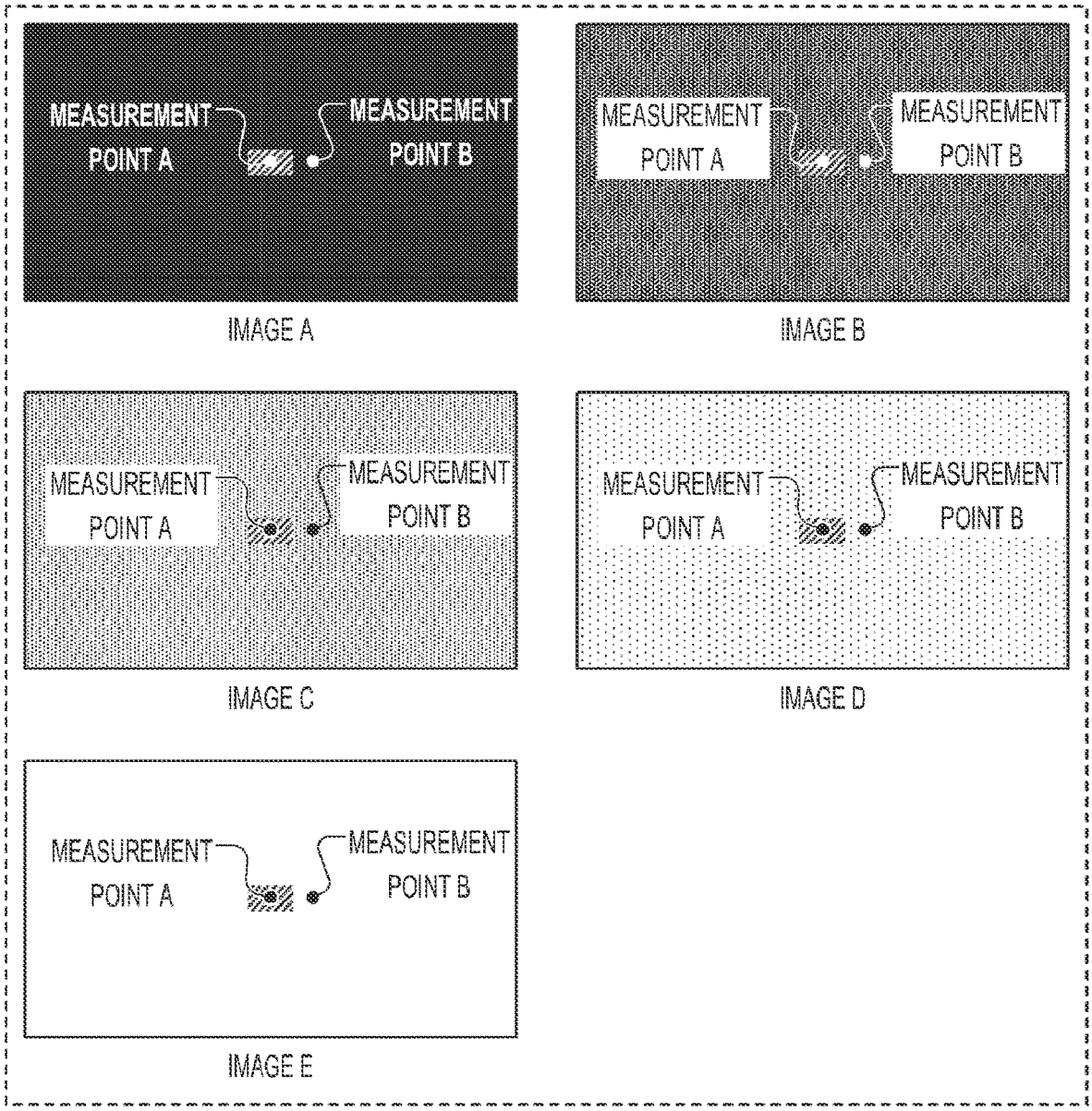
FIG. 10 is a diagram showing an example of an input image according to the first example.

FIG. 10 shows an example of an input image. In images A to D, an RGB value (Vr, Vg, Vb) of a patch region including the measurement point A is (205, 205, 205). An RGB value of the background region including the measurement point B, a size of the patch region, coordinates of the patch region, and positions of the measurement points A and B are the same as in FIG. 6.

Figure 11:
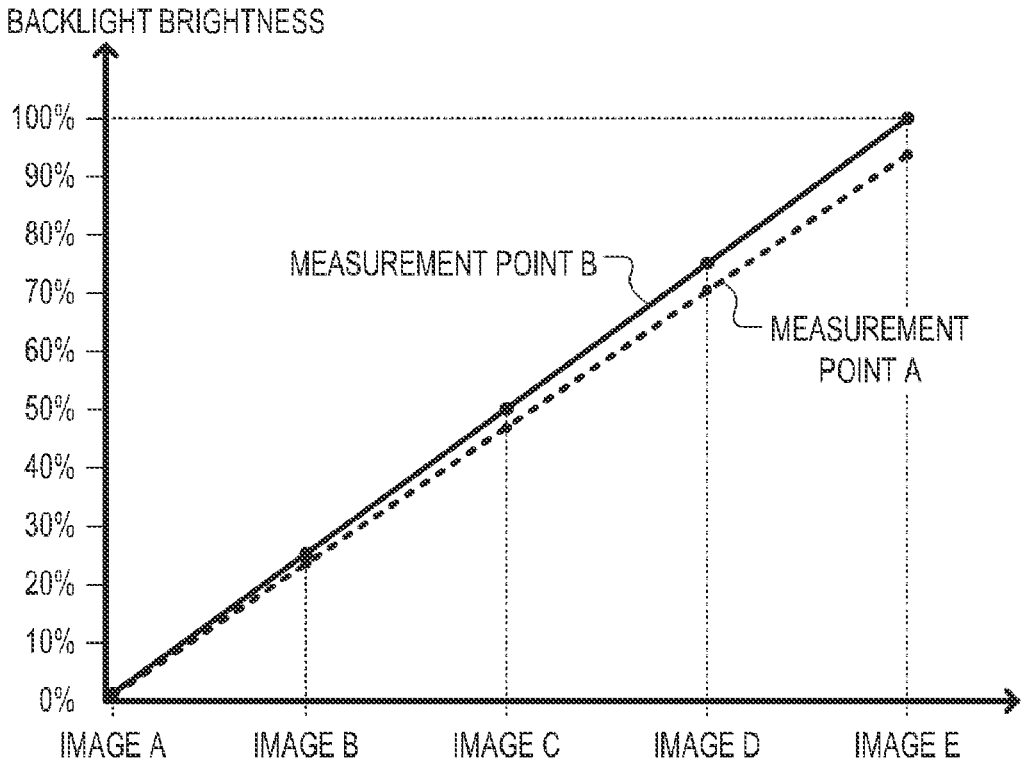
FIG. 11 is a diagram showing an example of emission brightness according to the first example.

FIG. 11 shows an example of the backlight brightness Le at the measurement point A and the measurement point B in FIG. 10. In this case, it is assumed that a light source of a divided region including the measurement point A among a plurality of light sources of the backlight module 109 is turned on and, due to the effect of light from the light source, the backlight brightness Le at the measurement point A includes a brightness of 1%. In addition, is assumed that the backlight brightness Le at the measurement point A includes brightness equivalent to 90% of the backlight brightness Le at the measurement point B due to an effect of diffused light from a light source of a divided region including the measurement point B. In other words, the backlight brightness Le at the measurement point A is assumed to be a value obtained by adding 1% to 90% of the backlight brightness Le at the measurement point B. Therefore, when the backlight brightness Le at the measurement point B is 0.1% in image A, 25% in image B, 50% in image C, 75% in image D, and 100% in image E, the backlight brightness Le at the measurement point A is 1.09% in image A, 23.5% in image B, 46% in image C, 68.5% in image D, and 91% in image E.

Figure 12A:
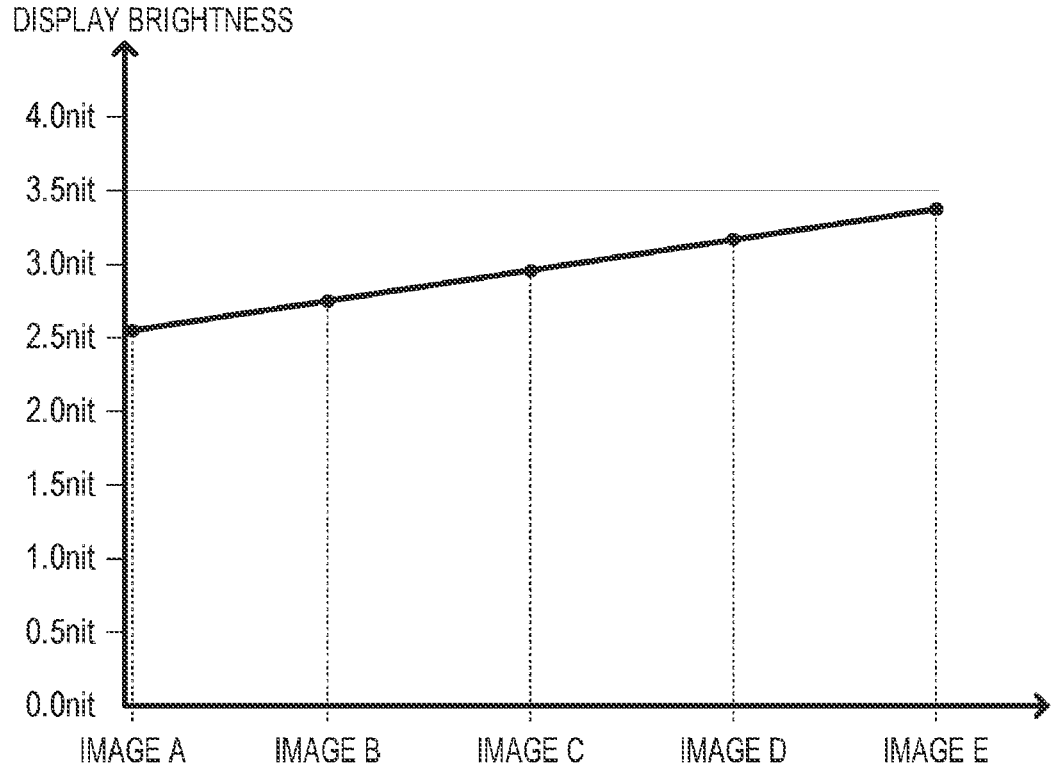
FIGS. 12A and 12B are diagrams showing an example of conventional display brightness.
Figure 12B:
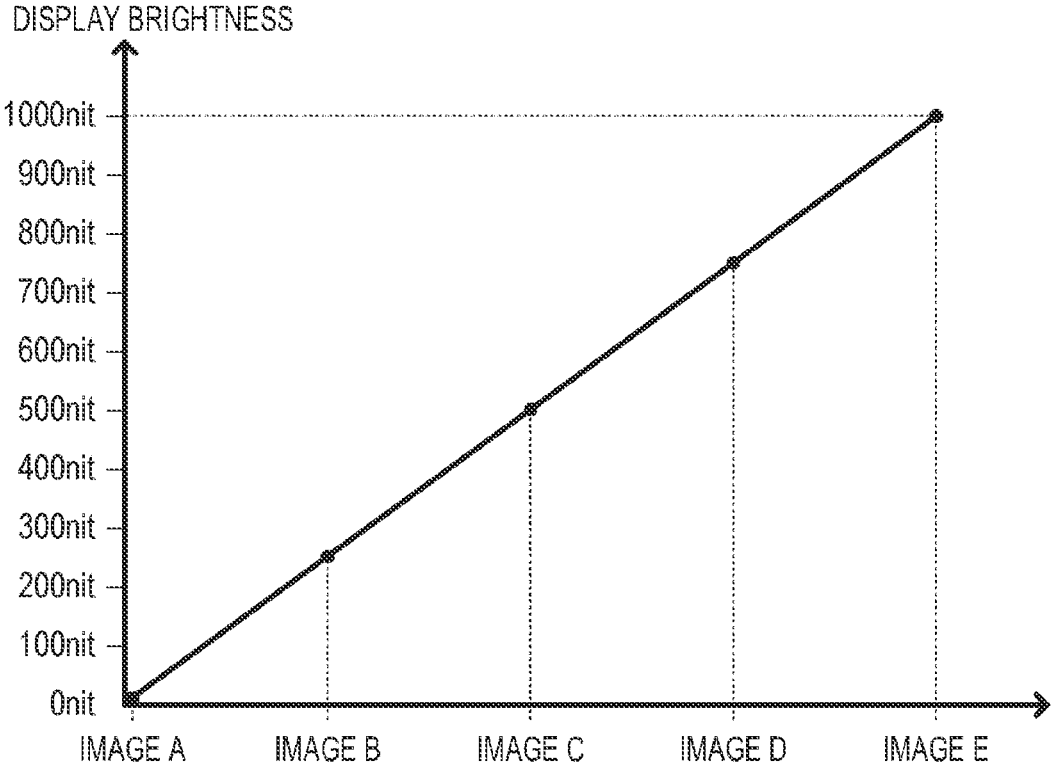
Figure 13A:
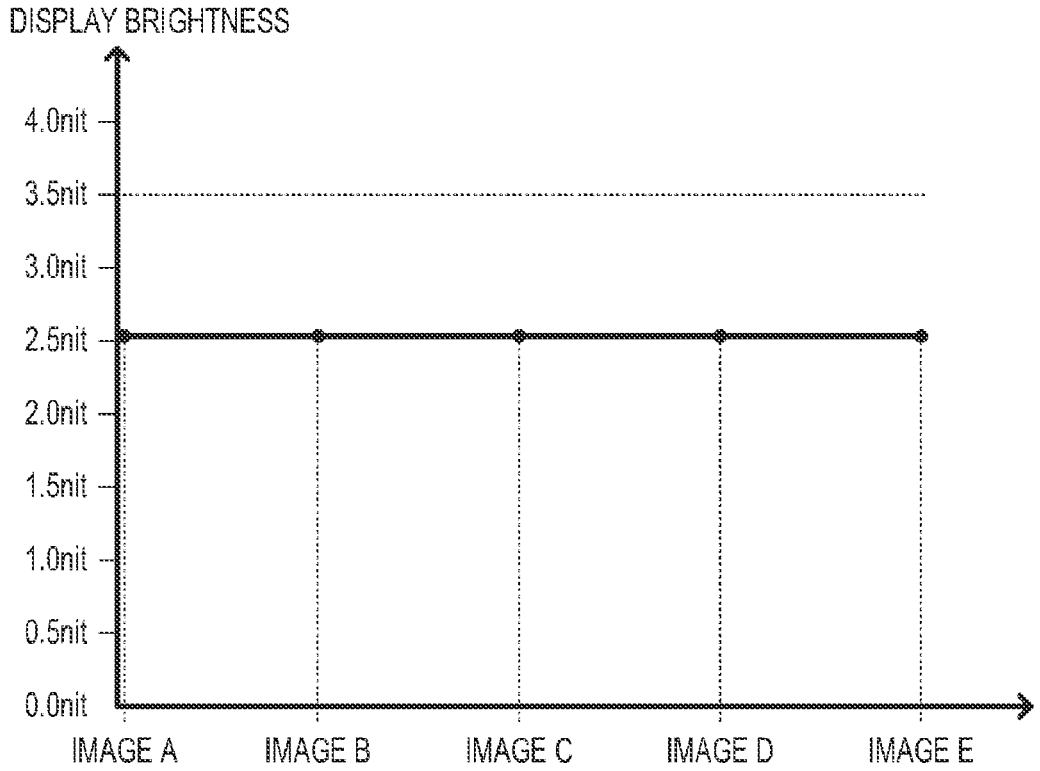
FIGS. 13A and 13B are diagrams showing an example of display brightness according to the first example.
Figure 13B:
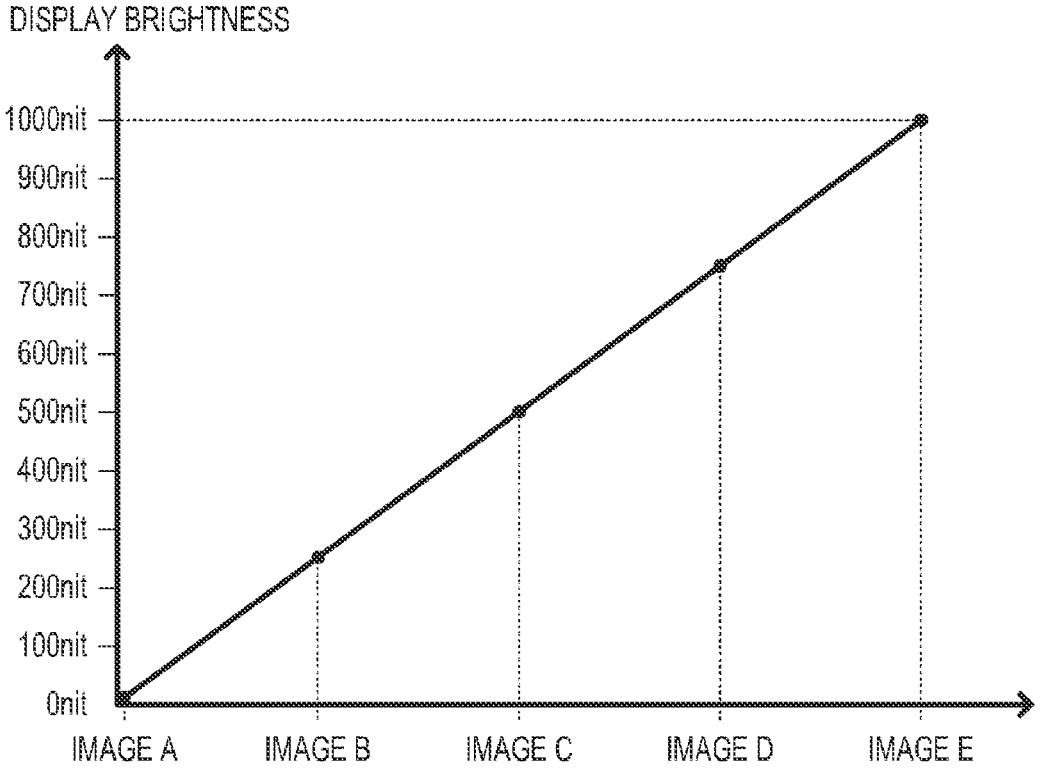

FIGS. 12A, 12B, 13A, and 13B show an example of the display brightness Lc at the measurement point A and the measurement point B when the input image shown in FIG. 10 is displayed on a liquid crystal display apparatus with the backlight brightness Le shown in FIG. 11. FIGS. 12A and 12B show an example in a case of using a conventional technique of correcting an input image with an inverse of the backlight brightness Le, and FIGS. 13A and 13B show an example in a case of correcting the input image using the method according to the first example. In a similar manner to FIGS. 8A to 9B, it is assumed that the panel contrast of the liquid crystal display apparatus is 1000 to 1 (Cp=1000) and the maximum display brightness when the backlight brightness Le is 100% is 1000 nit. Therefore, when the backlight brightness Le is 100%, the brightness dynamic range of a display with the panel contrast is 1 to 1000 nit. In addition, the panel gamma pg of the liquid crystal display apparatus is assumed to be 2.0.

First, with reference to FIGS. 12A and 12B, an example in a case of using a conventional technique of correcting an input image with an inverse of the backlight brightness Le will be described. FIG. 12A shows the display brightness Lc at the measurement point A shown in FIG. 10, and FIG. 12B shows the display brightness Lc at the measurement point B shown in FIG. 10. The display brightness Lc can be calculated in accordance with expression (11) and expression (12) described earlier.

As shown in FIG. 12B, at the measurement point B in image A shown in FIG. 10, since the input value Vin is 0, the display brightness Lc is calculated as 0.001 nit in accordance with expression (12). At the measurement point B in images B to E in FIG. 10, since the input value Vin is not 0, the display brightness Lc is 250 nit in image B, 500 nit in image C, 750 nit in image D, and 1000 nit in image E in accordance with expression (11). In addition, as shown in FIG. 12A, at the measurement point A in images A to E in FIG. 10, since the input value Vin is not 0, the display brightness Lc is 2.51 nit in image A, 2.74 nit in image B, 2.96 nit in image C, 3.19 nit in image D, and 3.41 nit in image E in accordance with expression (11).

Expression (11) can be expanded as represented by Expression (15). In the example shown in FIG. 12A, in expression (15), the input value Vin, the panel contrast (Cp), and the maximum display brightness Lmax when the backlight brightness Le is 100% are fixed and the backlight brightness Le is variable. Therefore, FIG. 12A reveals that a brightness error due to the backlight brightness Le has occurred.

[Math. 49]

$$\begin{aligned} Lc &= \left(\left(\frac{Vmaxin}{4095}\times\left(\frac{1}{Le}\right)^{\frac{1}{pg}}\right)^{pg}\times\left(1-\frac{1}{Cp}\right)+\frac{1}{Cp}\right)\times Lmax\times Le \\ &= \left(\frac{Vin}{4095}\right)^{pg}\times\frac{1}{Le}\times\left(1-\frac{1}{Cp}\right)\times Lmax\times Le+\frac{1}{Cp}\times Lmax\times Le \\ &= \left(\frac{Vin}{4095}\right)^{pg}\times\left(1-\frac{1}{Cp}\right)\times Lmax+\frac{1}{Cp}\times Lmax\times Le \end{aligned} \tag{15}$$

Next, with reference to FIGS. 13A and 13B, an example in a case of correcting an input image using the method according to the first example will be described. FIG. 13A shows the display brightness Lc at the measurement point A shown in FIG. 10, and FIG. 13B shows the display brightness Lc at the measurement point B shown in FIG. 10. The display brightness Lc can be calculated in accordance with expression (13) and expression (14) described earlier.

As shown in FIG. 13B, at the measurement point B in image A shown in FIG. 10, since the input value Vin is 0, the display brightness Lc is calculated as 0.001 nit in accordance with expression (14). At the measurement point B in images B to E in FIG. 10, since the input value Vin is not 0, the display brightness Lc is 250 nit in image B, 500 nit in image C, 750 nit in image D, and 1000 nit in image E in accordance with expression (13). In addition, as shown in FIG. 13A, at the measurement point A in images A to E shown in FIG. 10, since the input value Vin is not 0, the display brightness Lc is calculated as 2.51 nit in all of the images A to E in accordance with expression (13). Therefore, FIG. 13A shows that the brightness error is suppressed.

As described above, in the first example, an image is corrected based on a backlight brightness Le, a panel contrast, and a target contrast so as to suppress a newly-found brightness error that is a brightness error related to the backlight brightness and the panel contrast. As a result, since accuracy of display brightness is improved and black floating is suppressed, display that imparts a sense of higher contrast as is conventional can be realized. It should be noted that a correction method of an image is not limited to the method using the correction coefficient Gt based on expression (9). Image can be corrected using any method as long as the brightness error related to the backlight brightness and the panel contrast can be suppressed.

Second Example

Figure 14:
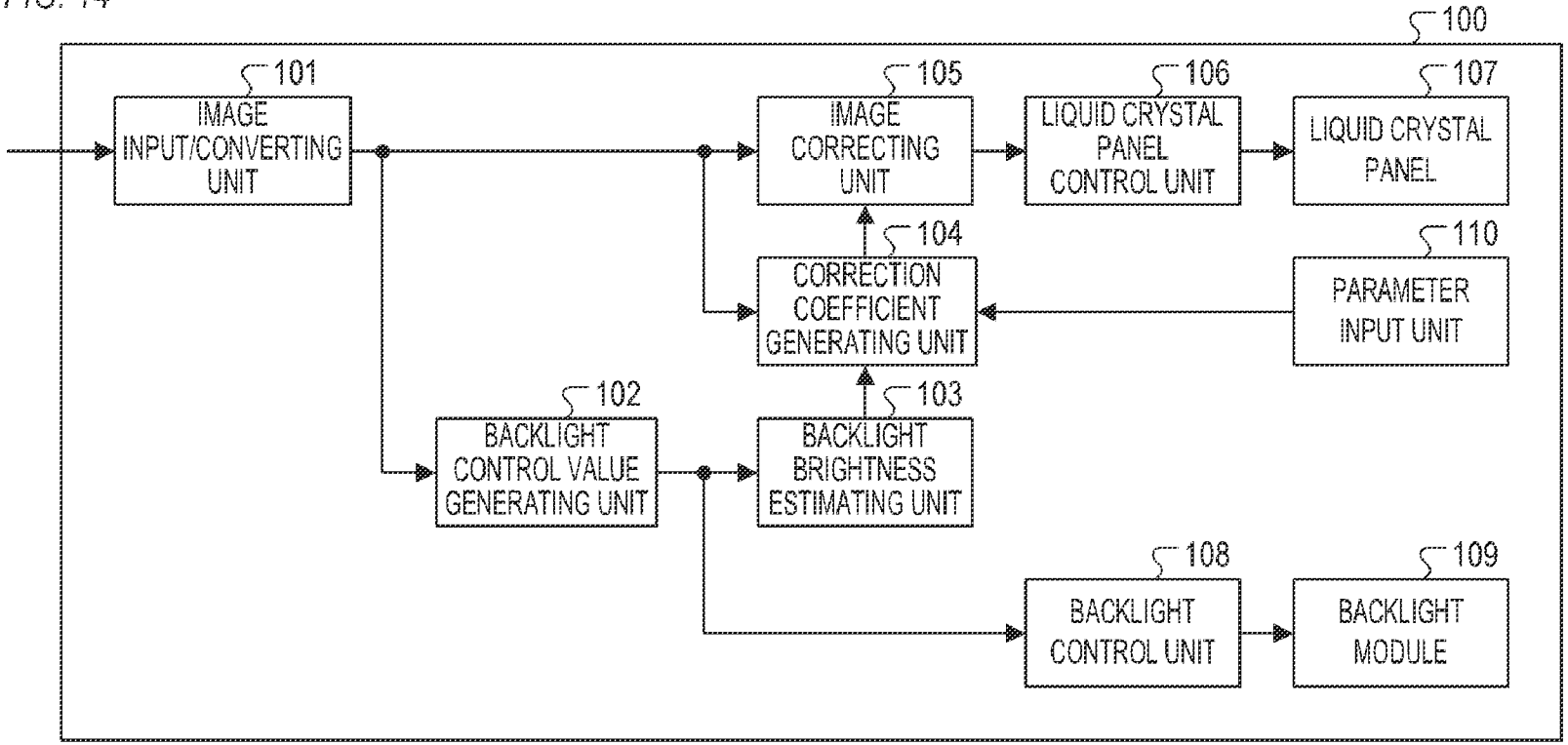
FIG. 14 is a block diagram showing functional blocks of a liquid crystal display apparatus according to a second example.

A second example of the present invention will be described below. In the second example, an example will be described in which a parameter related to a target contrast used to calculate the correction coefficient Gt is input from the outside. FIG. 14 is a block diagram showing functional blocks of the liquid crystal display apparatus 100 according to the second example. The liquid crystal display apparatus 100 shown in FIG. 14 has a configuration in which a parameter input unit 110 has been added to the liquid crystal display apparatus 100 shown in FIG. 1.

The parameter input unit 110 inputs a parameter related to the target contrast from the outside. For example, the parameter related to the target contrast is a value Ct corresponding to a maximum brightness of the target contrast and is input from the outside of the liquid crystal display apparatus 100 in accordance with a user operation with respect to an OSD (On Screen Display) menu. The parameter input unit 110 outputs the parameter (the target contrast) having been input in accordance with a user operation to the correction coefficient generating unit 104. It should be noted that the parameter related to the target contrast may be any kind of parameter as long as the target contrast can be comprehended (determined) from the parameter. For example, instead of the value Ct, the parameter related to the target contrast may be one or more setting values such as an identifier of the target contrast. The correction coefficient generating unit 104 may comprehend (determine) the target contrast based on the one or more setting values. The parameter input method is not limited to the method described above which involves using an OSD menu and other input methods may be adopted.

Figure 15:
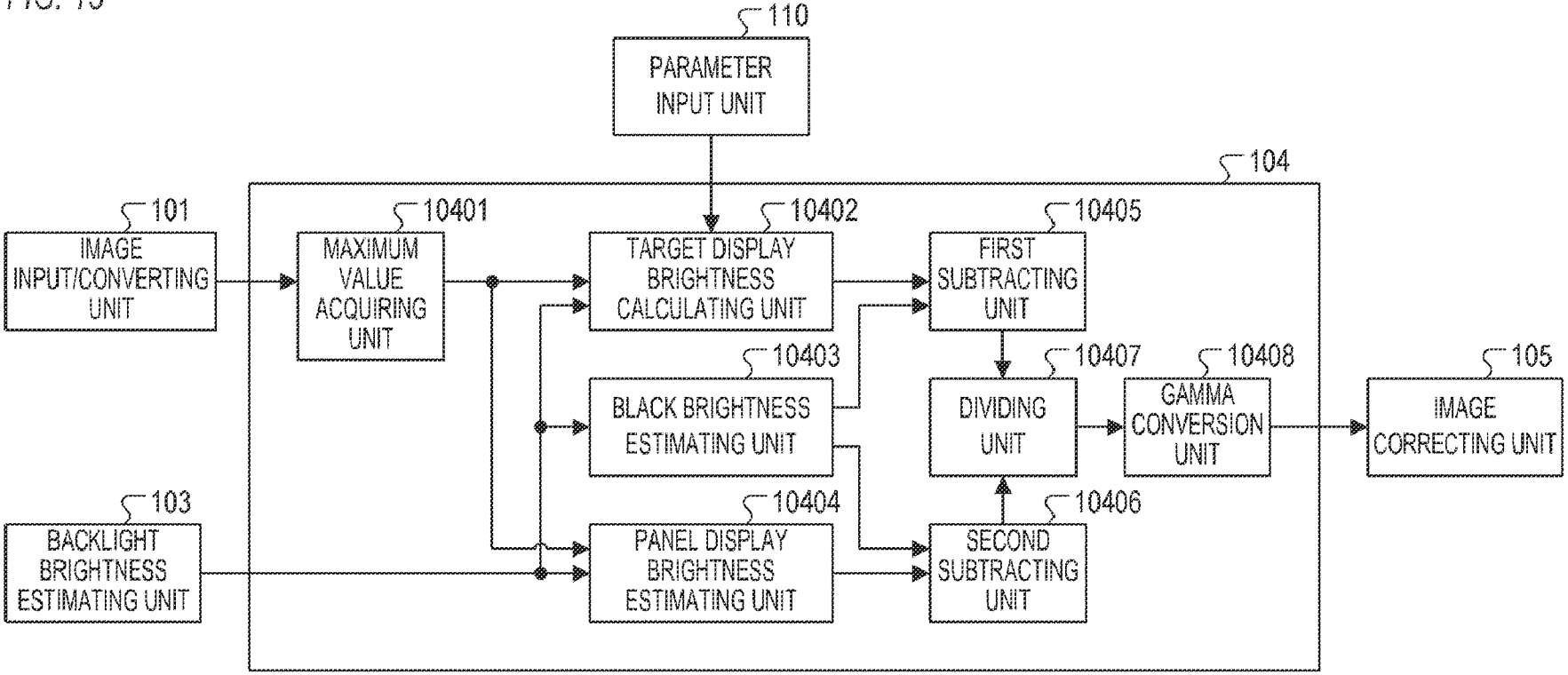
FIG. 15 is a block diagram showing functional blocks of a correction coefficient generating unit according to the second example.

FIG. 15 is a block diagram showing functional blocks of the correction coefficient generating unit 104 according to the second example. In the correction coefficient generating unit 104 shown in FIG. 15, the parameter (the target contrast) output from the parameter input unit 110 is input to the target display brightness calculating unit 10402.

As described above, in the second example, a parameter related to a target contrast used to calculate the correction coefficient Gt is input (designated) from the outside. Accordingly, a brightness error with respect to a display brightness with an arbitrary target contrast (a brightness error related to a backlight brightness and a panel contrast) can be suppressed and accuracy of display brightness can be improved.

Third Example

Figure 16:
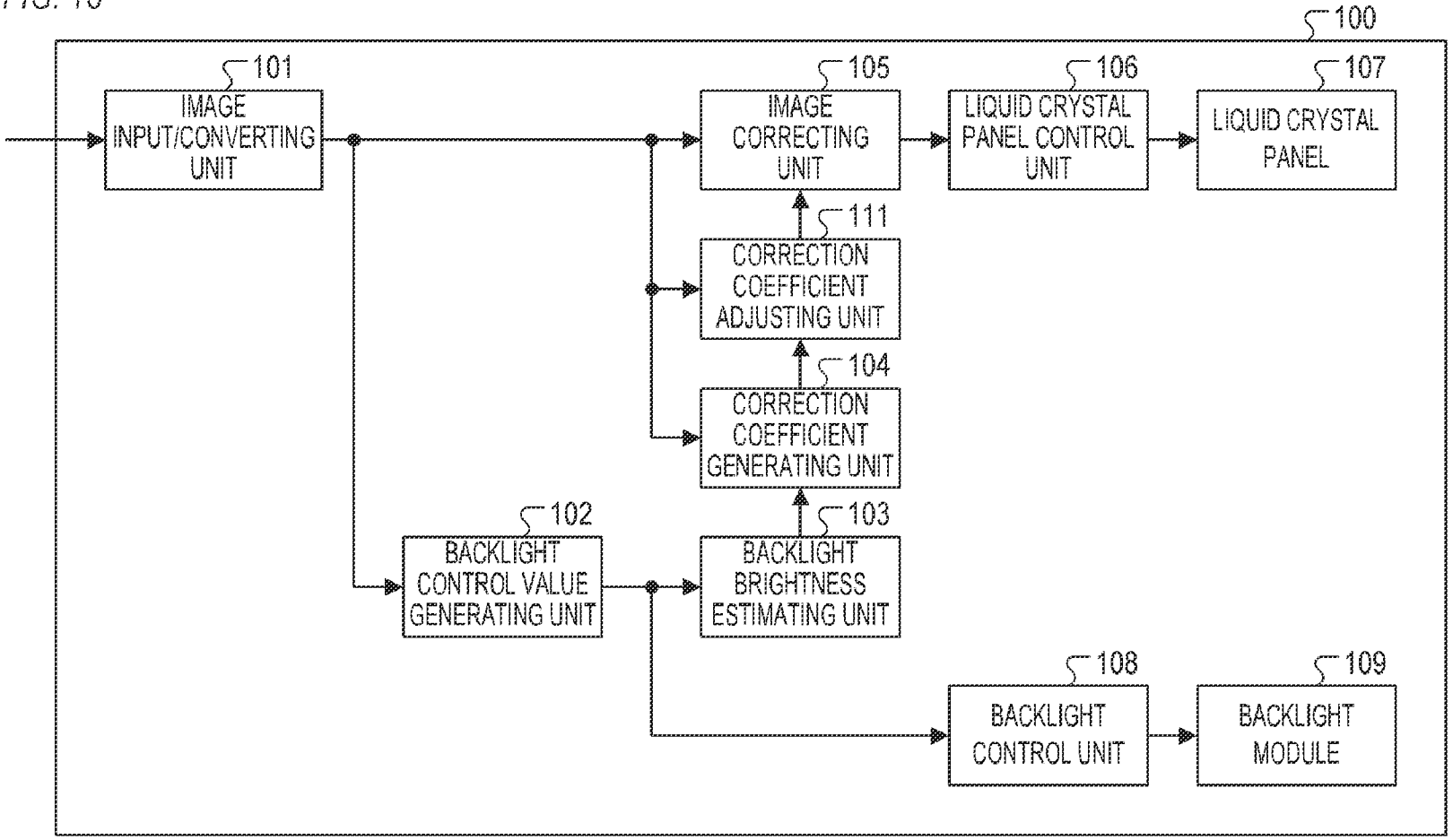
FIG. 16 is a block diagram showing functional blocks of a liquid crystal display apparatus according to a third example.

A third example of the present invention will be described below. In the third example, an example will be described in which an input image is corrected so that blocked-up shadows are not created. FIG. 16 is a block diagram showing functional blocks of the liquid crystal display apparatus 100 according to the third example. The liquid crystal display apparatus 100 shown in FIG. 16 has a configuration in which a correction coefficient adjusting unit 111 has been added to the liquid crystal display apparatus 100 shown in FIG. 1.

The correction coefficient adjusting unit 111 limits the correction coefficient Gt generated by the correction coefficient generating unit 104 so as to suppress blocked-up shadows due to the application of the correction coefficient Gt. Specifically, the image input/converting unit 101 outputs a minimum value among an R value, a G value, and a B value of an RGB value that is the pixel value of input image data to the correction coefficient adjusting unit 111. The correction coefficient adjusting unit 111 limits a lower limit value of the correction coefficient Gt to an inverse of the minimum value output from the image input/converting unit 101. In other words, the correction coefficient adjusting unit 111 limits the correction coefficient Gt to a value equal to or larger than the minimum value output from the image input/converting unit 101. It should be noted that processing by the correction coefficient adjusting unit 111 (adjustment of the correction coefficient Gt) is not limited to the processing described above and may be other processing for adjusting the correction coefficient Gt so that blocked-up shadows are suppressed. The inverse for limiting the correction coefficient Gt may be an inverse of a maximum value, an average value, an intermediate value, or the like of an R value, a G value, and a B value or an inverse of a Y value of YCbCr, XYZ, or the like.

A specific example of correction coefficient adjustment processing by the correction coefficient adjusting unit 111 will be described with reference to FIGS. 17A to 17C. It is assumed that a gradation value of image data output from the image input/converting unit 101 and the image correcting unit 105 is a 12-bit unsigned integer value.

Figure 17A:
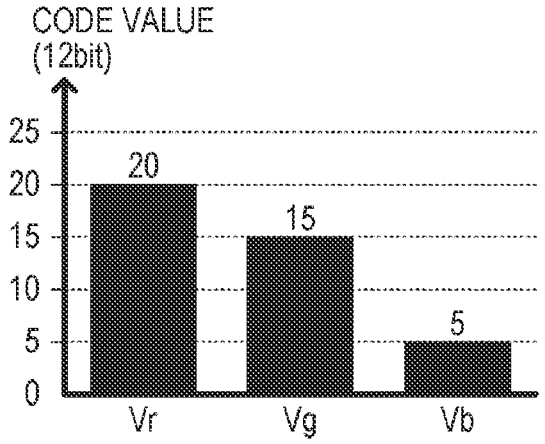
FIG. 17A to 17C are diagrams for describing a specific example of correction coefficient adjustment processing according to the third example.

FIG. 17A shows an RGB value (Vr, Vg, Vb) that is a pixel value of input image data output from the image input/converting unit 101, in which the R value Vr is 20, the G value Vg is 15, and the B value Vb is 5.

Figure 17B:
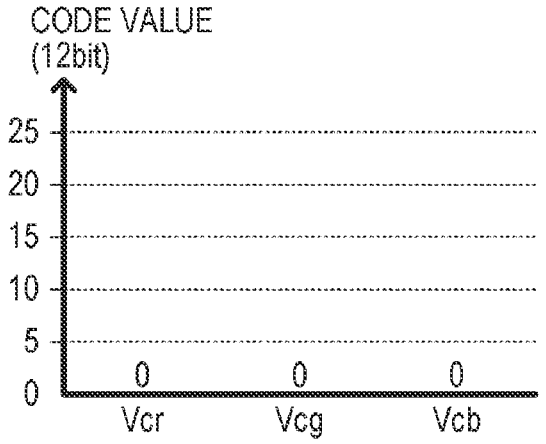

FIG. 17B shows an RGB value when the RGB value (Vr, Vg, Vb) shown in FIG. 17A is corrected using the correction coefficient Gt=0.02 (an RGB value (Vrc, Vgc, Vbc) that is a pixel value of corrected image data output from the image correcting unit 105). As represented by the following calculation formula, in accordance with expression (1) described in the first example, the R value Vrc=0.4, the G value Vgc=0.3, and the B value Vbc=0.1. Since the output of the image correcting unit 105 is a 12-bit unsigned integer value, all of the R value Vrc=0.4, the G value Vgc=0.3, and the B value Vbc=0.1 become 0 and blocked-up shadows occur in the corrected image.

$$Vrc=20\times0.02=0.4$$

$$Vgc=15\times0.02=0.3$$

$$Vbc=5\times0.02=0.1 \qquad \text{[Math. 50]}$$

Therefore, in order to suppress the blocked-up shadows in the corrected image, the correction coefficient adjusting unit 111 limits the correction coefficient Gt generated by the correction coefficient generating unit 104 using an inverse of a minimum value output from the image input/converting unit 101 (a minimum value among the R value Vr, the G value Vg, and the B value Vb) as a lower limit value. From FIG. 17A, since the minimum value is 5, the lower limit value of the correction coefficient Gt is 1/5=0.2. Since the correction coefficient Gt generated by the correction coefficient generating unit 104 is 0.02, the correction coefficient Gt is limited to 0.2.

When the minimum value among the R value Vr, the G value Vg, and the B value Vb is 0, a zero division occurs. In such a case, an inverse of the minimum value among the R value Vr, the G value Vg, and the B value Vb excluding zero may be adopted as the lower limit value of the correction coefficient Gt so as to prevent a zero division from occurring. For example, in a case where the RGB value (Vr, Vg, Vb)=(20, 15, 0), 1/15 may be adopted as the correction coefficient Gt.

Figure 17C:
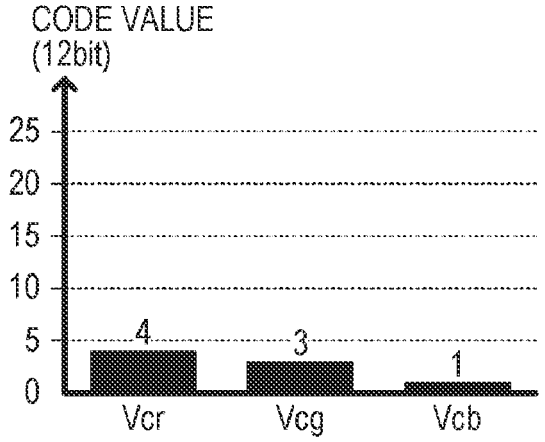

FIG. 17C shows an RGB value (Vrc, Vgc, Vbc) when the RGB value (Vr, Vg, Vb) shown in FIG. 17A is corrected using the correction coefficient Gt=0.2 after being limited. As represented by the following calculation formula, in accordance with expression (1) described in the first example, the R value Vrc=4, the G value Vgc=3, and the B value Vbc=1.

$$Vrc=20\times0.2=4$$

$$Vgc=15\times0.2=3$$

$$Vbc=5\times0.2=1 \qquad \text{[Math. 51]}$$

As described above, in the third example, since an input image is corrected so that blocked-up shadows do not occur, an image in which blocked-up shadows are suppressed can be displayed.

Fourth Example

Figure 18:
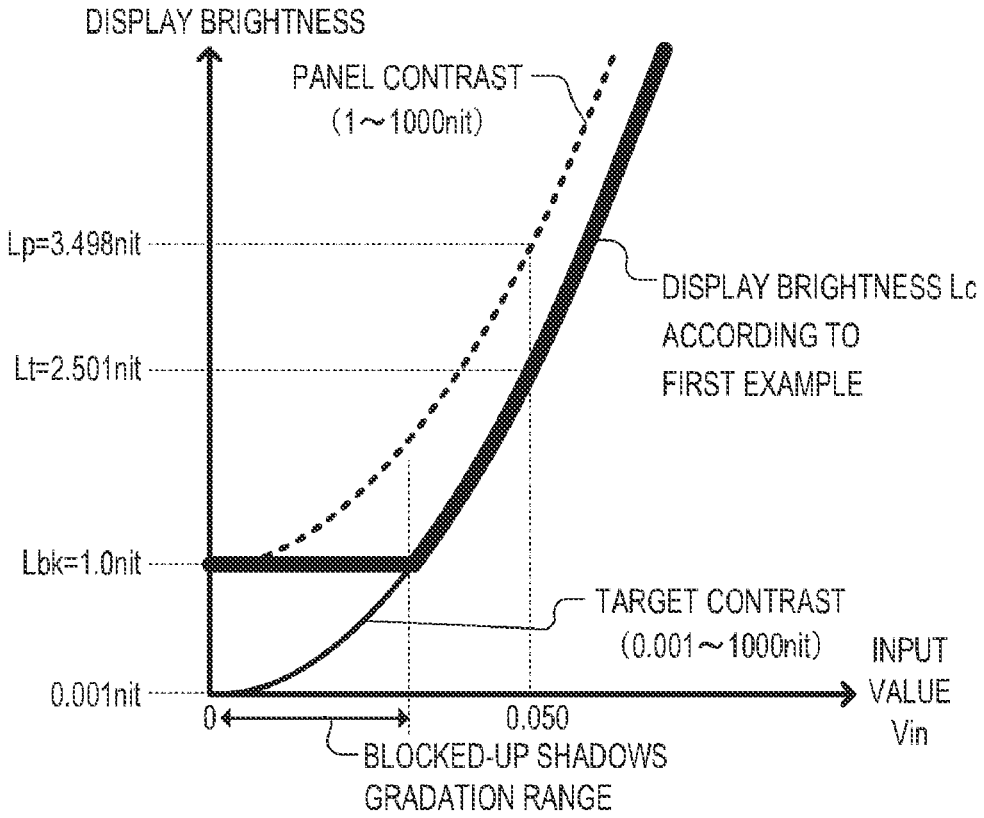
FIG. 18 is a diagram for illustrating blocked-up shadows that are suppressed in a fourth example.

A fourth example of the present invention will be described below. In the first example, blocked-up shadows may occur in a portion corresponding to a low gradation part (dark part) of an input image among a corrected image. Such blocked-up shadows will now be described in detail with reference to FIG. 18. FIG. 18 is a graph that is similar to FIG. 3. In FIG. 18, a display brightness Lc (panel display brightness) according to the first example is depicted by a bold line. It is assumed that the brightness dynamic range of a display with a target contrast is 0.001 to 1000 nit and the brightness dynamic range of a display with a panel contrast is 1 to 1000 nit. In this case, blocked-up shadows occur in the corrected image in a portion corresponding to a brightness range in which a pixel value of an input image is equal to or smaller than 1.0 nit. Specifically, as represented by the blocked-up shadows gradation range shown in FIG. 18, a portion corresponding to the brightness range of 0.001 to 1.0 nit is displayed with 1.0 nit. In the fourth example, an example of suppressing such blocked-up shadows will be described.

Figure 19:
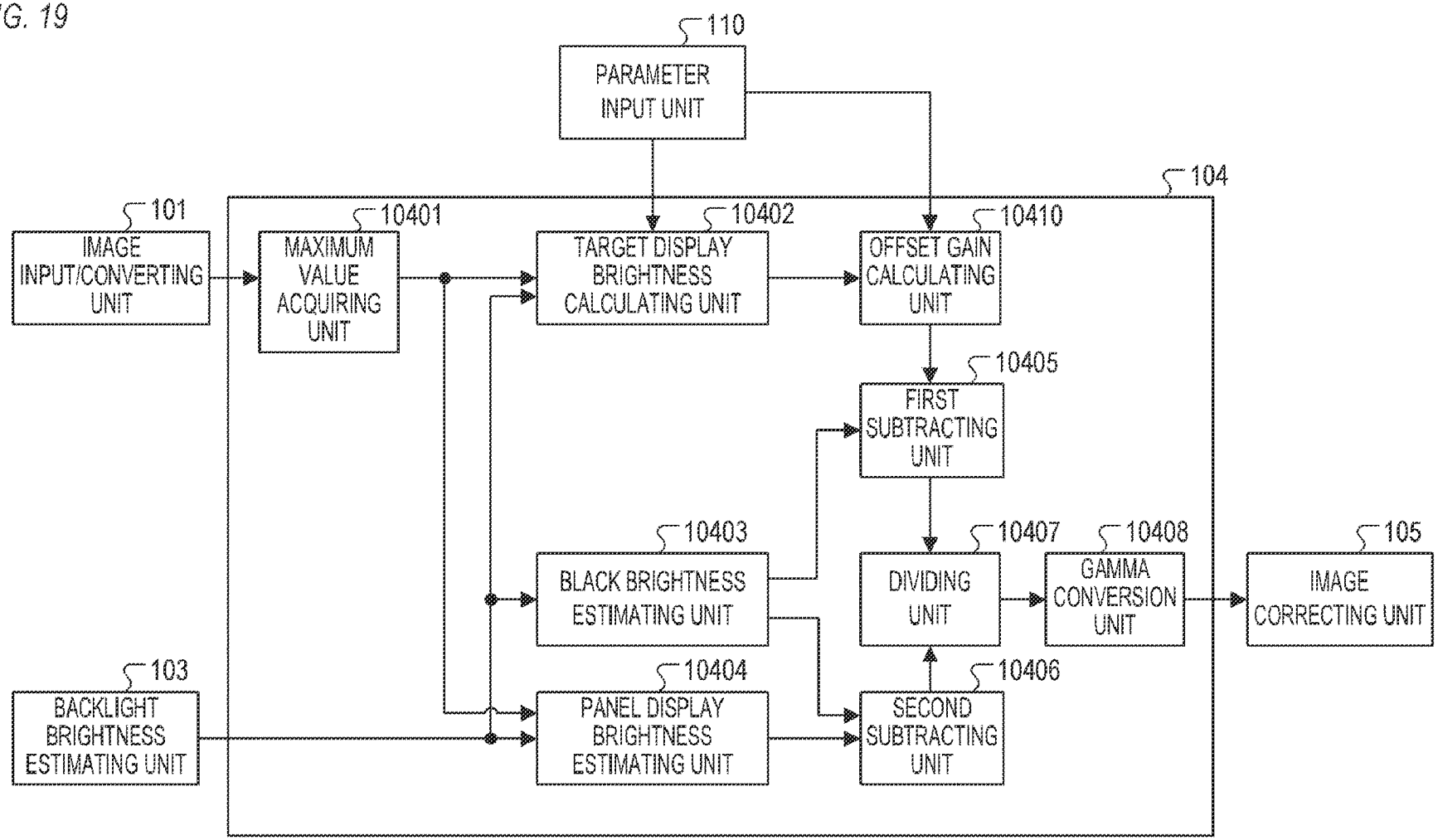
FIG. 19 is a block diagram showing functional blocks of a correction coefficient generating unit according to the fourth example.

FIG. 19 is a block diagram showing functional blocks of the correction coefficient generating unit 104 according to the fourth example. The correction coefficient generating unit 104 shown in FIG. 19 has a configuration in which an offset gain calculating unit 10410 has been added to the correction coefficient generating unit 104 shown in FIG. 2.

The offset gain calculating unit 10410 performs an addition of an offset value and a multiplication by a gain value with respect to the target display brightness Lt calculated by the target display brightness calculating unit 10402 and outputs a calculation result to the first subtracting unit 10405.

A calculation method of the offset gain calculating unit 10410 will now be described in detail.

First, the offset gain calculating unit 10410 determines a reference brightness Kt. For example, for each divided region, the offset gain calculating unit 10410 determines the reference brightness Kt of the divided region based on an average gradation value (an average pixel value) of an input image in the divided region. In the example shown in FIG. 20, the reference brightness Kt=2.0 nit is determined in accordance with an average gradation value of 0.05. It should be noted that a determination method of the reference brightness Kt is not particularly limited. For example, for each divided region, the offset gain calculating unit 10410 may determine the reference brightness Kt of the divided region based on a histogram of gradation values of an input image in the divided region. The reference brightness Kt may be input (set) from the parameter input unit 110 shown in FIG. 19.

Next, the offset gain calculating unit 10410 determines an offset value OFT. For example, the offset value OFT is black brightness Lbk which is 1.0 nit in the example shown in FIG. 20.

Next, the offset gain calculating unit 10410 determines a gain value GAIN. For example, the gain value GAIN is calculated by dividing the black brightness Lbk by the reference brightness Kt. In the example shown in FIG. 20, the gain value GAIN is 0.5.

Figure 20:
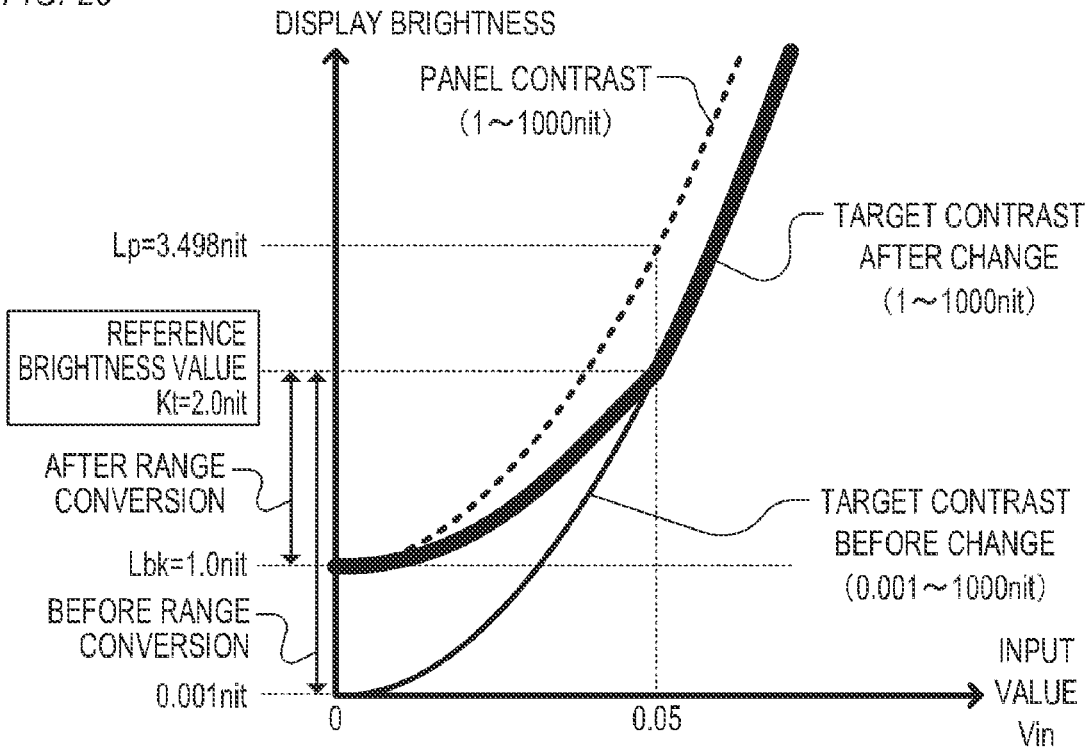
FIG. 20 is a diagram showing an example of a target contrast change according to the fourth example.

Finally, the offset gain calculating unit 10410 changes the target contrast by performing an addition of the offset value OFT and a multiplication by the gain value GAIN with respect to the target display brightness Lt. For example, the brightness range of 0.001 to 2.0 nit is convened into a brightness range of 1.0 to 2.0 nit and the target contrast depicted by a solid line in FIG. 20 is changed to the target contrast depicted by a bold line in FIG. 20. Hereinafter, brightness of the target contrast after the change (target display brightness) will be denoted as LtH. As shown in FIG. 20, as the target display brightness LtH that is equal to or higher than the reference brightness Kt, the target display brightness Lt calculated by the target display brightness calculating unit 10402 is adopted. In addition, the target display brightness LtH that is lower than the reference brightness Kt is calculated according to "(Lt×GAIN)+OFT".

As described above, in the fourth example, by changing the target contrast as shown in FIG. 20, blocked-up shadows in a corrected image (blocked-up shadows in a portion corresponding to a low gradation part (dark part) of an input image) can be suppressed.

Fifth Example

A fifth example of the present invention will be described below. In the fifth example, an example will be described in which blocked-up shadows in a corrected image (blocked-up shadows in a portion corresponding to a low gradation part (dark part) of an input image) are suppressed using a method that differs from the fourth example.

Figure 21:
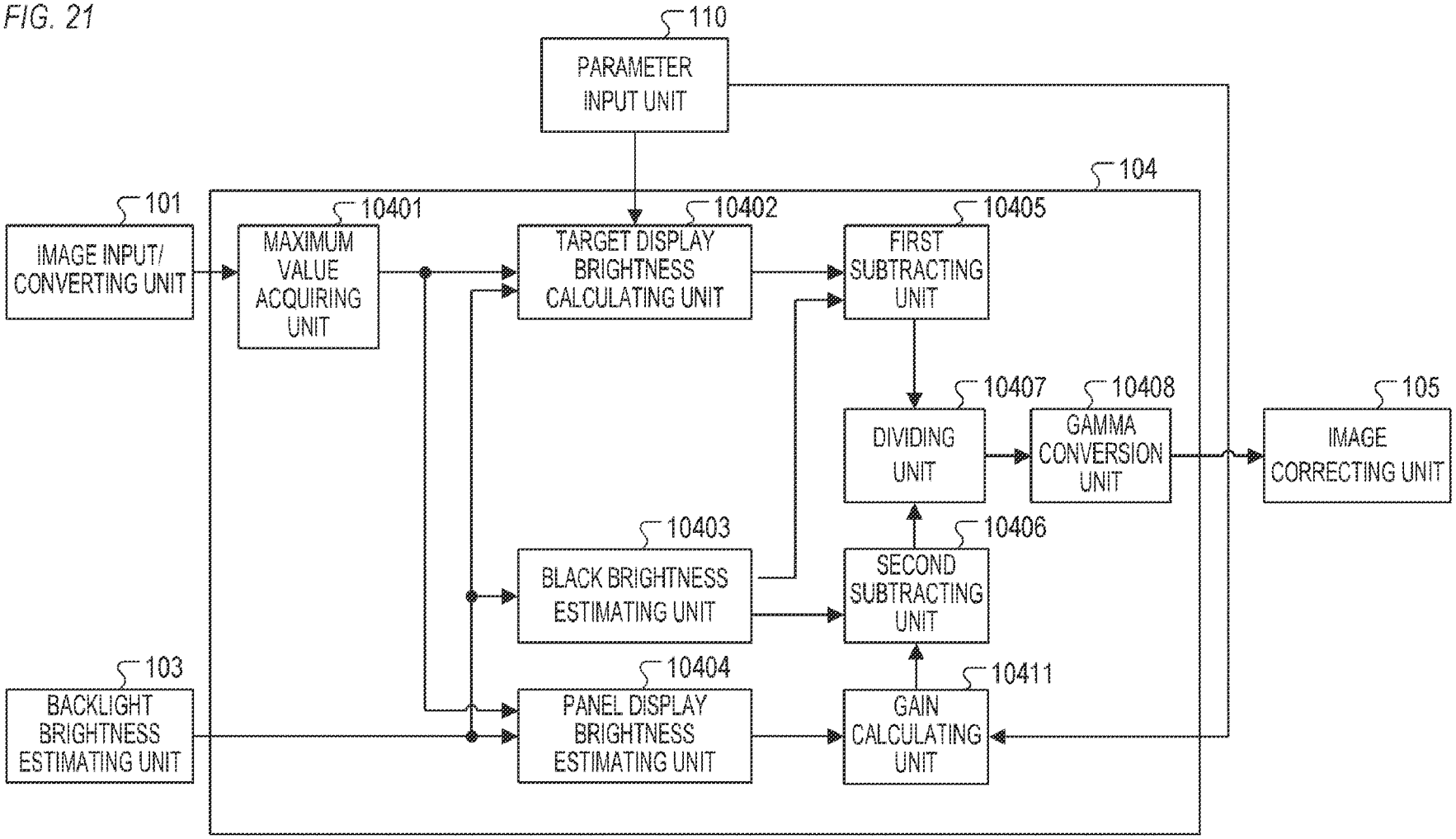
FIG. 21 is a block diagram showing functional blocks of a correction coefficient generating unit according to a fifth example.

FIG. 21 is a block diagram showing functional blocks of the correction coefficient generating unit 104 according to the fifth example. The correction coefficient generating unit 104 shown in FIG. 21 has a configuration in which a gain calculating unit 10411 has been added to the correction coefficient generating unit 104 shown in FIG. 2.

The gain calculating unit 10411 multiplies the panel display brightness Lp calculated by the panel display brightness estimating unit 10404 by a gain value and outputs a calculation result (a multiplied brightness) to the second subtracting unit 10406.

A calculation method of the gain calculating unit 10411 will now be described in detail.

Figure 22:
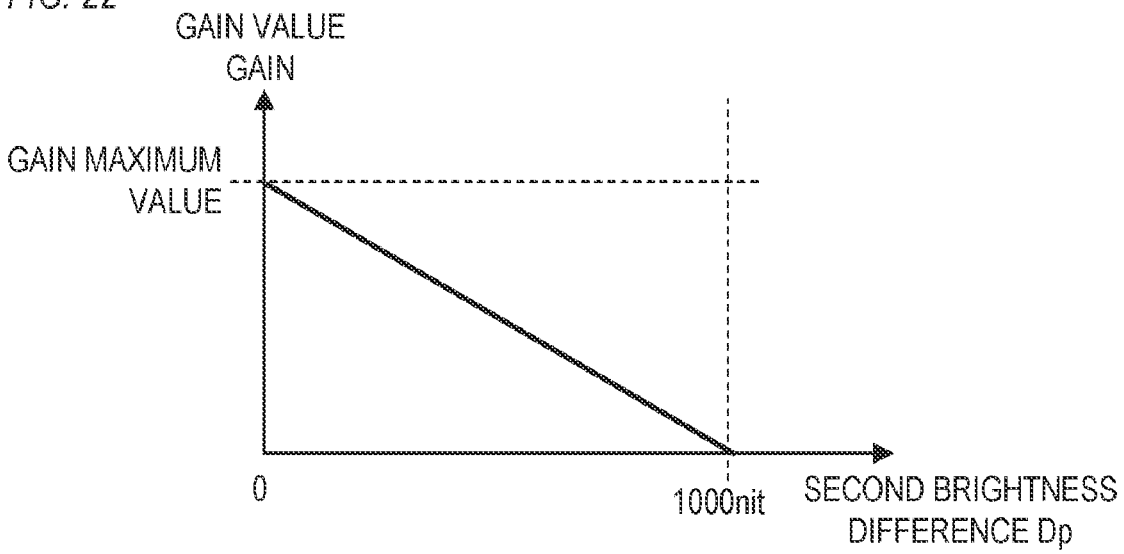
FIG. 22 is a diagram showing an example of a determination method of a gain value according to the fifth example.

First, the gain calculating unit 10411 determines a gain value GAIN. For example, the gain value GAIN is determined in accordance with the second brightness difference Dp as shown in FIG. 22. In this case, a gain maximum value shown in FIG. 22 is set by the parameter input unit 110 shown in FIG. 21. While the gain value GAIN linearly decreases as the second brightness difference Dp increases in FIG. 22, alternatively, the gain value GAIN may nonlinearly decrease as the second brightness difference Dp increases. Since the larger the gradation value of an input image, the larger the second brightness difference Dp, a smaller value is used as the gain value GAIN as the gradation value of the input image increases.

Next, the gain calculating unit 10411 obtains a multiplied brightness LpG (=Lp×GAIN) by multiplying the panel display brightness Lp by the gain value GAIN.

Figure 23:
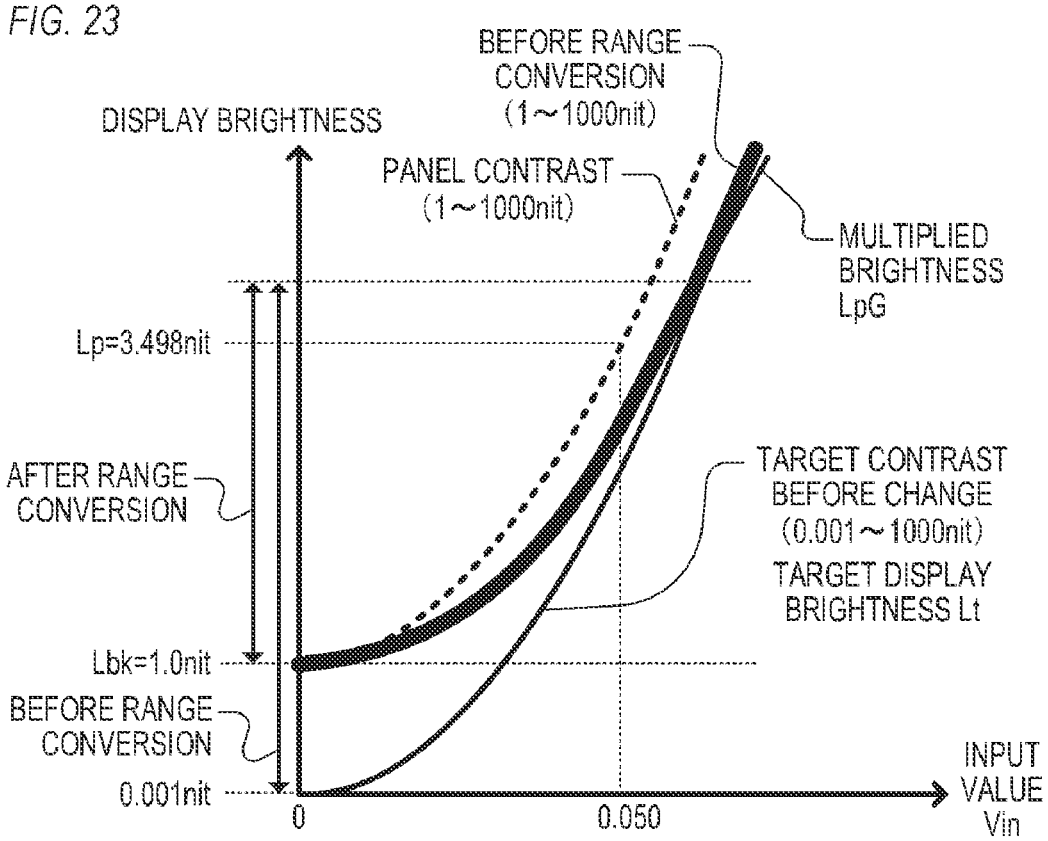
FIG. 23 is a diagram showing an example of a target contrast change according to the fifth example.

Finally, the gain calculating unit 10411 changes the target contrast by changing the target display brightness Lt. For example, the target contrast depicted by a solid line in FIG. 23 is changed to the target contrast depicted by a bold line in FIG. 23. Hereinafter, brightness of the target contrast after the change (target display brightness) will be denoted as LtH. As shown in FIG. 23, when the target display brightness Lt is equal to or higher than the multiplied brightness LpG, the target display brightness Lt is adopted as the target display brightness LtH. In addition, when the target display brightness Lt is lower than the multiplied brightness LpG, the multiplied brightness LpG is adopted as the target display brightness LtH. In other words, the target display brightness Lt that is lower than the multiplied brightness LpG is changed to the multiplied brightness LpG.

As described above, in the fifth example, by changing the target contrast as shown in FIG. 23, blocked-up shadows in a corrected image (blocked-up shadows in a portion corresponding to a low gradation part (dark part) of an input image) can be suppressed. In the fifth example, gradation characteristics (a correspondence relationship between a gradation value and brightness) change more smoothly between a brightness range that adopts the target display brightness Lt and a brightness range that does not adopt the target display brightness Lt as compared to the fourth example. Therefore, in a case where an input image includes gradation or the like, an occurrence of a gradation level difference can be suppressed and a high-quality image with a smooth gradation change can be displayed.

Sixth Example

Figure 24:
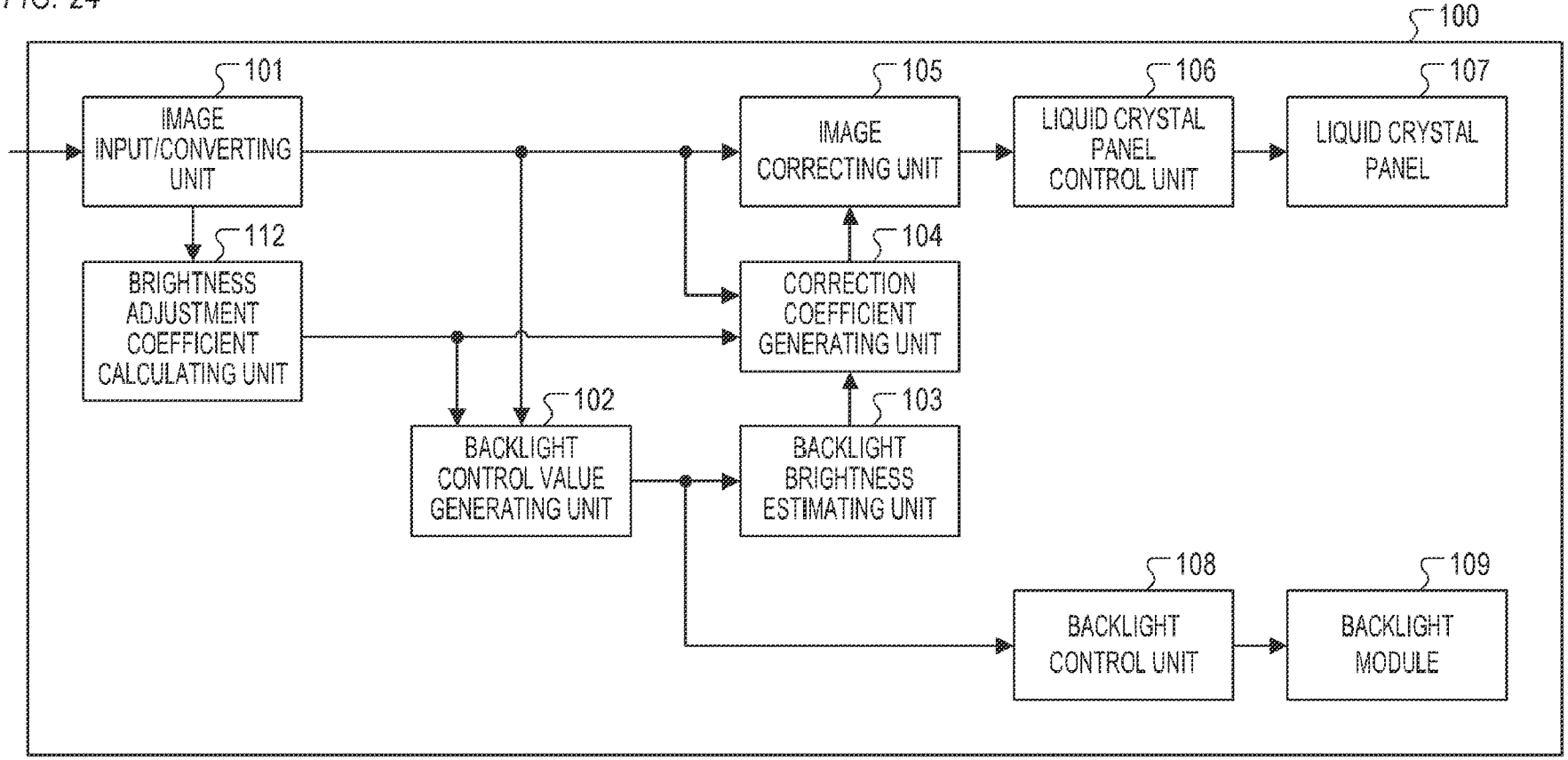
FIG. 24 is a block diagram showing functional blocks of a liquid crystal display apparatus according to a sixth example.

A sixth example of the present invention will be described below. In the sixth example, an example will be described in which black floating is suppressed by image correction when a decline in brightness due to image signal processing is compensated by backlight brightness. FIG. 24 is a block diagram showing functional blocks of the liquid crystal display apparatus 100 according to the sixth example. The liquid crystal display apparatus 100 shown in FIG. 24 has a configuration in which a brightness adjustment coefficient calculating unit 112 has been added to the liquid crystal display apparatus 100 shown in FIG. 1. Alternatively, the brightness adjustment coefficient calculating unit 112 can also be added to the liquid crystal display apparatus 100 shown in FIG. 14 or 16.

The brightness adjustment coefficient calculating unit 112 calculates a brightness adjustment coefficient Ladj based on a brightness reduction rate attributable to image signal processing in the image input/converting unit 101 and outputs the brightness adjustment coefficient Ladj to the backlight control value generating unit 102 and the correction coefficient generating unit 104. In the backlight control value generating unit 102, a backlight control value is adjusted based on the brightness adjustment coefficient Ladj calculated by the brightness adjustment coefficient calculating unit 112. In addition, in the correction coefficient generating unit 104, a correction coefficient is adjusted based on the brightness adjustment coefficient Ladj calculated by the brightness adjustment coefficient calculating unit 112. While examples of image signal processing that causes a decline in brightness include processing for displaying overly-white of a limited range signal and processing for changing a color balance by color temperature adjustment or the like, processing is not limited thereto and includes all types of processing attributable to image signal processing. Hereinafter, an example of displaying overly-white of a limited range signal will be described with reference to FIGS. 25A, 25B, and 26.

Figure 25A:
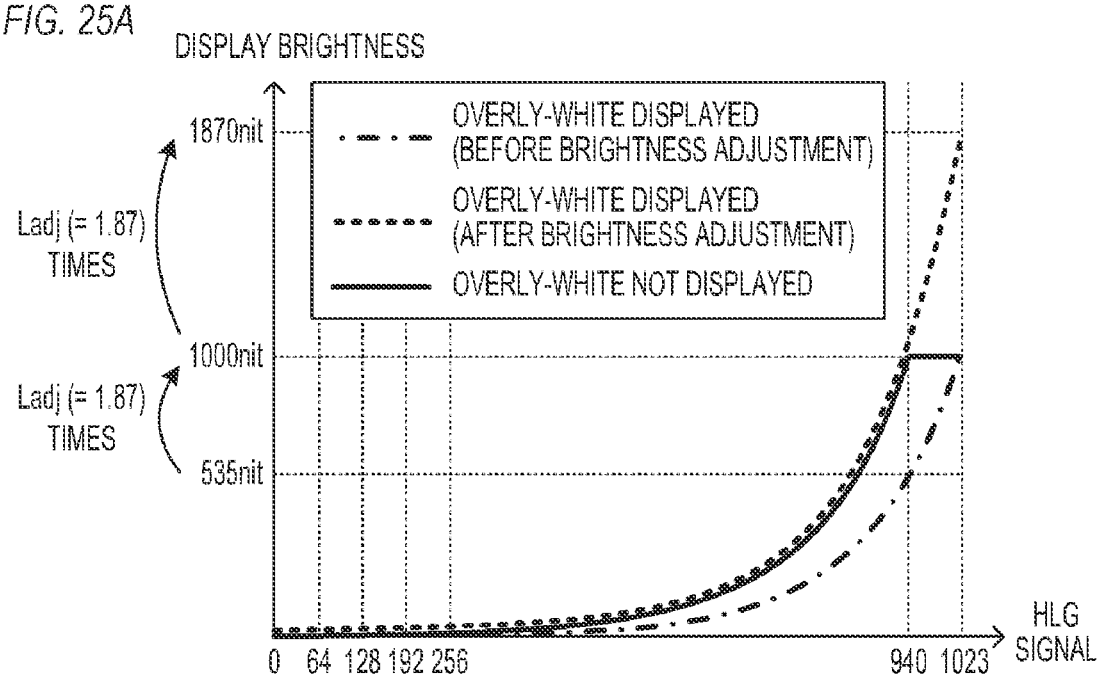
FIGS. 25A and 25B are diagrams showing an example of display brightness according to the sixth example.

FIG. 25A is a graph representing a relationship between a gradation value (hereinafter, an HLG signal) of a Hybrid Log-Gamma (hereinafter, HLG) input image and display brightness. In FIG. 25A, the HLG signal is a 10-bit limited range signal. In the 10-bit limited range signal, a gradation value of 64 is equal to 0% (black), a gradation value of 940 is equal to 100% (white), and a gradation value of 941 to 1023 is equal to or exceeds 100% (overly-white). In the example shown in FIG. 25A, it is assumed that local dimming control (backlight control) and image correction are performed using a target contrast of 200 thousand: 1 by the method according to the first example. Accordingly, when a maximum display brightness is 1000 nit, a gradation range of 0 to 1023 is displayed with 0.005 to 1000 nit.

A solid line in FIG. 25A depicts an example of display brightness of an HLG signal when overly-white is not displayed. In addition, a dashed-dotted line in FIG. 25A depicts an example of display brightness of an HLG signal when overly-white is displayed. A case where overly-white is not displayed is a case where a region of overly-white is displayed without imparting gradation properties thereto and a case where all gradation values of overly-white are displayed with a same display brightness (maximum display brightness). A case where overly-white is displayed is a case where a region of overly-white is displayed by imparting gradation properties thereto and a case where each gradation value of overly-white is displayed with a different display brightness.

In the example depicted by the solid line in FIG. 25A, since overly-white is not displayed, the gradation range of the HLG signal is expanded from a gradation range (limited range) of 64 to 940 to a gradation range (full range) of 0 to 1023. Therefore, when the target contrast is 200 thousand to 1 and the maximum display brightness is 1000 nit, as depicted by the solid line in FIG. 25A, the display brightness of a gradation value of 940 is approximately 1000 nit and the display brightness of a gradation value of 64 is approximately 0.005 nit.

On the other hand, in the example depicted by the dashed-dotted line in FIG. 25A, since overly-white is displayed, the gradation range of the HLG signal is expanded from a gradation range (limited range and overly-white) of 64 to 1023 to a gradation range (full range) of 0 to 1023.

Now, let us consider a case where local dimming control and image correction are performed using a target contrast of 200 thousand: 1 and a maximum display brightness of 1000 nit by the method according to the first example. In this case, gradation values of 64 to 1023 of an HLG signal is displayed with a brightness dynamic range of 0.005 to 1000 nit. Therefore, as depicted by the dashed-dotted line in FIG. 25A, the display brightness of a gradation value of 1023 is approximately 1000 nit and the display brightness of a gradation value of 64 is approximately 0.005 nit. In addition, a display brightness of a gradation value of 940 is a brightness obtained by normalizing, to the brightness dynamic range of 0.005 to 1000 nit, a linear brightness (a brightness that linearly increases with an increase in a gradation value) having been converted by reverse OETF and OOTF of HLG. In this case, OETF stands for Opto-Electrical Transfer Function and OOTF stands for Opto-Optical Transfer Function. The reverse OETF and OOTF of HLG can be approximately represented by expression (16).

[Math. 52]

$$L = OOTF\left[OETF^{-1}[Vext]\right] \tag{16}$$

$$OETF^{-1}[x] = \begin{cases} \dfrac{x^2}{3} & ※0 \le x \le \dfrac{1}{2} \\ \dfrac{e^{\frac{x-0.55991073}{0.17883277}} + 0.28466892}{12} & ※\dfrac{1}{2} < x \le 1 \end{cases}$$

$$OOTF[E] = E^{\gamma}$$

In expression (16), γ denotes a system gamma, Vext denotes a value obtained by normalizing an HLG signal with a limited range (64 to 940) to 0.000 to 1.000, and L denotes a brightness level (1.000=1 time). In the example shown in FIG. 25A, the system gamma is assumed to be 1.2. In addition, when the HLG signal is 940, Vext is calculated as 1.00 using the calculation formula below.

[Math. 53]

$$Vext = \frac{940 - 64}{940 - 64} = 1{,}000$$

Furthermore, when the HLG signal (a gradation value of an input image) is 1023, Vext is calculated as 1.095 using the calculation formula below.

[Math. 54]

$$Vext = \frac{1023 - 64}{940 - 64} \approx 1095$$

From expression (16), a brightness level L in a case where the HLG signal is 940 is calculated as 1.000 and the brightness level L in a case where the HLG signal is 1023 is calculated as approximately 1.870. In other words, when displaying overly-white of an HLG signal, the brightness level L ranges from approximately 0.000 to 1.870. Using expression (17), the brightness level L can be approximated and calculated to a brightness level (hereinafter, a normalized brightness level) Ln having been normalized to 0.000 to 1.000.

[Math. 55]

$$\mathrm{Ln} = \frac{L}{1.870} \tag{17}$$

Therefore, when the gradation value of the input image is 940, from expression (16) and expression (17), the normalized brightness level Ln is approximately 0.535. In addition, when the gradation value of the input image is 1023, from expression (16) and expression (17), the normalized brightness level Ln is 1.000.

As described earlier, in the example shown in FIG. 25A, local dimming control and image correction are performed using a target contrast of 200 thousand: 1 by the method according to the first example. Therefore, when a maximum display brightness is 1000 nit, an image is displayed in a gradation range of 0.005 to 1000 nit. When displaying overly-white of an HLG image, the normalized brightness level Ln calculated using expression (16) and expression (17) is assigned to the brightness dynamic range of 0.005 to 1000 nit. As a result, the display brightness when the HLG signal is 940 is approximately 535 nit as depicted by the dashed-dotted line in FIG. 25A. In addition, the display brightness when the HLG signal is 1023 is approximately 1000 nit as depicted by the dashed-dotted line in FIG. 25A.

As described above, even when performing display in a same brightness dynamic range, in a case where overly-white is displayed (the dashed-dotted line in FIG. 25A), white brightness (display brightness of a gradation value of 940) declines as compared to a case where overly-white is not displayed (the solid line in FIG. 25A). In consideration thereof, in the sixth example, in the case of the dashed-dotted line in FIG. 25A, the gradation value 940 is displayed with around 1000 nit by increasing a maximum brightness of the backlight module 109.

A dashed line in FIG. 25A depicts a relationship between an HLG signal and display brightness when overly-white is displayed in a similar manner to the dashed-dotted line in FIG. 25A. As described earlier, in the example shown in FIG. 25A, local dimming control and image correction are performed using a target contrast of 200 thousand: 1 by the method according to the first example. Furthermore, in the example of the dashed line shown in FIG. 25A, backlight brightness is increased so that the maximum display brightness is 1.87 times that of the example of the dashed-dotted line in FIG. 25A or, in other words, 1870 nit. Therefore, the brightness dynamic range of the dashed line in FIG. 25A is 0.009 to 1870 nit. In this case, 1.87 is an inverse (1/0.535≈1.87) of a reduction rate (0.535) of white brightness.

As described earlier, the normalized brightness level Ln of the gradation value 940 when displaying overly-white of an HLG signal is approximately 0.535. Therefore, the display brightness of the gradation value 940 in the brightness dynamic range 0.009 to 1870 nit is approximately 1000 nit as depicted by the dashed line in FIG. 25A.

In a similar manner, as described earlier, the normalized brightness level Ln of the gradation value 1023 when displaying overly-white of an HLG signal is approximately 1.000. Therefore, the display brightness of the gradation value 1023 in the brightness dynamic range 0.009 to 1870 nit is approximately 1870 nit as depicted by the dashed line in FIG. 25A.

As described above, by increasing the backlight brightness, a decline in white brightness due to displaying overly-white can be compensated.

Figure 25B:
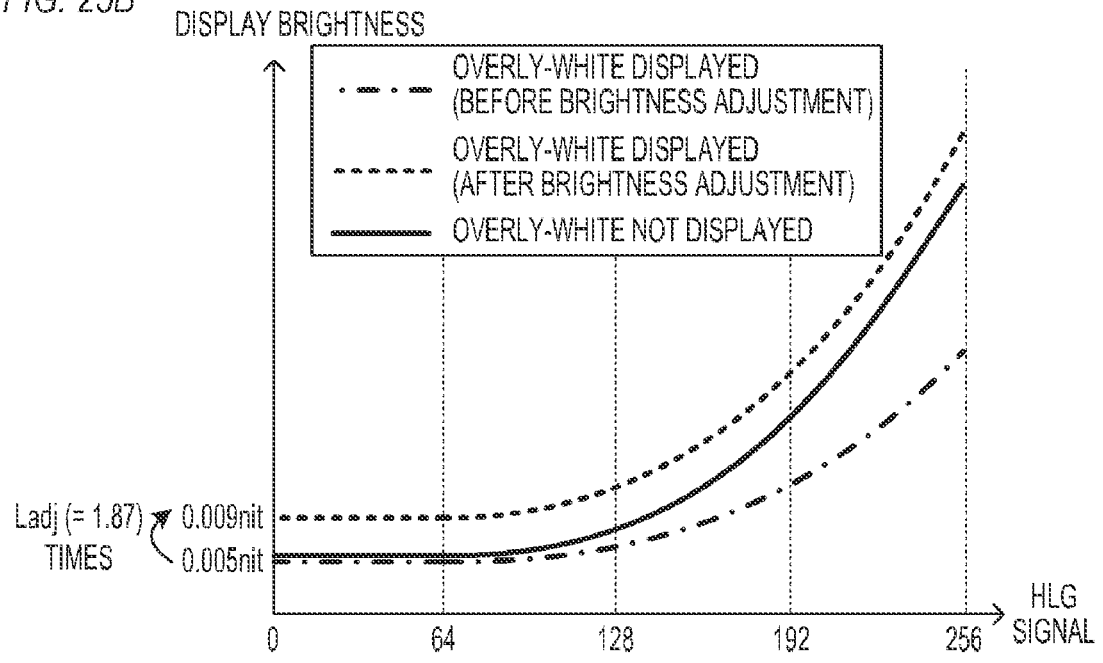

FIG. 25B is a graph showing a display brightness of a dark part gradation among FIG. 25A. As described earlier, the brightness dynamic range in a case where overly-white is not displayed (solid lines in FIGS. 25A and 25B) is approximately 0.005 to 1000 nit. In addition, the brightness dynamic range in a case where overly-white is displayed (dashed lines in FIGS. 25A and 25B) is approximately 0.009 to 1870 nit. In this manner, since black floating occurs in a case where overly-white is displayed as compared to a case where overly-white is not displayed, a brightness error occurs in the dark part gradation as shown in FIG. 25B.

Figure 26:
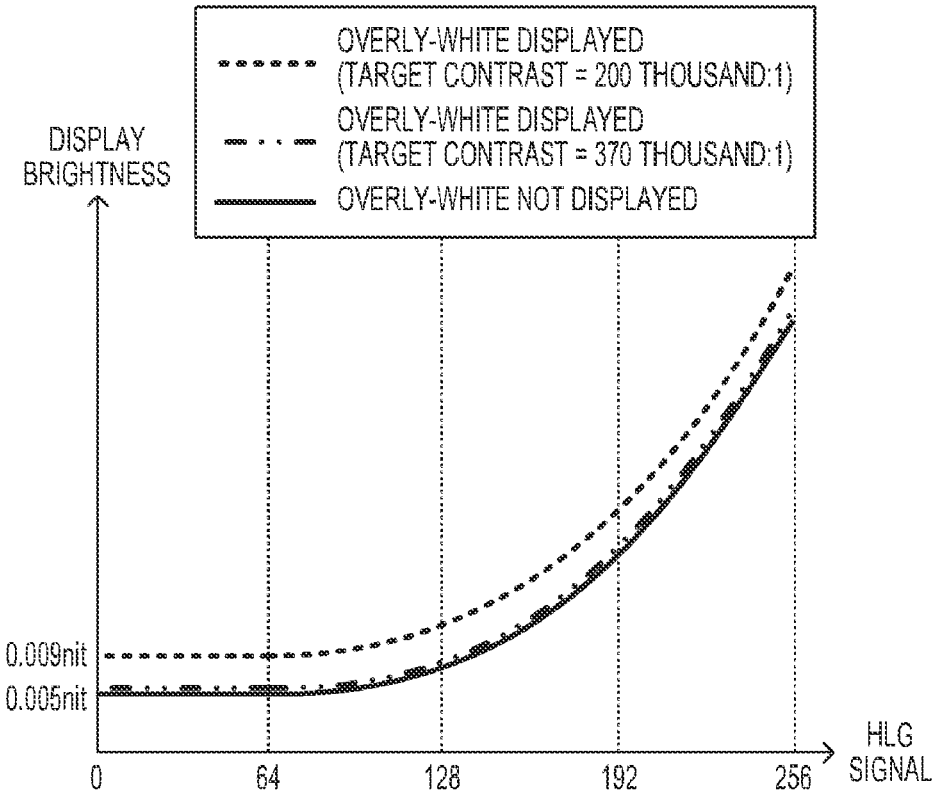
FIG. 26 is a diagram showing an example of display brightness according to the sixth example.

FIG. 26 is a graph showing a display brightness of a dark part gradation of an HLG signal in a similar manner to FIG. 25B. A solid line and a dashed line in FIG. 26 depict same characteristics as the solid line and the dashed line in FIG. 25B. Specifically, the solid line in FIG. 26 depicts an example in which a gradation range (a limited range) of 64 to 940 of an HLG signal is displayed in a brightness dynamic range of 0.005 to 1000 nit by the local dimming control and the image correction according to the first example in a similar manner to the solid line in FIG. 25B. In addition, the dashed line in FIG. 26 depicts an example in which a gradation range (a limited range+overly-white) of 64 to 1023 of the HLG signal is displayed in a brightness dynamic range of 0.009 to 1870 nit by the local dimming control and the image correction according to the first example in a similar manner to the dashed line in FIG. 25B.

A two-dot chain line in FIG. 26 depicts an example of showing the display brightness of the HLG signal in a case where the target contrast has been expanded with respect to the example depicted by the dashed line in FIG. 26. Specifically, in the example depicted by the two-dot chain line in FIG. 26, the target contrast (Ct) has been expanded by 1.87 times or, in other words, expanded to 370 thousand to 1 as compared to the case of the dashed line in FIG. 26. In this case, 1.87 is an inverse of a rate of increase of backlight brightness or, in other words, a reduction rate of white brightness. When performing the local dimming control and the image correction according to the first example using a target contrast of 370 thousand to 1 and a maximum display brightness of 1870 nit, the brightness dynamic range is approximately 0.005 to 1870 nit.

As described above, when increasing the backlight brightness in order to compensate for a reduction in white brightness due to image signal processing, expanding the target contrast in accordance with a rate of increase of the backlight brightness enables black floating to be suppressed.

The brightness adjustment coefficient calculating unit 112 shown in FIG. 24 calculates a reduction rate of white brightness attributable to the image signal processing by the image input/converting unit 101 and further calculates an inverse of the reduction rate of white brightness as the brightness adjustment coefficient Ladj. In the example depicted by the dashed-dotted line in FIGS. 25A and 25B, since the reduction rate of white brightness is 0.535, the brightness adjustment coefficient Ladj is 1/0.535=1.87.

The brightness adjustment coefficient Ladj is output to the backlight control value generating unit 102 and the correction coefficient generating unit 104. The backlight control value generating unit 102 outputs a value obtained by multiplying the backlight control value by the brightness adjustment coefficient Ladj to the backlight brightness estimating unit 103 and the backlight control unit 108. The correction coefficient generating unit 104 calculates a correction coefficient using the target contrast expanded by multiplying the target contrast (Ct) by the brightness adjustment coefficient Ladj.

As described above, in the sixth example, black floating can be suppressed while maintaining white brightness by respectively adjusting the backlight brightness and the target contrast in accordance with a reduction rate of white brightness. While an example in which white brightness declines due to overly-white display has been described in the sixth example, the sixth example is not limited thereto and is assumed to be applied to all cases where white brightness declines due to image signal processing such as color balance adjustment.

Seventh Example

Figure 27:
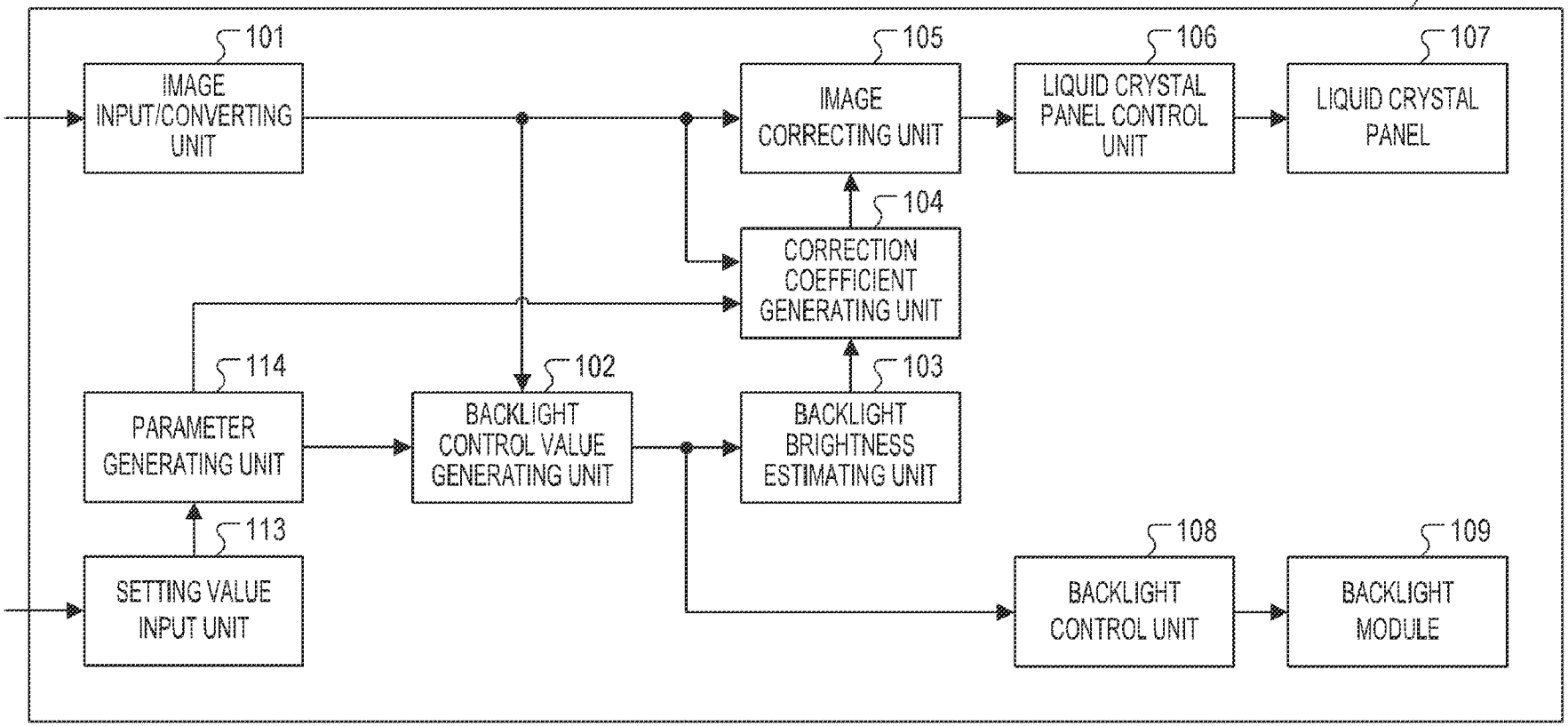
FIG. 27 is a block diagram showing functional blocks of a liquid crystal display apparatus according to a seventh example.

A seventh example of the present invention will be described below. In the seventh example, an example will be described in which a color gamut of a dark part region is expanded while displaying an input image with a desired display contrast. FIG. 27 is a block diagram showing functional blocks of the liquid crystal display apparatus 100 according to the seventh example. The liquid crystal display apparatus 100 shown in FIG. 27 has a configuration in which a setting value input unit 113 and a parameter generating unit 114 have been added to the liquid crystal display apparatus 100 shown in FIG. 1. Alternatively, the setting value input unit 113 and the parameter generating unit 114 can also be added to the liquid crystal display apparatus 100 shown in FIGS. 16 and 24.

The setting value input unit 113 inputs setting values related to local dimming control (image correction) from the outside. For example, a setting value related to local dimming control is for switching among display contrasts and states of dark part color gamut expansion and is input from the outside of the liquid crystal display apparatus 100 in accordance with a user operation with respect to an OSD menu such as that shown in FIG. 28A. For example, a setting value of the display contrast enables switching between high and low as shown in FIG. 28B. In addition, for example, a setting value of the dark part color gamut expansion enables switching between on and off as shown in FIG. 28C. The setting values shown in FIGS. 28A to 28C are examples of setting values related to local dimming control and another setting value such as an intensity of local dimming may be used instead.

Figure 29A:
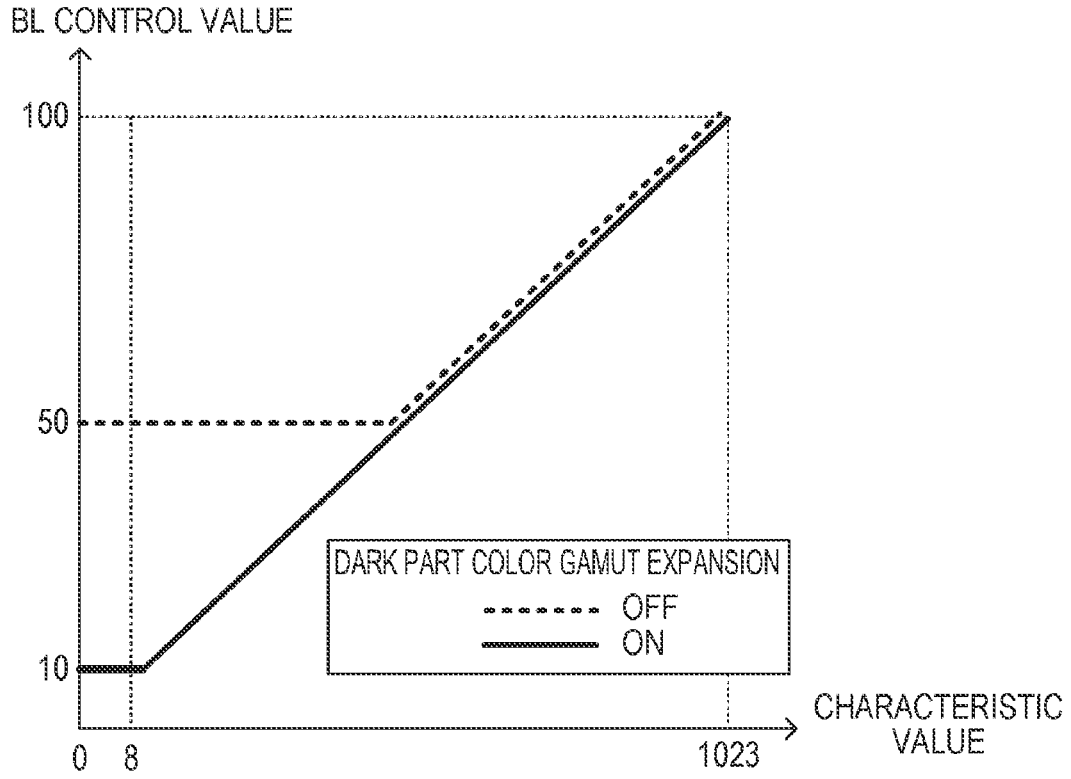
FIGS. 29A and 29B are diagrams showing examples of a BL control value according to the seventh example.
Figure 29B:
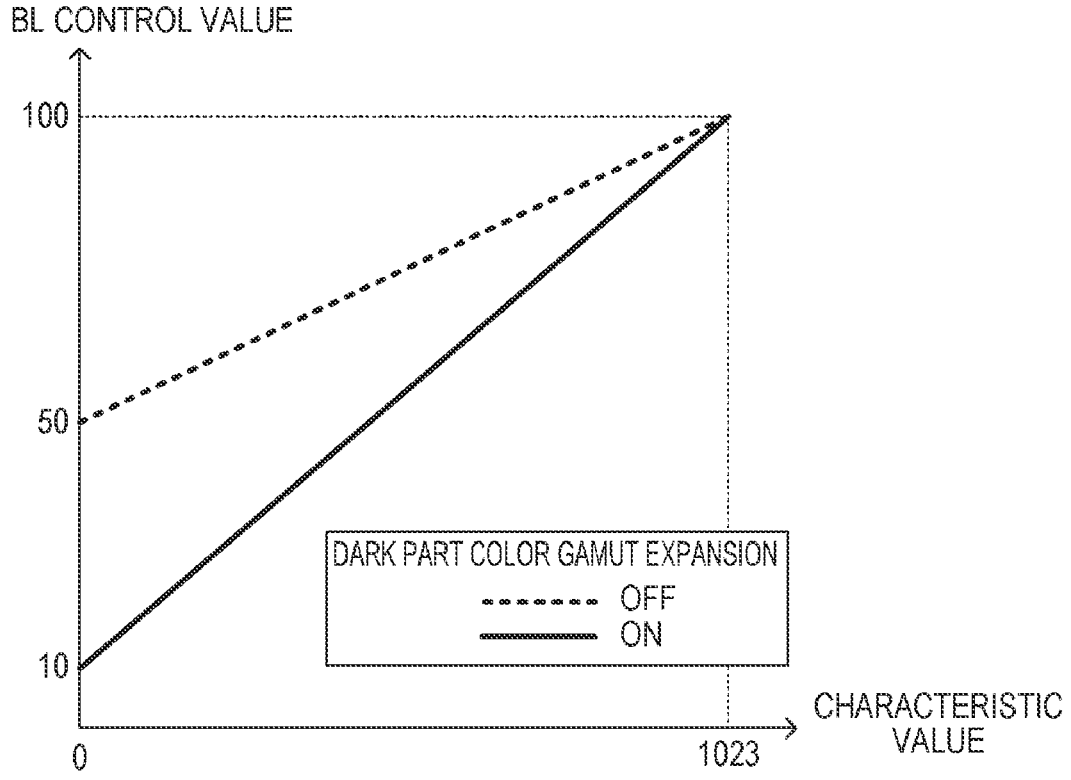

The parameter generating unit 114 generates a parameter related to local dimming control based on the setting value input by the setting value input unit 113. For example, the parameter related to local dimming control is a target contrast or a maximum value/minimum value of a backlight control value. The target contrast generated by the parameter generating unit 114 is output to the correction coefficient generating unit 104. In addition, the maximum value/minimum value of a backlight control value generated by the parameter generating unit 114 is output to the backlight control value generating unit 102. By limiting the backlight control value with the maximum value/minimum value, the backlight control value generating unit 102 can adjust a range of the backlight control value (BL control value) as shown in FIG. 29A. A solid line in FIG. 29A corresponds to a case where the setting value of dark part color gamut expansion is "on", and a range of the backlight control value (a brightness range of emission brightness of the backlight module 109) is 10 to 100. A dashed line in FIG. 29B corresponds to a case where the setting value of dark part color gamut expansion is "off", and a range of the backlight control value is 50 to 100.

It should be noted that the parameter to be output to the backlight control value generating unit 102 need not be the maximum value/minimum value of a backlight control value and may be another parameter such as a conversion table for converting a characteristic value of an input image into a backlight control value. For example, the conversion table has conversion characteristics such as those shown in FIG. 29B. For example, a characteristic value of an input image is a maximum value, an average value, or the like of the input image having been calculated for each divided region that is a unit of control by the backlight module 109.

Figure 30:
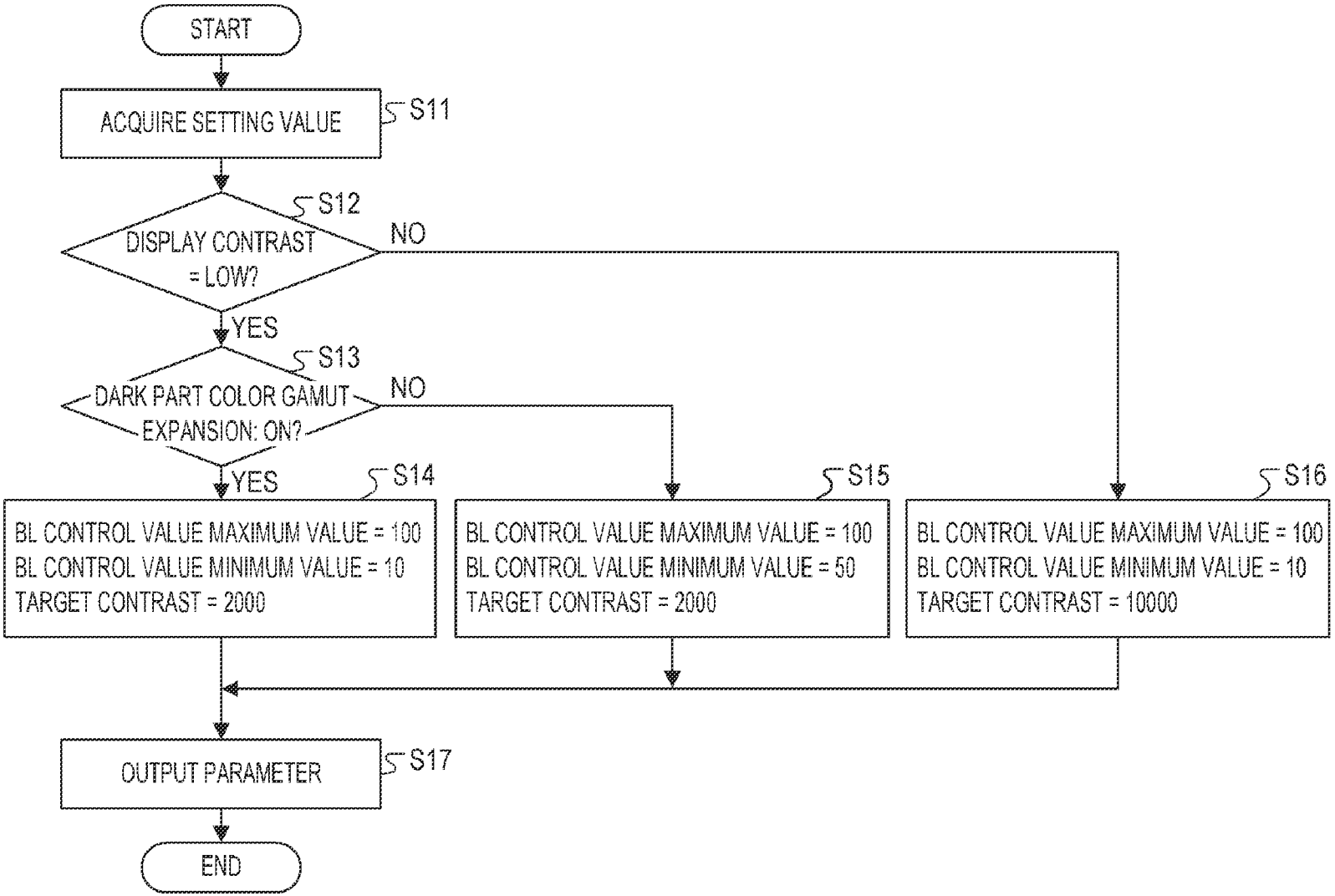
FIG. 30 is a flow chart showing an example of parameter generation processing according to the seventh example.

FIG. 30 is a flow chart showing parameter generation processing by the parameter generating unit 114.

In S11, the parameter generating unit 114 acquires setting values input by the setting value input unit 113 from the outside of the liquid crystal display apparatus 100. In the flow chart shown in FIG. 30, the setting values acquired in S11 are setting values related to the display contrast and dark part color gamut expansion as shown in FIGS. 28A to 28C.

In S12, the parameter generating unit 114 determines whether or not the setting value of the display contrast among the setting values acquired in S11 is "high" or "low". When it is determined in S12 that the setting value of the display contrast is "high", in S16, the parameter generating unit 114 generates parameters. The parameters generated in S16 include 100 as the maximum value of the backlight control value, 10 as the minimum value of the backlight control value, and 10000 as the target contrast.

When it is determined in S12 that the setting value of the display contrast is "low", in S13, the parameter generating unit 114 determines whether or not the setting value of dark part color gamut expansion is "on" or "off". When it is determined in S13 that the setting value of the dark part color gamut expansion is "on", in S14, the parameter generating unit 114 generates parameters. The parameters generated in S14 include 100 as the maximum value of the backlight control value, 10 as the minimum value of the backlight control value, and 2000 as the target contrast.

When it is determined in S13 that the setting value of the dark part color gamut expansion is "off, in S15, the parameter generating unit 114 generates parameters. The parameters generated in S15 include 100 as the maximum value of the backlight control value, 50 as the minimum value of the backlight control value, and 2000 as the target contrast.

In S17, among the parameters generated in S14 to S16, the parameter generating unit 114 outputs the maximum value/minimum value of the backlight control value to the backlight control value generating unit 102 and outputs the target contrast to the correction coefficient generating unit 104.

Figure 31:
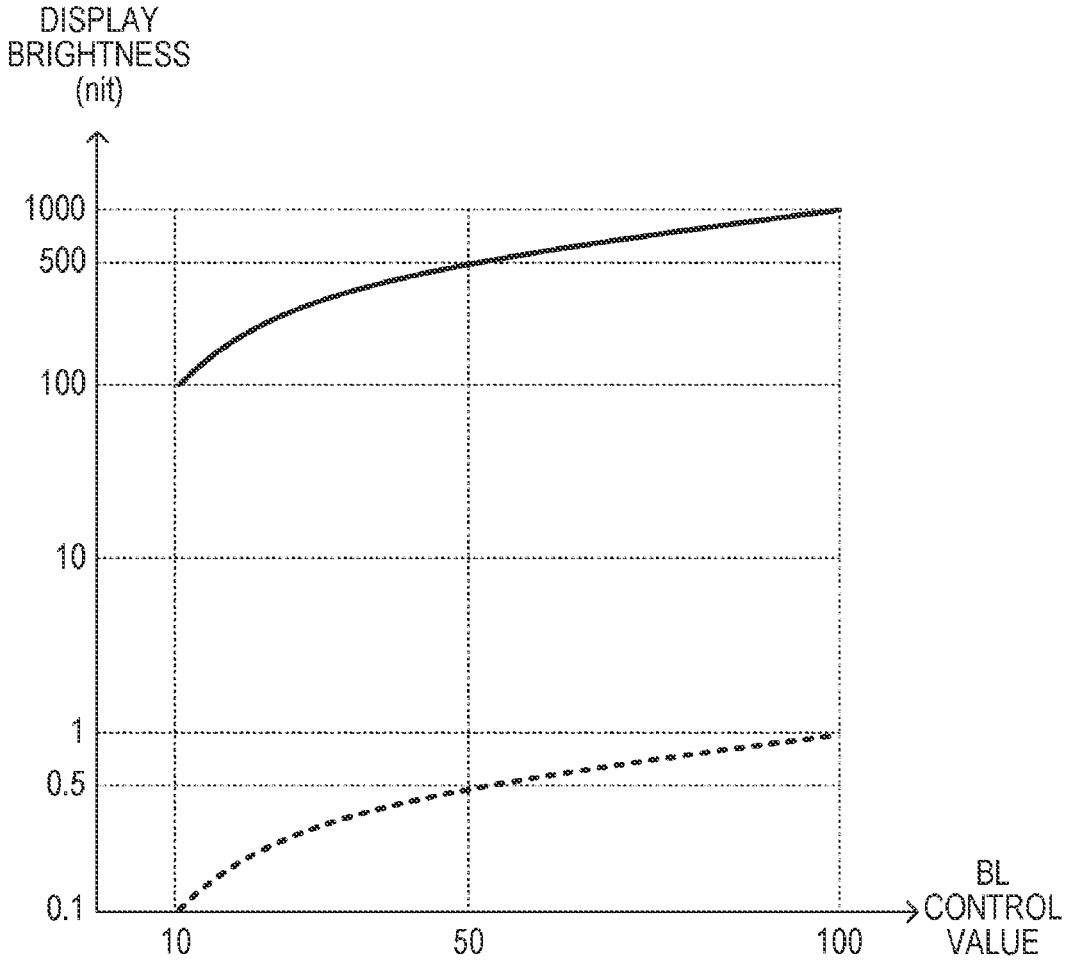
FIG. 31 is a diagram showing an example of display brightness according to the seventh example.

FIG. 31 is a schematic view showing a relationship between a backlight control value and display brightness of the liquid crystal display apparatus 100. A solid line in FIG. 31 depicts a maximum value of the display brightness of the liquid crystal display apparatus 100 when the backlight module 109 is caused to emit light using the backlight control value. A dashed line in FIG. 31 depicts a minimum value of the display brightness of the liquid crystal display apparatus 100 when the backlight module 109 is caused to emit light using the backlight control value. In this case, a panel contrast of the liquid crystal display apparatus 100 is assumed to be 1000 to 1.

In the example shown in FIG. 31, when the backlight control value is 100, the maximum value of the display brightness is 1000 nit. Furthermore, when the backlight control value is 100, since the panel contrast is 1000 to 1, the minimum value of the display brightness is 1 nit as shown in FIG. 31.

When the backlight control value is 50, the maximum value of the display brightness is 1/2 of the maximum value of the display brightness when the backlight control value is 100. Therefore, when the backlight control value is 50, the maximum value of the display brightness is 500 nit as shown in FIG. 31. Furthermore, when the backlight control value is 50, since the panel contrast is 1000 to 1, the minimum value of the display brightness is 0.5 nit as shown in FIG. 31.

When the backlight control value is 10, the maximum value of the display brightness is 1/10 of the maximum value of the display brightness when the backlight control value is 100. Therefore, when the backlight control value is 10, the maximum value of the display brightness is 100 nit as shown in FIG. 31. Furthermore, when the backlight control value is 10, since the panel contrast is 1000 to 1, the minimum value of the display brightness is 0.1 nit as shown in FIG. 31.

As described above, when the setting value of the display contrast is "low", the target contrast (a ratio of the target contrast; Ct) is 2000. In addition, when the setting value of dark part color gamut expansion is "off", the range of the backlight control value is 50 to 100. Furthermore, the maximum value of the display brightness is 1000 nit when the backlight control value is 100 and the minimum value of the display brightness is 0.5 nit when the backlight control value is 50. Therefore, when the setting value of the display contrast is "low" and the setting value of dark part color gamut expansion is "off", a ratio (maximum value/minimum value) between the maximum value and the minimum value of the display contrast is 2000 which is equal to the target contrast (Ct).

On the other hand, when the setting value of dark part color gamut expansion is "on", the range of the backlight control value is 10 to 100. In addition, the maximum value of the display brightness is 1000 nit when the backlight control value is 100 and the minimum value of the display brightness is 0.1 nit when the backlight control value is 50. Therefore, when the setting value of the display contrast is "low" and the setting value of dark part color gamut expansion is "on", the ratio (maximum value/minimum value) between the maximum value and the minimum value of the display contrast is 10000 which is larger than the target contrast (Ct) of 2000.

FIGS. 32A to 34B are schematic views representing an RGB value after image correction by linear brightness. Specifically, the example shown in FIGS. 32A to 34B represents an RGB value having been converted into linear brightness by applying the correction coefficient Gt calculated by the correction coefficient generating unit 104 in accordance with expression (9) to an input image output by the image input/converting unit 101. In the example shown in FIGS. 32A to 34B, it is assumed that the panel contrast is 1000 to 1 (Cp=1000), the panel gamma is 2.0 (pg=2.0), and the maximum display brightness when the backlight brightness Le is 100% (Le=1.0) is 1000 nit. In this case, it is assumed that the backlight brightness when the backlight control value is 100 is 100%. When the RGB value of the input image is 0, image correction is disabled. Therefore, in FIGS. 32A to 34B, an example will be described in which the image input/converting unit 101 or the image correcting unit 105 limits a lower limit value of the RGB value of the input image prior to image correction to 1 (a 10-bit integer).

Figure 32A:
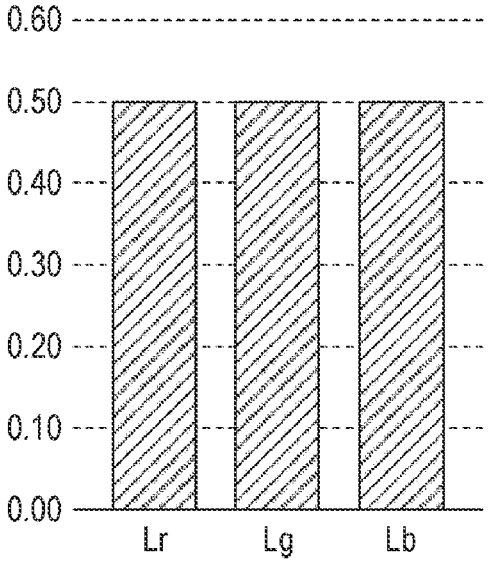
FIGS. 32A and 32B are diagrams showing a first specific example of image correction according to the seventh example.

FIGS. 32A to 33B are schematic views representing a linear brightness (brightness value) of each of RGB after image correction when the input image is achromatic. In FIGS. 32A and 32B, a case where the RGB value of the input image is R=1, G=1, and B=1 will be described, and in FIGS. 33A and 33B, a case where the RGB value of the input image is R=8, G=8, and B=8 will be described.

FIG. 32A represents a specific example of a brightness value for each of RGB when the RGB value of the input image is R=1, G=1, and B=1, the setting value of a display contrast input by the setting value input unit 113 is "low", and the setting value of dark part color gamut expansion is "off". When the setting value of the display contrast is "low" and the setting value of dark part color gamut expansion is "off", the minimum value of the backlight control value is calculated as 50 from the flow chart shown in FIG. 30. When the relationship between the maximum value of the input image and the backlight control value represents linear conversion characteristics, the lower limit value of the backlight control value is limited to 50 as indicated by the dashed line in FIG. 29A. Since the maximum value of the RGB value of the input image is 1, from characteristics of the dashed line in FIG. 29A, the backlight control value is 50 or, in other words, the backlight brightness is 50% (Le=0.5). Furthermore, when the setting value of the display contrast is "low" and the setting value of dark part color gamut expansion is "off", the target contrast is calculated as 2000 (Ct=2000) from the flow chart shown in FIG. 30. Therefore, the correction coefficient Gt calculated by the correction coefficient generating unit 104 in accordance with expression (9) is approximately 1.41 as represented by the following calculation formula.

[Math. 56]

$$Gt = \left( \frac{\left(\frac{1}{1023}\right)^{2.0} \times \frac{2000-1}{2000} + \frac{1}{2000} - \frac{0.5}{1000}}{\left(\frac{1}{1023}\right)^{2.0} \times \frac{1000-1}{1000} \times 0.5} \right)^{\frac{1}{2.0}} \approx 1.41$$

In addition, the RGB value after correction is R≈1, G≈1, and B≈1 as represented by the following calculation formula.

$$R=1\times1.41\approx1$$

$$G=1\times1.41\approx1$$

$$B=1\times1.41\approx1 \quad \text{[Math. 57]}$$

When the backlight control value is 50, the brightness dynamic range of the display brightness of the liquid crystal display apparatus 100 is 0.5 to 500 nit as shown in FIG. 31. Since values in the RGB value after correction are all the same, by converting the RGB value into linear brightness and normalizing to 0.5 to 500 as represented by the following calculation formula, a value equivalent to the display brightness is obtained. The brightness values Lr, Lg, and Lb calculated by the following calculation formula are all values around 0.5 as shown in FIG. 32A. In other words, when the RGB value after correction is displayed on the liquid crystal display apparatus 100, the display brightness is approximately 0.5 nit. A hatched section in FIG. 32A indicates that an offset due to black brightness is 0.5.

[Math. 58]

$$Lr=\left(\frac{1}{1023}\right)^{2.0}\times(500-0.5)+0.5\approx0.5$$

$$Lg=\left(\frac{1}{1023}\right)^{2.0}\times(500-0.5)+0.5\approx0.5$$

$$Lb=\left(\frac{1}{1023}\right)^{2.0}\times(500-0.5)+0.5\approx0.5$$

Figure 32B:
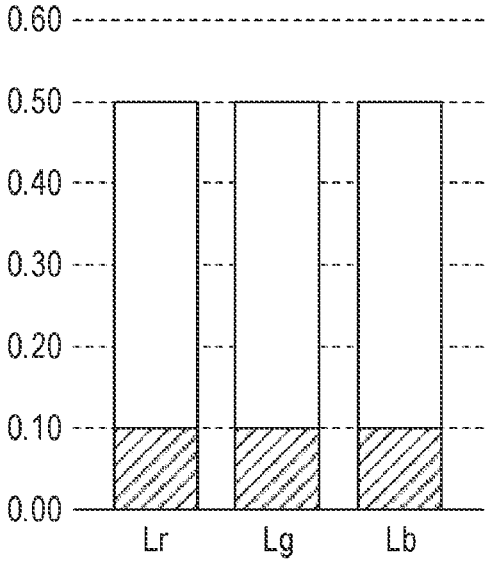

FIG. 32B represents a specific example of a brightness value for each of RGB when the RGB value of the input image is R=1, G=1, and B=1, the setting value of the display contrast having been input by the setting value input unit 113 is "low", and the setting value of dark part color gamut expansion is "on". When the setting value of the display contrast is "low" and the setting value of dark part color gamut expansion is "on", the minimum value of the backlight control value is calculated as 10 from the flow chart shown in FIG. 30. When the relationship between the maximum value of the input image and the backlight control value represents linear conversion characteristics, the lower limit value of the backlight control value is limited to 10 as indicated by the solid line in FIG. 29A. Since the maximum value of the RGB value of the input image is 1, from characteristics of the solid line in FIG. 29A, the backlight control value is 10 or, in other words, the backlight brightness is 10% (Le=0.1). Furthermore, when the setting value of the display contrast is "low" and the setting value of dark part color gamut expansion is "on", the target contrast is calculated as 2000 (Ct=2000) from the flow chart shown in FIG. 30. Therefore, the correction coefficient Gt calculated by the correction coefficient generating unit 104 in accordance with expression (9) is approximately 64.81 as represented by the following calculation formula

[Math. 59]

$$Gt=\left(\frac{\left(\frac{1}{1023}\right)^{2.0}\times\frac{2000-1}{2000}+\frac{1}{2000}-\frac{0.1}{1000}}{\left(\frac{1}{1023}\right)^{2.0}\times\frac{1000-1}{1000}\times0.1}\right)^{\frac{1}{2.0}}\approx64.81$$

In addition, the RGB value after correction is R≈64, G≈64, and B≈64 as represented by the following calculation formula.

$$R=1\times64.81\approx64$$

$$G=1\times64.81\approx64$$

$$B=1\times64.81\approx64 \quad \text{[Math. 60]}$$

When the backlight control value is 10, the brightness dynamic range of the display brightness of the liquid crystal display apparatus 100 is 0.1 to 100 nit as shown in FIG. 31. Since values in the RGB value after correction are all the same, by converting the RGB value into linear brightness and normalizing to 0.1 to 100 as represented by the following calculation formula, a value equivalent to the display brightness is obtained. The brightness values Lr, Lg, and Lb calculated by the following calculation formula are all values around 0.5 as shown in FIG. 32B. In other words, when the RGB value after correction is displayed on the liquid crystal display apparatus 100, the display brightness is approximately 0.5 nit. A hatched section in FIG. 32B indicates that an offset due to black brightness is 0.1.

[Math. 61]

$$Lr=\left(\frac{64}{1023}\right)^{2.0}\times(100-0.1)+0.1\fallingdotseq0.5$$

$$Lg=\left(\frac{64}{1023}\right)^{2.0}\times(100-0.1)+0.1\fallingdotseq0.5$$

$$Lb=\left(\frac{64}{1023}\right)^{2.0}\times(100-0.1)+0.1\fallingdotseq0.5$$

Figure 33A:
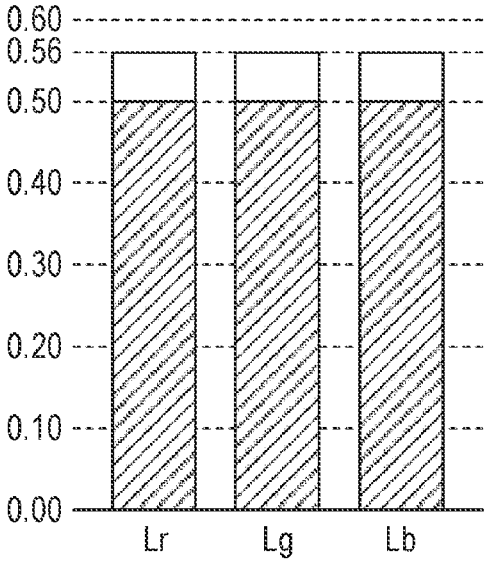
FIGS. 33A and 33B are diagrams showing a second specific example of image correction according to the seventh example.

FIG. 33A represents a specific example of a brightness value for each of RGB when the RGB value of the input image is R=8, G=8, and B=8, the setting value of the display contrast input by the setting value input unit 113 is "low", and the setting value of dark part color gamut expansion is "off". When the setting value of the display contrast is "low" and the setting value of dark part color gamut expansion is "off", the minimum value of the backlight control value is calculated as 50 from the flow chart shown in FIG. 30. When the relationship between the maximum value of the input image and the backlight control value represents linear conversion characteristics, the lower limit value of the backlight control value is limited to 50 as indicated by the dashed line in FIG. 29A. Since the maximum value of the RGB value of the input image is 8, from characteristics of the dashed line in FIG. 29A, the backlight control value is 50 or, in other words, the backlight brightness is 50% (Le=0.5). Furthermore, when the setting value of the display contrast is "low" and the setting value of dark part color gamut expansion is "off", the target contrast is calculated as 2000 (Ct=2000) from the flow chart shown in FIG. 30. Therefore, the correction coefficient Gt calculated by the correction coefficient generating unit 104 in accordance with expression (9) is approximately 1.41 as represented by the following calculation formula.

[Math. 62]

$$Gt = \left( \frac{\left(\frac{8}{1023}\right)^{2.0} \times \frac{2000-1}{2000} + \frac{1}{2000} - \frac{0.5}{1000}}{\left(\frac{8}{1023}\right)^{2.0} \times \frac{1000-1}{1000} \times 0.5} \right)^{\frac{1}{2.0}} \approx 1.41$$

In addition, the RGB value after correction is R≈11, G≈11, and B≈11 as represented by the following calculation formula.

$$R=8\times1.41\approx11$$

$$G=8\times1.41\approx11$$

$$B=8\times1.41\approx11$$

[Math. 63]

When the backlight control value is 50, the brightness dynamic range of the display brightness of the liquid crystal display apparatus 100 is 0.5 to 500 nit as shown in FIG. 31. Since values in the RGB value after correction are all the same, by converting the RGB value into linear brightness and normalizing to 0.5 to 500 as represented by the following calculation formula, a value equivalent to the display brightness is obtained. The brightness values Lr, Lg, and Lb calculated by the following calculation formula are all values around 0.56 as shown in FIG. 33A. In other words, when the RGB value after correction is displayed on the liquid crystal display apparatus 100, the display brightness is approximately 0.56 nit. A hatched section in FIG. 33A indicates that an offset due to black brightness is 0.5.

[Math. 64]

$$Lr = \left(\frac{11}{1023}\right)^{2.0} \times (500-0.5)+0.5 \fallingdotseq 0.56$$

$$Lg = \left(\frac{11}{1023}\right)^{2.0} \times (500-0.5)+0.5 \fallingdotseq 0.56$$

$$Lb = \left(\frac{11}{1023}\right)^{2.0} \times (500-0.5)+0.5 \fallingdotseq 0.56$$

Figure 33B:
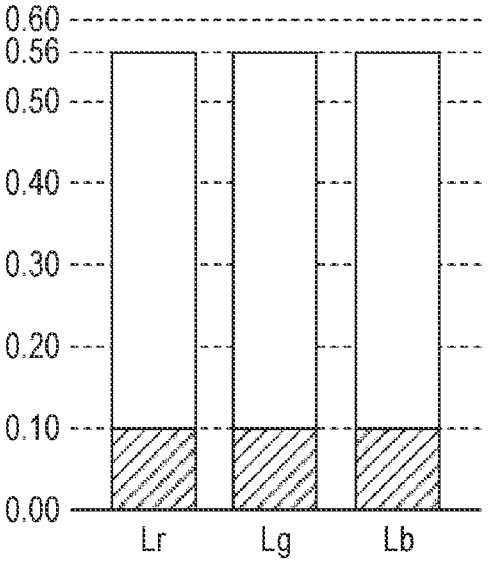

FIG. 33B represents a specific example of a brightness value for each of RGB when the RGB value of the input image is R=8, G=8, and B=8, the setting value of the display contrast input by the setting value input unit 113 is "low", and the setting value of dark part color gamut expansion is "on". When the setting value of the display contrast is "low" and the setting value of dark part color gamut expansion is "on", the minimum value of the backlight control value is calculated as 10 from the flow chart shown in FIG. 30. When the relationship between the maximum value of the input image and the backlight control value represents linear conversion characteristics, the lower limit value of the backlight control value is limited to 10 as indicated by the solid line in FIG. 29A. Since the maximum value of the RGB value of the input image is 8, from characteristics of the solid line in FIG. 29A, the backlight control value is 10 or, in other words, the backlight brightness is 10% (Le=0.1). Furthermore, when the setting value of the display contrast is "low" and the setting value of dark part color gamut expansion is "on", the target contrast is calculated as 2000 (Ct=2000) from the flow chart shown in FIG. 30. Therefore, the correction coefficient Gt calculated by the correction coefficient generating unit 104 in accordance with expression (9) is approximately 8.69 as represented by the following calculation formula

[Math. 65]

$$Gt = \left( \frac{\left(\frac{8}{1023}\right)^{2.0} \times \frac{2000-1}{2000} + \frac{1}{2000} - \frac{0.1}{1000}}{\left(\frac{8}{1023}\right)^{2.0} \times \frac{1000-1}{1000} \times 0.2} \right)^{\frac{1}{2.0}} \approx 8.69$$

In addition, the RGB value after correction is R≈69, G≈69, and B≈69 as represented by the following calculation formula.

$$R=8\times8.69\approx69$$

$$G=8\times8.69\approx69$$

$$B=8\times8.69\approx69$$

[Math. 66]

When the backlight control value is 10, the brightness dynamic range of the display brightness of the liquid crystal display apparatus 100 is 0.1 to 100 nit as shown in FIG. 31. Since values in the RGB value after correction are all the same, by converting the RGB value into linear brightness and normalizing to 0.1 to 100 as represented by the following calculation formula, a value equivalent to the display brightness is obtained. The brightness values Lr, Lg, and Lb calculated by the following calculation formula are all values around 0.56 as shown in FIG. 33B. In other words, when the RGB value after correction is displayed on the liquid crystal display apparatus 100, the display brightness is approximately 0.56 nit. A hatched section in FIG. 33B indicates that an offset due to black brightness is 0.1.

[Math. 67]

$$Lr = \left(\frac{69}{1023}\right)^{2.0} \times (100-0.1)+0.1 \fallingdotseq 0.56$$

$$Lg = \left(\frac{69}{1023}\right)^{2.0} \times (100-0.1)+0.1 \fallingdotseq 0.56$$

$$Lb = \left(\frac{69}{1023}\right)^{2.0} \times (100-0.1)+0.1 \fallingdotseq 0.56$$

As shown in FIG. 32A to 33B, when the input image is achromatic, even when the backlight brightness is reduced, display brightness is compensated by image correction. In other words, the input image can be displayed with the target contrast regardless of the backlight brightness.

Figure 34A:
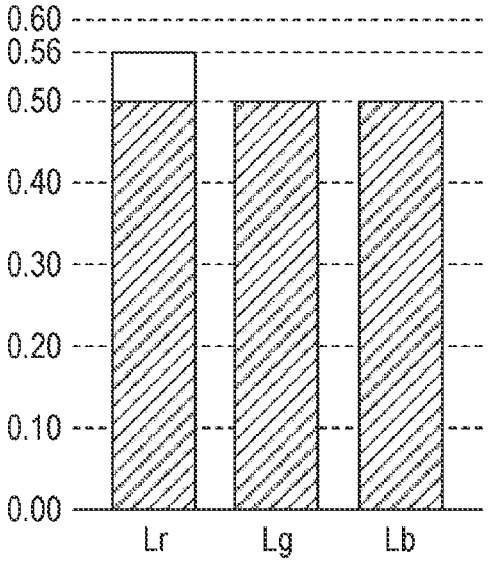
FIGS. 34A and 34B are diagrams showing a third specific example of image correction according to the seventh example.
Figure 34B:
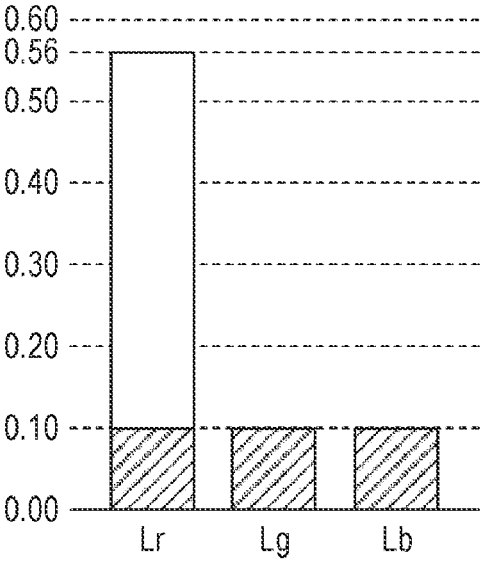

FIGS. 34A and 34B are schematic views representing a linear brightness (brightness value) of each of RGB after image correction when the input image is chromatic. In the example shown in FIGS. 34A and 34B, a case where the RGB value of the input image is R=8, G=1, and B=1 will be described.

FIG. 34A represents a specific example of a brightness value for each of RGB when the RGB value of the input image is R=8, G=1, and B=1, the setting value of the display contrast input by the setting value input unit 113 is "low", and the setting value of dark part color gamut expansion is "off". When the setting value of the display contrast is "low" and the setting value of dark part color gamut expansion is "off", the minimum value of the backlight control value is calculated as 50 from the flow chart shown in FIG. 30. When the relationship between the maximum value of the input image and the backlight control value represents linear conversion characteristics, the lower limit value of the backlight control value is limited to 50 as indicated by the dashed line in FIG. 29A. Since the maximum value of the RGB value of the input image is 8, from characteristics of the dashed line in FIG. 29A, the backlight control value is 50 or, in other words, the backlight brightness is 50% (Le=0.5). Furthermore, when the setting value of the display contrast is "low" and the setting value of dark part color gamut expansion is "off", the target contrast is calculated as 2000 (Ct=2000) from the flow chart shown in FIG. 30. Therefore, the correction coefficient Gt calculated by the correction coefficient generating unit 104 in accordance with expression (9) is approximately 1.41 as represented by the following calculation formula

[Math. 68]

$$Gt = \left( \frac{\left(\frac{8}{1023}\right)^{2.0} \times \frac{2000-1}{2000} + \frac{1}{2000} - \frac{0.5}{1000}}{\left(\frac{8}{1023}\right)^{2.0} \times \frac{1000-1}{1000} \times 0.5} \right)^{\frac{1}{2.0}} \approx 1.41$$

In addition, the RGB value after correction is R≈11, G≈1, and B≈1 as represented by the following calculation formula.

$$R=8\times1.41\approx11$$

$$G=1\times1.41\approx1$$

$$B=1\times1.41\approx1$$

[Math. 69]

When the backlight control value is 50, the brightness dynamic range of the display brightness of the liquid crystal display apparatus 100 is 0.5 to 500 nit as shown in FIG. 31. In a similar manner to the example shown in FIGS. 32A and 33A, when the RGB value after correction is converted into linear brightness and normalized to 0.5 to 500 in accordance with the following calculation formula, the brightness value Lr is approximately 0.56 and the brightness values Lg and Lb are approximately 0.5 as shown in FIG. 34A. A hatched section in FIG. 34A indicates that an offset due to black brightness is 0.5.

[Math. 70]

$$Lr = \left(\frac{11}{1023}\right)^{2.0} \times (500-0.5)+0.5 \fallingdotseq 0.56$$

$$Lg = \left(\frac{1}{1023}\right)^{2.0} \times (500-0.5)+0.5 \fallingdotseq 0.5$$

$$Lb = \left(\frac{1}{1023}\right)^{2.0} \times (500-0.5)+0.5 \fallingdotseq 0.5$$

FIG. 34B represents a specific example of a brightness value for each of RGB when the RGB value of the input image is R=8, G=1, and B=1, the setting value of the display contrast input by the setting value input unit 113 is "low", and the setting value of dark part color gamut expansion is "on". When the setting value of the display contrast is "low" and the setting value of dark part color gamut expansion is "off", the minimum value of the backlight control value is calculated as 10 from the flow chart shown in FIG. 30. When the relationship between the maximum value of the input image and the backlight control value represents linear conversion characteristics, the lower limit value of the backlight control value is limited to 10 as indicated by the solid line in FIG. 29A. Since the maximum value of the RGB value of the input image is 8, from characteristics of the solid line in FIG. 29A, the backlight control value is 10 or, in other words, the backlight brightness is 10% (Le=0.1). Furthermore, when the setting value of the display contrast is "low" and the setting value of dark part color gamut expansion is "on", the target contrast is calculated as 2000 (Ct=2000) from the flow chart shown in FIG. 30. Therefore, the correction coefficient Gt calculated by the correction coefficient generating unit 104 in accordance with expression (9) is approximately 8.69 as represented by the following calculation formula

[Math. 71]

$$Gt = \left( \frac{\left(\frac{8}{1023}\right)^{2.0} \times \frac{2000-1}{2000} + \frac{1}{2000} - \frac{0.1}{1000}}{\left(\frac{8}{1023}\right)^{2.0} \times \frac{1000-1}{1000} \times 0.2} \right)^{\frac{1}{2.0}} \approx 8.69$$

In addition, the RGB value after correction is R≈69, G≈8, and B≈8 as represented by the following calculation formula.

$$R=8\times8.69\approx69$$

$$G=1\times8.69\approx8$$

$$B=1\times8.69\approx8$$

[Math. 72]

When the backlight control value is 10, the brightness dynamic range of the display brightness of the liquid crystal display apparatus 100 is 0.1 to 100 nit as shown in FIG. 31. In a similar manner to the example shown in FIGS. 32B and 33B, when the RGB value after correction is converted into linear brightness and normalized to 0.1 to 100 in accordance with the following calculation formula, the brightness value Lr is approximately 0.56 and the brightness values Lg and Lb are approximately 0.1 as shown in FIG. 34B. A hatched section in FIG. 34B indicates that an offset due to black brightness is 0.1. The example shown in FIG. 34B reveals that intensity of an R component with respect to black brightness relatively increases as compared to the example shown in FIG. 34A.

[Math. 73]

$$Lr = \left(\frac{69}{1023}\right)^{2.0} \times (100-0.1)+0.1 \fallingdotseq 0.56$$

$$Lr = \left(\frac{8}{1023}\right)^{2.0} \times (100-0.1)+0.1 \fallingdotseq 0.1$$

$$Lb = \left(\frac{8}{1023}\right)^{2.0} \times (100-0.1)+0.1 \fallingdotseq 0.1$$

As shown in FIGS. 34A and 34B, when the setting value of dark part color gamut expansion is "on", a color component with a large gradation value among RGB is emphasized by reducing the backlight brightness (black brightness) while maintaining the target contrast of image correction. Accordingly, a color gamut of the dark part region can be expanded.

As described above, in the seventh example, the input image can be displayed with the target contrast even when the backlight brightness is adjusted. In addition, by respectively adjusting the target contrast and the backlight brightness, the color gamut of the dark part region can be expanded. While an example of expanding the color gamut of the dark part by reducing the backlight brightness while maintaining the target contrast has been described in the seventh example, a method of expanding the color gamut of the dark part is not limited thereto. For example, the color gamut of the dark part can also be expanded by increasing the target contrast while maintaining the backlight brightness.

According to the present disclosure, display in which a specific brightness error is suppressed can be performed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-189430, filed on Nov. 13, 2020, and Japanese Patent Application No. 2021-140204, filed on Aug. 30, 2021, which are hereby incorporated by reference herein in their entirety.

What is claimed is:

1. A liquid crystal display apparatus comprising:

a liquid crystal panel;

an input interface for inputting data of a first image;

a backlight module which is configured to irradiate light to the liquid crystal panel and of which emission brightness is changeable; and at least one memory and at least one processor which function as:

an estimating unit configured to estimate brightness of light to be irradiated from the backlight module to the liquid crystal panel;

a correcting unit configured to correct the first image to a second image based on the brightness estimated by the estimating unit, a contrast of the liquid crystal panel, and a target contrast so that a brightness error with respect to a display brightness in a case where the first image is displayed with the target contrast is suppressed; and a control unit configured to control transmittance of the liquid crystal panel based on data of the second image, wherein in a case where a value obtained by normalizing a gradation value of the first image to 0 to 1 is denoted by Vin, the target contrast is expressed as Ct to 1, the contrast of the liquid crystal panel is expressed as Cp to 1, a value obtained by normalizing the brightness estimated by the estimating unit to 0 to 1 is denoted by Le, and a gamma value of the liquid crystal panel is denoted by pg, the correcting unit calculates a gradation value of the second image by multiplying the gradation value of the first image by a correction coefficient Gt calculated using the following formula $$Gt = \left( \frac{Vin^{pg} \times \frac{Ct-1}{Ct} + \frac{1}{Ct} - \frac{Le}{Cp}}{Vin^{pg} \times \frac{Cp-1}{Cp} \times Le} \right)^{\frac{1}{pg}}.$$

2. The liquid crystal display apparatus according to claim 1, wherein the brightness error is a brightness error related to brightness of light to be irradiated from the backlight module to the liquid crystal panel and to the contrast of the liquid crystal panel.

3. The liquid crystal display apparatus according to claim 1, wherein the correcting unit corrects the first image so that the brightness error does not expand in association with an increase in brightness of light to be irradiated from the backlight module to the liquid crystal panel.

4. The liquid crystal display apparatus according to claim 1, wherein the correcting unit limits a lower limit value of the correction coefficient Gt to an inverse of the gradation value of the first image.

5. The liquid crystal display apparatus according to claim 1, further comprising a parameter input interface for inputting a parameter related to the target contrast from the outside.

6. The liquid crystal display apparatus according to claim 1, wherein the correcting unit corrects the first image so that blocked-up shadows do not occur in the second image.

7. The liquid crystal display apparatus according to claim 1, wherein the at least one memory and at least one processor further function as a changing unit configured to change the target contrast so that blocked-up shadows do not occur in the second image.

8. The liquid crystal display apparatus according to claim 7, wherein the changing unit performs multiplication by a gain value and addition of an offset value with respect to display brightness that is lower than reference brightness among display brightness in a case where display is performed with the target contrast.

9. The liquid crystal display apparatus according to claim 8, wherein the changing unit determines the reference brightness based on an average gradation value of the first image.

10. The liquid crystal display apparatus according to claim 8, wherein the changing unit determines the reference brightness based on a histogram of gradation values of the first image.

11. The liquid crystal display apparatus according to claim 7, wherein the changing unit changes display brightness that is lower than a multiplied brightness obtained by multiplying, by a gain value, display brightness in a case where display is performed with a contrast of the liquid crystal panel among display brightness in a case where display is performed with the target contrast, to the multiplied brightness.

12. The liquid crystal display apparatus according to claim 11, wherein the changing unit uses a smaller gain value as a gradation value of the first image is larger.

13. The liquid crystal display apparatus according to claim 1, wherein the at least one memory and at least one processor further function as:

an image signal processing unit configured to perform image signal processing with respect to the first image; and a brightness adjustment coefficient calculating unit configured to calculate a brightness adjustment coefficient based on a reduction rate of display brightness due to image signal processing by the image signal processing unit, wherein the backlight module adjusts emission brightness based on the brightness adjustment coefficient, and the correcting unit adjusts the target contrast based on the brightness adjustment coefficient.

14. The liquid crystal display apparatus according to claim 13, wherein the brightness adjustment coefficient is an inverse of the reduction rate of the display brightness.

15. The liquid crystal display apparatus according to claim 1, wherein the at least one memory and at least one processor further function as: an adjusting unit configured to adjust the target contrast and a brightness range of the emission brightness, wherein a ratio between a maximum value and a minimum value of the emission brightness in a case where the backlight module is caused to emit light in the brightness range adjusted by the adjusting unit is larger than a ratio of the target contrast adjusted by the adjusting unit.

16. The liquid crystal display apparatus according to claim 15, further comprising a setting value input interface for inputting a setting value from the outside, wherein the adjusting unit adjusts the target contrast and the brightness range based on a setting value input from the setting value input interface.

17. The liquid crystal display apparatus according to claim 1, wherein the correcting unit limits a lower limit value of a gradation value of the first image to a value larger than 0.

18. The liquid crystal display apparatus according to claim 1, wherein the correcting unit calculates a gradation value of the second image by multiplying a gradation value of the first image by a correction coefficient based on the brightness estimated by the estimating unit, the contrast of the liquid crystal panel, and the target contrast.

19. A control method of a liquid crystal display apparatus including a liquid crystal panel, an input interface for inputting data of a first image, and a backlight module which is configured to irradiate light to the liquid crystal panel and of which emission brightness is changeable, the control method comprising:

an estimating step of estimating brightness of light to be irradiated from the backlight module to the liquid crystal panel;

a correcting step of correcting the first image to a second image based on the brightness estimated in the estimating step, a contrast of the liquid crystal panel, and a target contrast so that a brightness error with respect to a display brightness in a case where the first image is displayed with the target contrast is suppressed; and a control step of controlling transmittance of the liquid crystal panel based on data of the second image, wherein in a case where a value obtained by normalizing a gradation value of the first image to 0 to 1 is denoted by Vin, the target contrast is expressed as Ct to 1, the contrast of the liquid crystal panel is expressed as Cp to 1, a value obtained by normalizing the brightness estimated in the estimating step to 0 to 1 is denoted by Le, and a gamma value of the liquid crystal panel is denoted by pg, in the correcting step, a gradation value of the second image in calculated by multiplying the gradation value of the first image by a correction coefficient Gt calculated using the following formula $$Gt = \left( \frac{Vin^{pg} \times \frac{Ct-1}{Ct} + \frac{1}{Ct} - \frac{Le}{Cp}}{Vin^{pg} \times \frac{Cp-1}{Cp} \times Le} \right)^{\frac{1}{pg}}.$$

20. A non-transitory computer readable medium that stores a program, wherein the program causes a computer to execute a control method of a liquid crystal display apparatus including a liquid crystal panel, an input interface for inputting data of a first image, and a backlight module which is configured to irradiate light to the liquid crystal panel and of which emission brightness is changeable, the control method comprising:

an estimating step of estimating brightness of light to be irradiated from the backlight module to the liquid crystal panel;

a correcting step of correcting the first image to a second image based on the brightness estimated in the estimating step, a contrast of the liquid crystal panel, and a target contrast so that a brightness error with respect to a display brightness in a case where the first image is displayed with the target contrast is suppressed; and a control step of controlling transmittance of the liquid crystal panel based on data of the second image, wherein in a case where a value obtained by normalizing a gradation value of the first image to 0 to 1 is denoted by Vin, the target contrast is expressed as Ct to 1, the contrast of the liquid crystal panel is expressed as Cp to 1, a value obtained by normalizing the brightness estimated in the estimating step to 0 to 1 is denoted by Le, and a gamma value of the liquid crystal panel is denoted by pg, in the correcting step, a gradation value of the second image is calculated by multiplying the gradation value of the first image by a correction coefficient Gt calculated using the following formula $$Gt = \left( \frac{Vin^{pg} \times \frac{Ct-1}{Ct} + \frac{1}{Ct} - \frac{Le}{Cp}}{Vin^{pg} \times \frac{Cp-1}{Cp} \times Le} \right)^{\frac{1}{pg}}.$$

* * * * *